US007129918B2

(12) United States Patent
Kimura

(10) Patent No.: US 7,129,918 B2
(45) Date of Patent: Oct. 31, 2006

(54) ELECTRONIC DEVICE AND METHOD OF DRIVING ELECTRONIC DEVICE

(75) Inventor: Hajime Kimura, Kanagawa (JP)

(73) Assignee: Semiconductor Energy Laboratory Co., Ltd., Atsugi (JP)

( * ) Notice: Subject to any disclaimer, the term of this patent is extended or adjusted under 35 U.S.C. 154(b) by 834 days.

(21) Appl. No.: 09/797,994

(22) Filed: Mar. 5, 2001

(65) Prior Publication Data

US 2001/0022565 A1 Sep. 20, 2001

(30) Foreign Application Priority Data

Mar. 10, 2000 (JP) ..... 2000-067793

(51) Int. Cl.
*G09G 3/30* (2006.01)

(52) U.S. Cl. ..... 345/82; 348/89; 348/77

(58) Field of Classification Search ..... 345/76, 345/39, 46, 63, 82, 89; 315/169.3
See application file for complete search history.

(56) References Cited

U.S. PATENT DOCUMENTS

| | | | | |
|---|---|---|---|---|
| 5,247,190 | A | 9/1993 | Friend et al. | |
| 5,399,502 | A | 3/1995 | Friend et al. | |
| 5,615,027 | A * | 3/1997 | Kuribayashi et al. | 349/87 |
| 5,990,629 | A * | 11/1999 | Yamada et al. | 315/169.3 |
| 6,583,775 | B1 | 6/2003 | Sekiya et al. | 345/76 |
| 6,611,108 | B1 * | 8/2003 | Kimura | 315/169.3 |
| 2001/0017618 | A1 * | 8/2001 | Azami | 345/204 |
| 2001/0035849 | A1 * | 11/2001 | Kimura et al. | 345/76 |

FOREIGN PATENT DOCUMENTS

WO WO90/13148 11/1990

OTHER PUBLICATIONS

Japanese Patent Application Laid–Open No. 11–176521 (English Abstract).
Japanese Patent Application Laid–Open No. 10–92576 (English Abstract).
H. Shenk et al., "Polymers for Light–emitting Diodes", Euro Display Proceedings, pp. 33–37, (1999).
Tsutsui et al., "Electroluminescence in Organic Thin Films", Photochemical Processes in Organized Molecular Systems, pp. 437–450, (1991).
M. A. Baldo et al., "Highly Efficient Phosphorescent Emission from Organic Electroluminescent Devices", Nature vol. 395, pp. 151–154, (Sep. 10, 1998).
M. A. Baldo et al., "Very High–Efficiency Green Organic Light–Emitting Devices Based on Electrophosphorescence", Applied Physics Letters vol. 75, No. 1, pp. 4–6, (Jul. 5, 1999).
Tsutsui et al., "High Quantum Efficiency in Organic Light–Emitting Devices with Irdium–Comolex As A triplet Emissive Center", Japanese Journal of Applied Physics vol. 38, Part 12B, pp. L1502–L1504, (Dec. 15, 1999).

(Continued)

*Primary Examiner*—Amare Mengistu
(74) *Attorney, Agent, or Firm*—Fish & Richardson P.C.

(57) ABSTRACT

Problems such as insufficient brightness, caused by a reduction in duty ratio (the ratio of a light emitting period and a non-light emitting period), are improved upon in accordance with using a novel method of driving and a novel circuit in an electronic device. Signals are written into pixels of a plurality of differing lines during one gate signal line selection period. By arbitrarily setting, to a certain extent, the time from when a signal is input into the pixels of a certain line until the next signal is input to the same pixels, while ensuring the time for writing into the pixels, a sustain (turn on) period can be arbitrarily set and a high duty ratio is realized.

18 Claims, 37 Drawing Sheets

OTHER PUBLICATIONS

Shimoda et al., "Current Status and Future of Light–Emitting Polymer Display Driven by Poly–Si TFT", SID 99 Digest, pp. 372–375.
Han et al., "Green OLED with low temperature poly Si TFT", Euro Display 99 Late–news Papers, pp. 27–30, (Sep., 1999).
Kimura et al., "TFT–LEPD with Image Uniformity by Area Ratio Gray Scale", Euro Display 99 Late–news papers, pp. 71–74, (Sep., 1999).
Shimoda et al., "Technology for Active Matrix Light Emitting Polymer Displays" IEDM 99, pp. 107–110, (1999).
Kimura et al., "Low Temperature Poly–Si TFT Driven Light–Emitting–Polymer Display and Digital Gray Scale for Uniformity", IDW 99, pp. 171–174, (1999).
Shimoda et al., "High Resolution Light Emitting Polymer Display Driven by Low Temperature Polysilicon Thin Film Transistor with Integrated Driver", Asia Display 98, pp. 217–220, (1998).

* cited by examiner

5001 : substrate 5002 : base film 5003, 5004, 5005, 5006 : semiconductor film 5007 : gate insulating film 5008 : Si film
5009 : Ta film 5010, 5011, 5012, 5013, 5014 : gate electrode 5024, 5025 : resist mask 5501 : wiring 5052, 5057, 5060, 5061, 5069 : channel forming region 5053, 5062 : first impurity region (source region) 5054, 5064 : first impurity region (drain region)
5063 : first impurity region (source/drain region) 5058, 5071 : third impurity region (drain region) 5059, 5070 : third impurity region (source region)
5055a, 5056a, 5065a, 5066a, 5067a, 5068a : second impurity region (GOLD region) 5055b, 5056b, 5065b, 5066b, 5067b, 5068b : second impurity region (LDD region)

11 : sub-gate period selection pulse A
12 : sub-gate period selection pulse B operations of (A) and (B) are performed in parallel by two source signal line side driving circuit data signals holded in second latch circuit by first and second source signal line side driving circuit are written into pixels in the first and latter halves of next gate signal line selection period

ELECTRONIC DEVICE AND METHOD OF DRIVING ELECTRONIC DEVICE

BACKGROUND OF THE INVENTION

1. Field of the Invention

The present invention relates to an electronic device and to a method of driving an electronic device. In particular, the present invention relates to an active matrix electronic device having a thin film transistor (TFT) formed on an insulating substrate, and to a method of driving an active matrix electronic device. From among all active matrix electronic devices, the present invention relates, in particular, to an active matrix electronic device using a self light emitting element, such as an OLED (Organic Light Emitting Diode) element, and to a method of driving such an active matrix electronic device.

2. Description of the Related Art

OLED displays have been gathering attention in recent years as flat display substitutes for LCDs (liquid crystal displays), and research into OLED displays is proceeding apace.

LCDs can roughly be divided into two types of driving methods. One is a passive matrix type using an LCD such as an STN-LCD, and the other is an active matrix type using an LCD such as a TFT-LCD. OLED displays are similarly divided roughly into two types; one a passive type, and the other an active type.

For a case of the passive type, wirings which become electrodes are arranged in portions above and below an OLED element. Voltages are applied in order to the wirings, and the OLED elements turn on due to the electric current flowing. On the other hand, each pixel has a transistor in a case of the active type, and a signal can be stored within each pixel.

A schematic diagram of an active type OLED display device is shown in FIG. 21A. A source signal line driver circuit 2151, a gate signal line driver circuit 2152, and a pixel portion 2153 are arranged on a substrate 2150. The gate signal line driver circuit is arranged on both sides of the pixel portion in FIG. 21A, but it may also be placed on only one side. A signal for driving the display device is input to each driver circuit in accordance with a flexible printed circuit (FPC) 2154.

FIG. 21B shows an enlargement of a portion of the pixel portion 2153, 3×3 pixels. The portion surrounded by a dotted line frame 2100 is one pixel. Reference numeral 2101 denotes a TFT which functions as a switching element when a signal is written into the pixel (hereafter referred to as a switching TFT). The switching TFTs may be n-channel TFTs or p-channel TFTs in FIGS. 21A and 21B. Reference numeral 2102 denotes a TFT (hereafter referred to as an OLED driver TFT) which functions as an element (electric current control element) for controlling the electric current supplied to an OLED element 2103. The OLED driver TFT is arranged between an anode of the OLED element 2103 and an electric current supply line 2107 when the OLED driver TFT is a p-channel TFT. As another type of separate structure, it is also possible to use an n-channel TFT or to arrange the OLED driver TFT between a cathode of the OLED element 2103 and a cathode wiring. However, a method in which the OLED driver TFT is arranged between an anode of the OLED element 2103 and the electric current supply line 2107 is best when using a p-channel TFT as the OLED driver TFT because the transistor operation is good with its source grounded and because of the constraints on the production of the OLED element 2103, and therefore this method is often employed. Reference numeral 2104 denotes a storage capacitor for storing a signal (voltage) input from a source signal line 2106. One of the terminals of the storage capacitor 2104 is connected to the electric current supply line 2107 in FIG. 21B, but it is also possible to use a dedicated wiring. A gate signal line 2105 is connected to a gate electrode of the switching TFT 2101, and the source signal line 2106 is connected to a source region. Further, the anode of the OLED element 2103 is connected to one of a source region and a drain region of the OLED driver TFT 2102, while the electric current supply line 2107 is connected to the remaining region.

Operation of the active type OLED element is explained. The relationship between the electric current flowing in an OLED element and the brightness of the OLED element is shown in FIG. 22A. It can be understood from FIG. 22A that the brightness of the OLED element increases nearly in direct proportion to the electric current flowing in the OLED element. The electric current flowing in the OLED element will therefore be mainly argued hereafter. Next, the voltage vs. Electric current characteristics of the OLED element are shown in FIGS. 22B and 22C. When a voltage exceeding a certain threshold value is applied to the OLED element, an exponentially large electric current begins to flow. From another point of view, even if the amount of electric current flowing in the OLED element changes, the value of the voltage applied to the OLED element does not change much. On the other hand, if the value of the voltage applied to the OLED element changes even by a small amount, the amount of electric current flowing in the OLED element changes greatly. It is therefore difficult to control the amount of electric current flowing in the OLED element, namely the brightness of the OLED element, by controlling the value of the voltage applied to the OLED element. The brightness in the OLED element is then controlled in accordance with controlling the amount of electric current flowing in the OLED element.

Refer to FIGS. 23A and 23B. FIG. 23A is a figure showing only the structure portions of the OLED driver TFT 2102 and the OLED element 2103 in the OLED element pixel portion of FIG. 21. An electric current supply line 2301, a cathode wiring 2302, an OLED driver TFT 2304, a gate electrode 2303 of the OLED driver TFT 2304, and an OLED element 2305 appear in FIG. 23A. FIG. 23B shows the voltage current characteristics in order to analyze the operational points of FIG. 23A. The voltage applied to the OLED element 2305 is taken as $V_{OLED}$, the electric potential of the electric current supply line 2301 is taken as $V_{DD}$, the electric potential of the cathode wiring 2302 is taken as $V_{GND}$ (=OV), the voltage between a source and a drain of the OLED driver TFT 2304 is taken as $V_{DS}$, and the voltage between a gate electrode 2303 of to the OLED driver TFT 2304 and the electric current supply line 2301, namely the voltage between a gate and a source of the OLED driver TFT 2304, is taken as $V_{GS}$. In order to clarify the explanation, it is assumed that a p-channel TFT is used as the OLED driver TFT 2304 here, and that a source terminal is set to the high side voltage terminal, while a drain terminal is set to the low side voltage terminal. As can be understood from FIG. 23B, the value of the electric current flowing in the OLED driver TFT 2304 becomes larger as the absolute value of the voltage between the gate and the source of the OLED driver TFT 2304 $|V_{GS}|$ gets larger.

Operational points of an OLED circuit are explained next. First, the OLED driver TFT 2304 and the OLED element 2305 are connected in series in the circuit of FIG. 23A. The value of the electric current flowing in both elements (the OLED driver TFT 2304 and the OLED element 2305) is therefore equal. The operation point of the circuit of FIG. 23A consequently becomes the point of intersection on the graph of the voltage current characteristics of both elements (see FIG. 23B.) $V_{OLED}$ becomes the voltage between $V_{GND}$ and the electric potential of the operation point in FIG. 23B. $V_{DS}$ becomes the voltage between $V_{DD}$ and the electric potential of the operation point. In other words, the voltage from $V_{DD}$ to $V_{OLED}$ is equal to the sum of $V_{OLED}$ and $V_{DS}$.

A case in which $V_{GS}$ is changed is considered here. The OLED driver TFT 2304 is a p-channel TFT, and therefore becomes a conducting state if $V_{GS}$ becomes smaller than the threshold voltage $V_{th}$ of the OLED driver TFT 2304. If $V_{GS}$ becomes even smaller, namely the absolute value $|V_{GS}|$ becomes additionally larger, then the amount of electric current flowing in the OLED driver TFT 2304 becomes additionally larger, and the value of the electric current flow in the OLED element 2305 naturally becomes larger as well. The brightness of the OLED element 2305 becomes higher in proportion to the value of electric current flowing in the OLED element 2305. However, $V_{OLED}$ also becomes larger at this point.

In order to analyze the operation in a rather detailed fashion, the operational region of the OLED driver TFT 2304 for a case in which $|V_{GS}|$ is large is discussed first. In general, the operation of a transistor can be roughly divided into two regions. One region is one in which the electric value of the electric current almost does not change even when there is a change in the voltage between the source and the drain; namely, a saturation region in which the current value is determined by only the voltage difference between the source and the drain ($|V_{DS}|>|V_{GS}-V_{th}|$). The other region is a linear one in which the value of the electric current is determined by the voltage between the source and the drain, and by the voltage between the gate and the source ($|V_{DS}|<|V_{GS}-V_{th}|$). The operation region of the OLED driver TFT 2304 is considered based upon the above. First, when the value of the electric current is low, namely in a case when $|V_{GS}|$ is small, the OLED driver TFT 2304 operates in the saturation region as shown in FIG. 23B. If $|V_{GS}|$ then becomes larger, the value of the electric current also becomes large. At the same time, $V_{OLED}$ also gradually becomes larger. Therefore, $V_{DS}$ becomes smaller the larger that $V_{OLED}$ becomes at this point. However, the OLED driver TFT 2304 is operating in the saturation region in this case, and even if $V_{DS}$ changes, the value of the electric current changes very little. In other words, when the OLED driver TFT 2304 is operating in the saturation region, the amount of electric current flowing in the OLED element 2305 is determined only by $|V_{GS}|$.

In addition, if $|V_{GS}|$ becomes larger, the OLED driver TFT 2304 begins to operate in the linear region. Then $V_{OLED}$ gradually becomes larger. $V_{DS}$ consequently becomes smaller the larger $V_{OLED}$ becomes. In the linear region, the amount of electric current also becomes smaller if $V_{DS}$ decreases. Therefore, the value of electric current does not increase easily even if $|V_{GS}|$ becomes larger. Assuming the case that $|V_{GS}|=\infty$, the value of the electric current becomes equal to $I_{MAX}$. Namely, however large $|V_{GS}|$ becomes, an electric current of more than $I_{MAX}$ will not flow. $I_{MAX}$ is the value of the electric current flowing in the OLED element 2305 when $V_{OLED}$ is $(V_{DD}-V_{GND})$($V_{GND}$=0 V here, and therefore $V_{OLED}=V_{DD}$).

Bringing together the above operation analysis, when $|V_{GS}|$ is changed, the value of the electric current flowing in the OLED element is shown in a graph of FIG. 24. As the value of $|V_{GS}|$ becomes larger and exceeds the absolute value of the threshold voltage of the OLED driver TFT $|V_{th}|$, then the OLED driver TFT is placed in a conducting state, and electric current begins to flow. The value of $|V_{GS}|$ at this point is referred to as the turn on start voltage. If $|V_{GS}|$ becomes additionally large, the value of the electric current becomes larger, and finally the value of the electric current saturates. The value of $|V_{GS}|$ at this point is referred to as the brightness saturation voltage. As can be understood from FIG. 24, almost no current flows when $|V_{GS}|$ is smaller than the turn on start voltage. The amount of electric current changes in accordance with $|V_{GS}|$ when $|V_{GS}|$ is between the turn on start voltage and the brightness saturation voltage. When $|V_{GS}|$ then becomes sufficiently larger than the brightness saturation voltage, the value of the electric current flowing in the OLED element changes very little. Control of the value of the electric current flowing in the OLED element, namely control of the brightness of the OLED element, can thus be performed in accordance with changing $|V_{GS}|$.

Operation of an active type OLED circuit is explained next. FIGS. 21A and 21B are again referred to.

First, the gate of the switching TFT 2101 opens when the gate signal line 2105 is selected, and the switching TFT 2101 is placed in a conducting state. The signal (voltage) of the source signal line 2106 is thus stored in the storage capacitor 2104. The voltage of the storage capacitor 2104 becomes the voltage $V_{GS}$ between the gate and the source of the OLED driver TFT 2102, and therefore the electric current, which responds to the voltage of the storage capacitor 2104, flows in the OLED driver TFT 2102 and in the OLED element 2103. As a result, the OLED element 2103 turns on. As explained by FIGS. 23A to 24, the brightness of the OLED element 2103, namely the amount of electric current flowing in the OLED element 2103, can be controlled by $V_{GS}$. $V_{GS}$ is the voltage stored in the storage capacitor 2104, and is the signal (voltage) of the source signal line 2106. In other words, the brightness of the OLED element 2103 is controlled by controlling the signal (voltage) of the source signal line 2106. Finally, the gate signal line 2105 in unselected, the gate of the switching TFT 2101 closes, and the switching TFT 2101 is placed in a non-conducting state. The electric charge stored in the storage capacitor 2104 continues to be stored at this point. $V_{GS}$ is therefore stored as is, and the electric current in response to $V_{GS}$ continues to flow in the OLED driver TFT 2102 and in the OLED element 2103.

Information regarding the above explanation is reported in papers such as the following: "Current Status and Future of Light-emitting Polymer Display Driven by Poly-Si TFT", SID99 Digest, p. 372; "High Resolution Light Emitting Polymer Display Driven by Low Temperature Polysilicon Thin Film Transistor with Integrated Driver", ASIA DISPLAY 98, p. 217; and "3.8 Green OLED with Low Temperature Poly-Si TFT", Euro Display 99 Late News, p. 27.

A method of gradation display of an OLED element is explained next. As FIG. 24 shows, when the absolute value of the gate voltage of the OLED driver TFT $|V_{GS}|$ is equal to or above the turn on start voltage and equal to or below the brightness saturation voltage, the brightness of the OLED element, namely the gray scale, can be controlled in an analog manner by changing the value of $|V_{GS}|$. This method is therefore referred to as an analog gray scale method.

The analog gray scale method has a disadvantage in that it is weak with respect to dispersion in the electric current characteristics of the OLED driver TFTs. In other words, if the electric current characteristics of the OLED driver TFTs differ, the value of the electric current flowing in the OLED driver TFTs and the OLED elements will differ even if the same gate voltage is applied. As a result, the brightness of the OLED elements, namely their gray scale, changes. FIG. 25 shows a graph of the absolute value of the gate voltage of an OLED driver TFT $|V_{GS}|$ and the electric current flowing in the OLED element for a case in which the threshold voltage value and the mobility of the OLED driver TFT change. For example, the voltage effectively applied to the gate of the OLED driver TFT becomes smaller if the threshold voltage of the OLED driver TFT becomes larger ($|V_{GS}|-|V_{th}|$), and therefore the turn on start voltage becomes larger. Further, if the mobility of the OLED driver TFT becomes smaller, then the electric current flowing between the source and the drain of the OLED driver TFT becomes smaller, and therefore the slope of the graph becomes smaller.

In order to reduce the effect of dispersion in the characteristics of the OLED driver TFTs, a method referred to as a digital gray scale method was proposed. This method is a method of controlling the gray scale by two states, a state in which the absolute value of the gate voltage of the OLED driver TFT $|V_{GS}|$ is below the turn on start voltage (when almost no electric current flows), and a state in which $|V_{GS}|$ is greater than the brightness saturation voltage (in which the value of the electric current is nearly $I_{MAX}$). In this case, if the value of the absolute value of the gate voltage of the OLED driver TFT $|V_{GS}|$ is sufficiently higher than the brightness saturation voltage, the electric current value stays near $I_{MAX}$ even if the electric current characteristics of the OLED driver TFTs are dispersed. The influence of the OLED driver TFT dispersions can therefore be made extremely small. The gray scale is controlled by two states, an ON state (a bright state in which the maximum electric current flows) and an OFF state (a dark state in which the electric current does not flow), and therefore this method is referred to as the digital gray scale method.

However, only two gray scales can be displayed with the digital gray scale method in this state. Several techniques of changing to multiple gray scales by combining this method with another method have been proposed.

One of these techniques is a method in which a surface area gray scale method and a digital gray scale method are combined. The surface area gray scale method is a method of outputting gray scales by controlling the surface area of portions which are switched on. Namely, one pixel is divided into a plurality of sub-pixels, and the number of sub-pixels turned on and their surface area are controlled, and a gray scale is expressed. Disadvantages of this method include the fact that it is difficult to increase the resolution, and that it is difficult to make a lot of gray scales, because the number of sub-pixels cannot be made large. The surface area gray scale method is reported upon in papers such as: "TFT-LEPD with Image Uniformity by Area Ratio Gray Scale", Euro Display 99 Late News, p. 71; and "Technology for Active Matrix Light Emitting Polymer Displays", IEDM 99, p. 107.

Another method capable of making many gray scales is a method which combines a time gray scale method and a digital gray scale method. The time gray scale method is a method of outputting gray scales by controlling the amount of turned on time. In other words, one frame period is divided up into a plurality of subframe periods, and gray scales are expressed by controlling the number and the length of the subframe periods turned on.

A case of combining the digital gray scale method, the surface area gray scale method, and the time gray scale method is reported in "Low-Temperature Poly-Si TFT driven Light-Emitting-Polymer Displays and Digital Gray Scale for Uniformity", IDW '99, p. 171.

A method applied for in Japanese Patent Application Laid-open No. Hei 11-176521 is discussed as a method of combining the digital gray scale method and the time gray scale method. A three bit gray scale is expressed here, and therefore as an example a case of dividing one frame period into three subframe periods is discussed.

FIG. 26 is referred to. As shown in FIG. 26, one frame period is divided into three subframe periods (SF). A first subframe period is referred to here as $SF_1$. Subframe periods from the second onward are similarly referred to as $SF_2$ and $SF_3$. One subframe period is additionally divided into an address (write in) period (Ta) and a sustain (turn on) period (Ts). The sustain (turn on) period of $SF_1$ is denoted by $Ts_1$. The sustain periods for $SF_2$ and $SF_3$ are similarly denoted by $Ts_2$ and $Ts_3$.

Operations performed in the address (write in) period Ta are explained. FIGS. 21A and 21B, and FIG. 26 are referred to. First, the electric potential difference between the electric current supply line 2107 and a cathode wiring 2108 is set to 0 V. The electric potential of the cathode wiring 2108 is actually increased and placed at the same electric potential as that of the electric current supply line 2107. The cathode wiring 2108 is connected to all pixels, and therefore this operation is performed in all pixels simultaneously. The aim of this operation is so that no electric current flows in the OLED elements 2103, without depending upon the value of the voltage of the storage capacitor 2104 of each pixel. Signals (voltages) are then stored in the storage capacitors 2104 of each pixel through the source signal lines 2106. To set a pixel into a display state, the absolute value of the voltage between the gate and the source of the OLED driver TFT 2101 is set to a voltage sufficiently higher than the brightness saturation voltage. When a pixel is set to not display, the $|V_{GS}|$ of the OLED driver TFT 2101 is set to a voltage sufficiently lower than the turn on start voltage. The signals (voltages) are stored in the storage capacitors 2104 of all pixels. The operation of the address (write in) period Ta is thus complete.

The sustain (turn on) period $Ts_1$ begins next. The electric potential difference between the electric current supply line 2107 and the cathode wiring 2108 was in a state of 0 V during the address (write in) period (Ta). In the sustain (turn on) period ($Ts_1$), a voltage is applied between the electric current supply line 2107 and the cathode wiring 2108 simultaneously to all pixels. As a result, an electric current flows in the OLED driver TFT 2101 and in the OLED element 2103 of pixels in which $|V_{GS}|$ is sufficiently larger than the brightness saturation voltage, and the OLED elements turn on. An electric current does not flow in the OLED driver TFT 2101 and in the OLED element 2103 for pixels in which is sufficiently lower voltage than the turn on start voltage, and those pixels remain dark. This state continues, and the electric potential difference between the electric current supply line 2107 and the cathode wiring 2108 is once again set to a state of 0 V when the sustain (turn on) period $Ts_1$ is complete. This naturally occurs across all the pixels simultaneously. Electric current then does not flow in the OLED elements 2103, without depending on the value of the storage capacitor 2104 voltage of each pixel, name $|V_{GS}|$, and the OLED elements 2103 become dark.

The above is the operation of one subframe period ($SF_1$). Similar operations are also performed in $SF_2$ and $SF_3$. However, the length of the sustain (turn on) periods differ in accordance with the subframe period. The length ratios become $Ts_1:Ts_2:Ts_3=2^2:2^1:2^0$. In other words, the sustain (turn on) periods change in accordance with powers of 2. The changing of the sustain (turn on) period lengths by powers of 2 is in order to easily conform to digital operation.

The OLED element 2103 does not turn on during the interval until the end of the address (write in) period even if a predetermined voltage is applied to the gate of the OLED driver TFT 2101, and the OLED driver TFT 2101 is in a conducting state. The OLED element 2103 is made to turn on at the same time as the sustain (turn on) period begins. This is in order to more accurately control the length of the sustain (turn on) periods. A timing chart relating to the electric potential $V_{GND}$ of the cathode wiring of the OLED element 2103 is shown in FIG. 26. The cathode wiring is connected to all pixels, and therefore reference numeral 2601 denotes the electric potential $V_{GND}$ of the cathode wirings of all pixels in FIG. 26. The electric potential of the cathode wiring is set to the same electric potential as that of the electric current supply line, or to a higher electric potential, in the address (write in) period (Ta). the electric potential of the cathode wiring is then reduced in the sustain (turn on) period, and an electric current flows in the OLED elements.

The brightness is controlled by controlling whether or not the OLED elements turn on in the sustain (turn on) periods $Ts_1$ to $Ts_3$ in the gray scale display method. With this example, $2^3=8$ turn on time lengths can be determined by combining the sustain (turn on) periods, and therefore 8 gray scales can be displayed. This method of performing gray scale display by thus utilizing the lengthening and shortening of the turn on times is referred to as the time gray scale method.

In addition, the number of divisions of one frame period may be increased for a higher number of gray scales. It becomes possible to express $2^n$ gray scales, in which the ratio of lengths of the sustain (turn on) periods becomes $Ts_1:Ts_2:\ldots:Ts_{(n-1)}:Ts_n=2^{(n-1)}:2^{(n-2)}:\ldots:2^1:2^0$ for a case of dividing one frame period into n subframe periods.

Note that gray scale display is also possible even when the lengths of the sustain (turn on) periods are not ratios of powers of 2.

The division of the subframe periods into address (write in) periods and sustain (turn on) periods, is in order to be able to freely set the length of the sustain (turn on) periods. In other words, it becomes possible to set the sustain (turn on) periods shorter than the address (write in) periods by dividing up the subframe periods. If the sustain (turn on) period is short for a case in which the period is not divided, then there are cases in which the address (write in) period overlaps with the address (write in) period of another subframe, and therefore normal signal write in is not performed.

Problems associated with the method of dividing into address (write in) periods and sustain (turn on) periods for a case of multiple gray scale in which the time gray scale method and the digital gray scale method are combined, namely the technique submitted in Japanese Patent Application Laid-open No. Hei 11-176521, is mainly discussed.

First, the fact that the OLED element is not turned on in the address (write in) period Ta can be given. The ratio of the display period to an entire one frame period (this is referred to as a duty ratio) therefore becomes small. Assuming that the ratio of the total time occupied by the sustain (turn on) periods (Ts) in one frame period is half, namely that the duty ratio is 50%, a brightness can be obtained which is only half that for a case in which the duty ratio is 100%. It is necessary that the brightness at the time light is emitted in the sustain (turn on) period, namely the instantaneous brightness, be twice as high in order to obtain a brightness equal to that of a case of a 100% duty ratio. It is therefore necessary for an electric current which is twice as large to flow in the OLED elements.

A second problem point is that it is necessary to complete the write in of the signals to all of the pixels within the address (write in) period (Ta), and therefore it is necessary to have high speed circuit operation. If the circuit operation is slow, then the address (write in) period (Ta) becomes longer. As a result, the duty ratio becomes smaller, and various problems develop. Further, the energy consumption becomes large if a high speed circuit operates, and this also becomes problematic.

A third problem point is that it is difficult to increase the number of pixels. The reason this is true is that the address (write in) period (Ta) becomes longer by increasing the number of pixels, and as a result, the duty ratio becomes smaller.

A fourth problem is that it is difficult to increase the number of gray scales. This is because it is necessary to increase the number of divisions in the subframe periods in order to increase the number of gray scales, and as a result, the number of address (write in) periods (Ta) increases, and the duty ratio becomes smaller.

SUMMARY OF THE INVENTION

The main cause of insufficient brightness is a reduced duty ratio in accordance with the above stated problem points. The present invention is created in view of these types of problems, and an object of the present invention is to realize an increase in the duty ratio, and in addition to maintain sufficient sustain (turn on) periods for cases in which the operating frequency of a driver circuit is low, thus realizing good image quality, by using a novel method of driving.

The method of driving of the present invention is one in which signals are written into pixels of a plurality of differing lines within one gate signal line selection period by dividing the gate signal line selection period into a plurality of sub-periods. The time from when one signal is input until the next signal is input in a certain line of pixels can thus be arbitrarily set to a certain extent provided that the write in time to the pixels is maintained. In other words, the sustain (turn on) periods can be arbitrarily set, and therefore the duty ratio can be made to appear larger, up to 100%. The various problems which are generated due to a small duty ratio can therefore be avoided.

Further, the method of driving of the present invention is one in which the OLED elements can be turned on even during the address (write in) periods. Suppression of the sustain (turn on) periods can therefore be avoided even for cases in which the address (write in) periods becomes long. In other words, sufficient sustain (turn on) periods can be maintained even for cases in which the circuit operation is slow. As a result, the operating frequency of the driver circuit can be lowered, and the electric power consumption can be reduced.

Structures of electronic devices of the present invention, and methods of driving electronic devices, are recorded below.

According to a first aspect of the present invention, a method of driving an electronic device of this invention, for n-bit grey scale control for controlling the length of a turn on period of self light emitting elements; characterized in that:

one frame period has n subframe periods $SF_1, SF_2, \ldots, SF_n$;

the n subframe periods $SF_1, SF_2, \ldots, SF_n$ have: address (write in) periods $Ta_1, Ta_2, \ldots, Ta_n$, respectively; and sustain (turn on) periods $Ts_1, Ts_2, \ldots, Ts_n$, respectively;

the length of the sustain (turn on) periods $Ts_1:Ts_2: \ldots : Ts_n=2^{(n-1)}:2^{(n-2)}: \ldots :2^0$; and may have a period in which the address (write in) period and the sustain (turn on) period overlap in at least one subframe period from among the n subframe periods.

According to a second aspect of the present invention, a method of driving an electronic device in this invention, for n-bit grey scale control for controlling the length of a turn on period of self light emitting elements; characterized in that:

one frame period has n subframe periods $SF_1, SF_2, \ldots, SF_n$;

the n subframe periods $SF_1, SF_2, \ldots, SF_n$ have: address (write in) periods $Ta_1, Ta_2, \ldots, Ta_n$, respectively; and sustain (turn on) periods $Ts_1, Ts_2, \ldots, Ts_n$, respectively;

the length of the sustain (turn on) periods $Ts_1:Ts_2: \ldots : Ts_n=2^{(n-1)}:2^{(n-2)}: \ldots :2^0$; and a plurality of gate signal line selection periods within the subframe periods have m sub-gate signal line selection periods;

write in to at most one gate signal line is performed in the sub-gate signal line selection periods; and write in of signals to at most m gate signal lines may be completed within one gate signal line selection period.

According to a third aspect of the present invention, a method of driving an electronic device of this invention, for n-bit grey scale control for controlling the length of a turn on period of self light emitting elements; characterized in that:

one frame period has n subframe periods $SF_1, SF_2, \ldots, SF_n$;

the n subframe periods $SF_1, SF_2, \ldots, SF_n$ have: address (write in) periods $Ta_1, Ta_2, \ldots, Ta_n$, respectively; and sustain (turn on) periods $Ts_1, Ts_2, \ldots, Ts_n$, respectively;

the length of the sustain (turn on) periods $Ts_1:Ts_2: \ldots : Ts_n=2^{(n-1)}:2^{(n-2)}: \ldots :2^0$; and a plurality of gate signal line selection periods within the subframe periods have m sub-gate signal line selection periods;

write in to at most one gate signal line is performed in the sub-gate signal line selection periods;

write in of signals to at most m gate signal lines is completed within one gate signal line selection period;

write in periods for the same gate signal lines do not overlap within differing sub-gate signal line selection periods; and write in periods for differing gate signal lines may be made to not overlap within the same sub gate signal line selection period.

According to a fourth aspect of the present invention, a method of driving an electronic device in this invention, for n-bit grey scale control for controlling the length of a turn on period of self light emitting elements; characterized in that:

one frame period has n subframe periods $SF_1, SF_2, \ldots, SF_n$;

the n subframe periods $SF_1, SF_2, \ldots, SF_n$ have: address (write in) periods $Ta_1, Ta_2, \ldots, Ta_n$, respectively; and sustain (turn on) periods $Ts_1, Ts_2, \ldots, Ts_n$, respectively;

the length of the sustain (turn on) periods $Ts_1:Ts_2: \ldots : Ts_n=2^{(n-1)}:2^{(n-2)}: \ldots :2^0$; and a plurality of gate signal line selection periods within the subframe periods have m sub-gate signal line selection periods;

write in to at most one gate signal line is performed in the sub-gate signal line selection periods;

write in of signals to at most m gate signal lines is completed within one gate signal line selection period;

for cases in which the address (write in) periods of differing subframe periods overlap, a reset signal is input only during the periods in which the address (write in) periods overlap; and may have a period where the self light emitting element is in a turned off state during the periods in which the reset signal is input.

According to a fifth aspect of the present invention, an electronic device of this invention comprising: a source signal line driver circuit; a gate signal line driver circuit; and a pixel portion having a plurality of self light emitting elements arranged in a matrix shape; characterized in that:

n-bit grey scale control for controlling the length of a turn on period of the self light emitting elements is performed;

one frame period has n subframe periods $SF_1, SF_2, \ldots, SF_n$;

the n subframe periods $SF_1, SF_2, \ldots, SF_n$ have: address (write in) periods $Ta_1, Ta_2, \ldots, Ta_n$, respectively; and sustain (turn on) periods $Ts_1, Ts_2, \ldots, Ts_n$, respectively;

the length of the sustain (turn on) periods $Ts_1:Ts_2: \ldots : Ts_n=2^{(n-1)}:2^{(n-2)}:2^0$; and the address (write in) period and the sustain (turn on) period overlap in at least one subframe period from among the n subframe periods.

According to a sixth aspect of the present invention, an electronic device of this invention comprising: a source signal line driver circuit; a gate signal line driver circuit; and a pixel portion having a plurality of self light emitting elements arranged in a matrix shape; characterized in that:

n-bit grey scale control for controlling the length of a turn on period of the self light emitting elements is performed;

one frame period has n subframe periods $SF_1, SF_2, \ldots, SF_n$;

the n subframe periods $SF_1, SF_2, \ldots, SF_n$ have: address (write in) periods $Ta_1, Ta_2, \ldots, Ta_n$, respectively; and sustain (turn on) periods $Ts_1, Ts_2, \ldots, Ts_n$, respectively;

the length of the sustain (turn on) periods $Ts_1:Ts_2: \ldots : Ts_n=2^{(n-1)}:2^{(n-2)}: \ldots :2^0$; and a plurality of gate signal line selection periods within the subframe periods have m sub-gate signal line selection periods;

write in to at most one gate signal line is performed in the sub-gate signal line selection periods; and write in of signals to at most m gate signal lines is completed within one gate signal line selection period.

According to a seventh aspect of the present invention, an electronic device of this invention comprising: a source signal line driver circuit; a gate signal line driver circuit; and a pixel portion having a plurality of self light emitting elements arranged in a matrix shape; characterized in that:

one frame period has n subframe periods $SF_1, SF_2, \ldots, SF_n$;

the n subframe periods $SF_1, SF_2, \ldots, SF_n$ have: address (write in) periods $Ta_1, Ta_2, \ldots, Ta_n$, respectively; and sustain (turn on) periods $Ts_1, Ts_2, \ldots, Ts_n$, respectively;

the length of the sustain (turn on) periods $Ts_1:Ts_2: \ldots : Ts_n=2^{(n-1)}:2^{(n-2)}: \ldots :2^0$; and a plurality of gate signal line selection periods within the subframe periods has m sub-gate signal line selection periods;

write in to at most one gate signal line is performed in the sub-gate signal line selection periods;

write in of signals to at most m gate signal lines is completed within one gate signal line selection period;

write in periods for the same gate signal lines do not overlap within differing sub-gate signal line selection periods; and write in periods for differing gate signal lines do not overlap within the same sub-gate signal line selection period.

According to an eighth aspect of the present invention, an electronic device of this invention comprising: a source signal line driver circuit; a gate signal line driver circuit; and a pixel portion having a plurality of self light emitting elements arranged in a matrix shape; characterized in that:

one frame period has n subframe periods $SF_1$, $SF_2$, . . . , $SF_n$;

the n subframe periods $SF_1$, $SF_2$, . . . , $SF_n$ have: address (write in) periods $Ta_1$, $Ta_2$, . . . , $Ta_n$, respectively; and sustain (turn on) periods $Ts_1$, $Ts_2$, . . . , $Ts_n$, respectively;

the length of the sustain (turn on) periods $Ts_1:Ts_2: \ldots : Ts_n=2^{(n-1)}:2^{(n-2)}: \ldots :2^0$; and a plurality of gate signal line selection periods within the subframe periods has m sub-gate signal line selection periods;

write in to at most one gate signal line is performed in the sub-gate signal line selection periods;

write in to at most m gate signal lines is completed within one gate signal line selection period;

for cases in which the address (write in) periods of differing subframe periods overlap, a reset signal is input only during the periods in which the address (write in) periods overlap and have a period in which the self light emitting element is in a turned off state during the periods in which the reset signal is input.

According to a ninth aspect of the present invention, an electronic device in this invention comprising: a source signal line driver circuit; a gate signal line driver circuit; and a pixel portion in which a plurality of self light emitting elements are arranged in an matrix shape having a rows and b columns; characterized in that:

the source signal driver circuit uses a plurality of source driver circuits having: at least one first shift register circuit; a first memory circuit for storing a digital image signal; and a second memory circuit for storing an output signal of the first memory circuit;

the gate signal line driver circuit uses a plurality of gate driver circuits having: at least one second shift register circuit; and at least one buffer circuit;

one frame period has n subframe periods $SF_1$, $SF_2$, . . . , $SF_n$;

a plurality of gate signal line selection periods within the subframe periods has m sub-gate signal line selection periods;

write in to at most one gate signal line is performed in the sub-gate signal line selection periods;

write in of signals to at most m gate signal lines is completed within one gate signal line selection period;

one source signal line is electrically connected to a maximum of m source driver circuits, through a first switching circuit;

one gate signal line is electrically connected to a maximum of m gate driver circuits, through a second switching circuit;

the source signal line driver circuit has a maximum of b×m source driver circuits;

the gate signal line driver circuit has a maximum of a×m gate driver circuits;

the first switching circuit selects only one electrically connected source driver circuit, from among the m source driver circuits, during one dot data write in period, connects to the source signal line, and performs signal write in; and the second switching circuit selects only one electrically connected gate driver circuit, from among the m gate driver circuits, during one sub-gate signal line selection period, connects to the gate signal line, and performs write in.

DETAILED DESCRIPTION OF THE PREFERRED EMBODIMENTS

Embodiment Mode

Figure 27A:
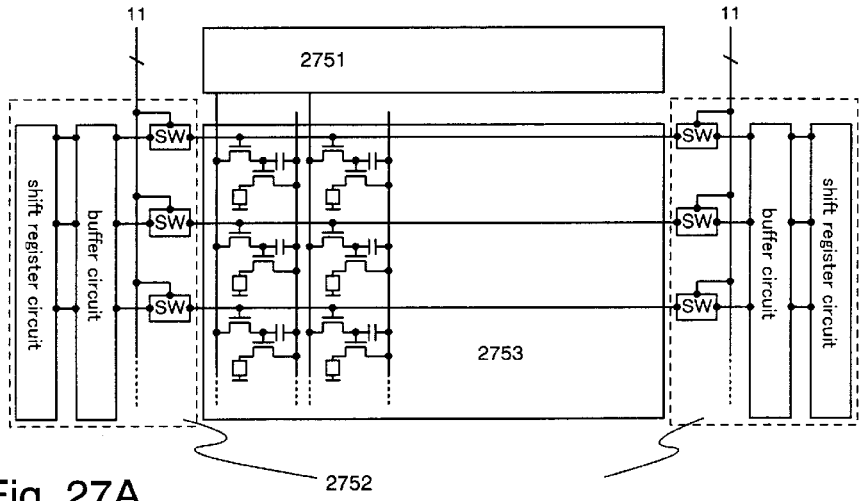
FIGS. 27A to 27C are diagrams showing embodiment modes of the present invention.
Figure 27B:
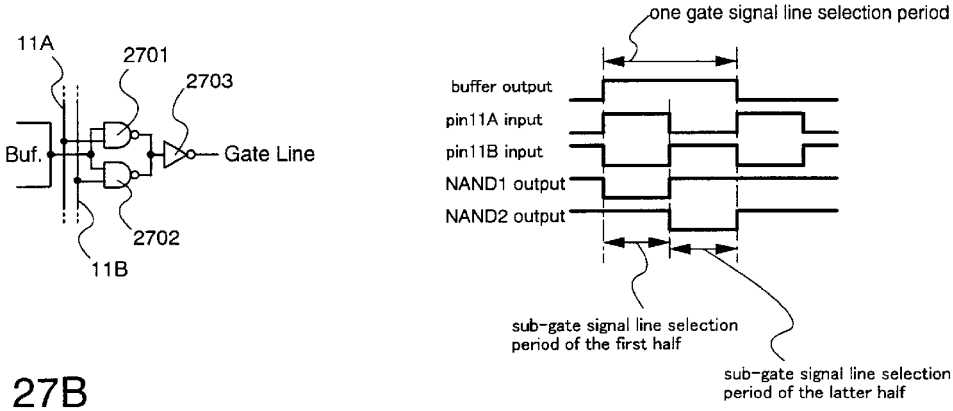
Figure 27C:
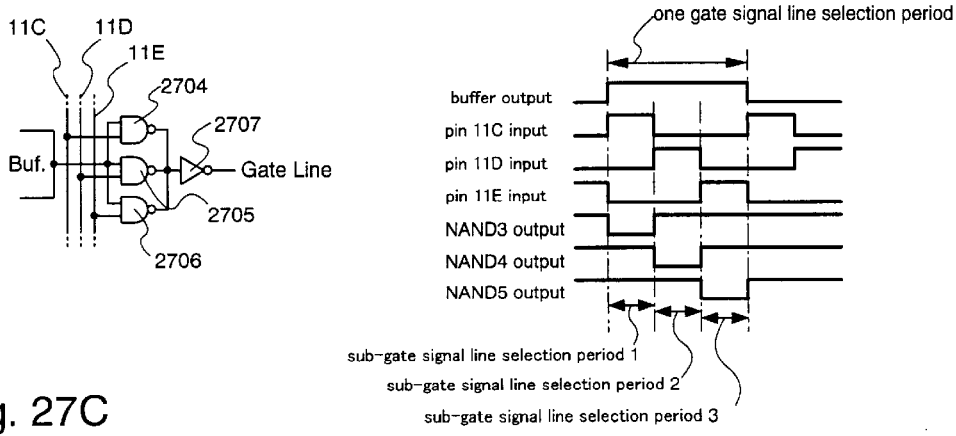

FIGS. 27A to 27C show one state of an embodiment mode of the present invention. FIG. 27A is a diagram of an entire electronic device having a source signal line driver circuit 2751, a gate signal line driver circuit 2752, and a pixel portion 2753. A gate signal line selection period is divided into a plurality of sub-periods with the present invention, and therefore although the gate signal line driver circuit is similar to a conventional gate signal line driver circuit from a shift register circuit to a buffer, it has a selection circuit (SW) between an output terminal of the buffer and a gate signal line. Signals such as a clock signal and a start pulse (not shown in the figures) are input to the shift register circuit, and a sub-gate period selection pulse is input to the selection circuit through a pin 11. Further, the source signal line driver circuit may be similar to a conventional source signal line driver circuit, and signals such as a clock signal and a start pulse (not shown in the figures) are input to the source signal line driver circuit.

The operation of the selection circuit is explained using FIGS. 27B and 27C. FIG. 27B is an example of a selection circuit used for a case of dividing a gate signal line selection period into two sub-gate signal line selection periods, while FIG. 27C is an example of a selection circuit used for a case of dividing a gate signal line selection period into three sub-gate signal line selection periods. A buffer output pulse is input to a plurality of NAND circuits for both examples, and by taking the logical multiplication of this pulse and the sub-gate period selection pulse input from the pin 11 (for cases of a plurality of pins, they are denoted by 11A, 11B, and 11C to 11E in FIGS. 27A to 27C) in each NAND circuit, division of the sub-periods is performed. The NAND output is output to the gate signal lines through an inverter in accordance with the timing charts of FIGS. 27B and 27C, and fixed period gate signal lines are placed in a selected state. Note that, in FIGS. 27A to 27C, appropriate circuits such as an inverter and a buffer may also be formed, and a structure not possessing inverters 2703 and 2707 may be formed, depending upon signal logic.

If a certain gate signal line selection period is seen as a standard unit, then two differing gate signal line selection periods are thus formed in the same gate signal line selection period.

Figure 28:
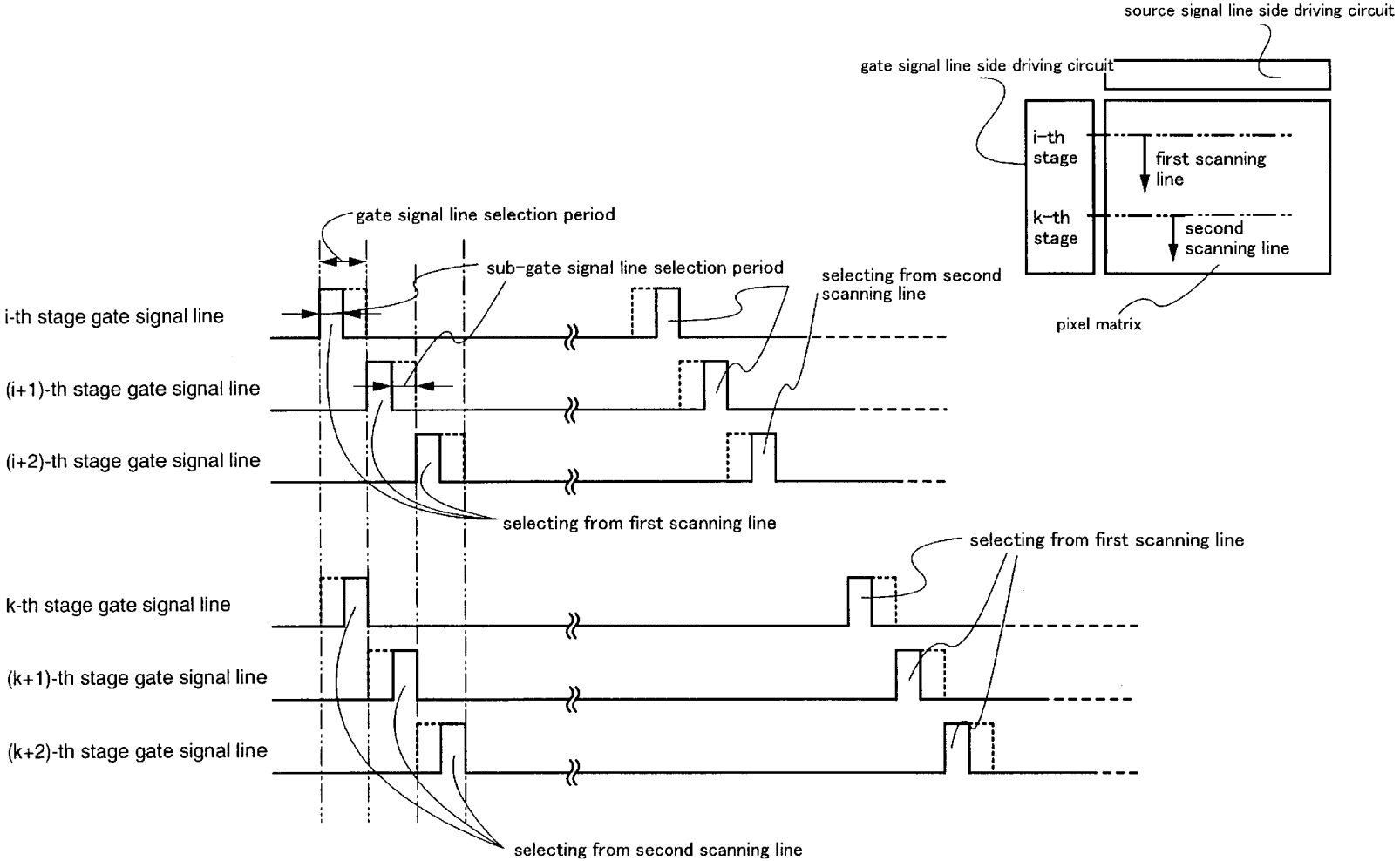
FIG. 28 is a diagram showing simultaneous selection of a plurality of gate signal lines.

As an example, a case of dividing a gate signal line selection period into two sub-gate signal line selection periods is explained. A timing chart is shown in FIG. 28. The number of sub-gate signal line selection periods is two, and therefore the number of gate signal lines simultaneously selected in the gate signal line selection period is similarly two.

A number i stage gate signal line and a number k stage gate signal line are simultaneously selected in a certain gate signal line selection period. Note that a period during which the number i stage gate signal line is actually selected, and the switching TFT is placed in a conducting state, is only during the sub-gate signal line selection period of the first half of the gate signal line selection period. Further, a period during which the number k stage gate signal line is actually selected and the switching TFT is placed in a conducting state, is only 5 during the sub-gate signal line selection period of the second half of the gate signal line selection period. During the first half of the gate signal line selection period, namely the time during which the number i stage gate signal line is selected, a signal is written into the number i stage pixels. During the second half of the gate signal line selection period, namely the time during which the number k stage gate signal line is selected, a signal is written into the number k stage pixels.

The number i+1 line and the number k+1 stage gate signal lines are simultaneously selected next. Here as well, the number i+1 stage gate signal line is only selected during the sub-gate signal line selection period of the first half of the gate signal line selection period, and the number k+1 stage gate signal line is only selected during the sub-gate signal line selection period of the second half of the gate signal line selection period. A signal is written into the number i+1 stage pixels when the number i+1 stage gate signal line is selected, and a signal is written into the number k+1 stage pixels when the number k+1 stage gate signal line is selected. Similarly, the number i+2 stage and the number k+2 stage gate signal lines are selected, and write in is performed at their respective timings. A gate signal line selection pulse from a number i stage for selecting a number i+n (where n is an integer) stage is referred to as a first gate signal line selection pulse, and a gate signal line selection pulse from a number k stage for selecting a number k+n (where n is an integer) stage is referred to as a second gate signal line selection pulse.

Once scanning has proceeded to a certain point, the first gate signal line selection pulse soon arrives at the number k stage gate signal line. At the same time, the second gate signal line selection pulse arrives at the number i stage gate signal line. Scanning proceeds, and horizontal scanning is performed.

The above is a case in which the gate signal line selection period is divided into two sub-gate signal line selection periods and two gate signal lines are selected. For a case in which m stages (where m is an integer) of gate signal lines are selected within one gate signal line selection period, the gate signal line selection period is divided into m divisions by a similar method and sub-gate signal line selection periods may be formed.

A gray scale method is explained next. In an electronic device of the present invention, gray scale display is performed in accordance with combining digital gray scale and time gray scale, but provided that normal gray scale display is performed, other methods, for example the additional combination with a method such as a surface area gray scale method, may also be used.

Figure 1A:
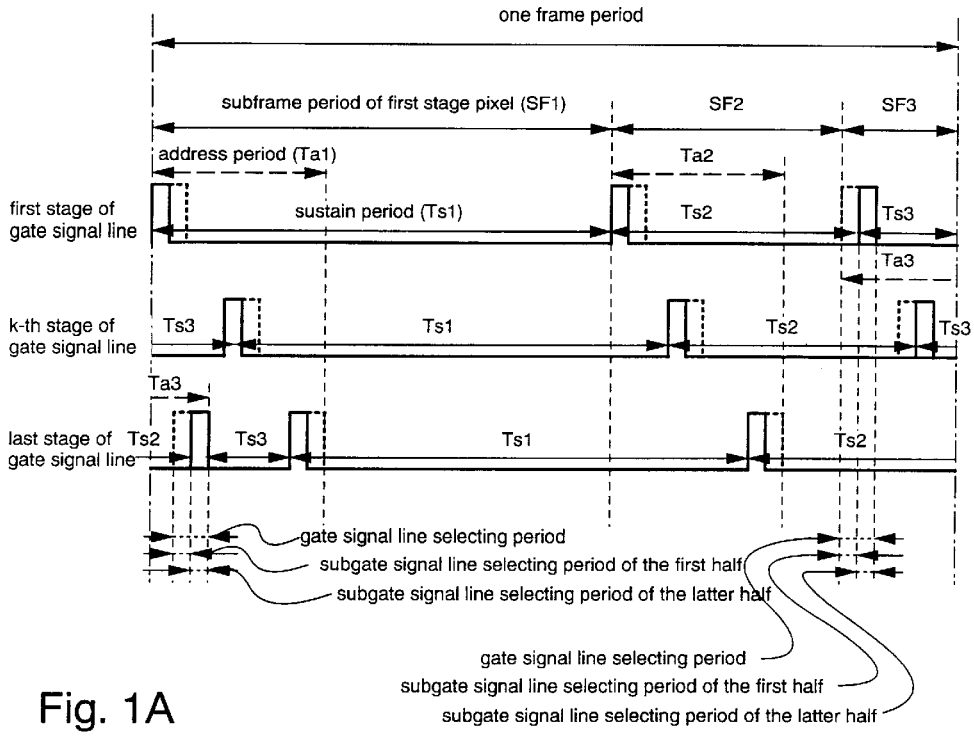
FIGS. 1A and 1B are diagrams showing a timing chart of simultaneous selection of a plurality of gate signal lines.
Figure 1B:
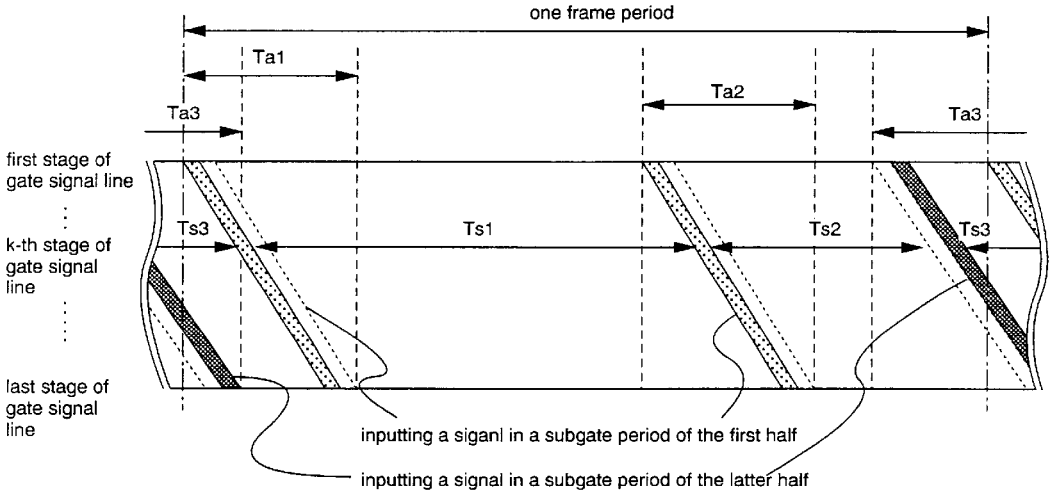

For simplicity, a case of combining digital gray scales and time gray scales for expressing 3-bit gray scales ($2^3$=8 gray scales) is explained here. FIGS. 1A and 1B show timing charts. One frame period is divided into three subframe periods $SF_1$ to $SF_3$. The lengths of each of $SF_1$ to $SF_3$ are determined by powers of 2. In short, $SF_1:SF_2:SF_3=4:2:1$ ($2^2:2^1:2^0$) for this case.

First, signals are input to pixels one stage at a time in the first subframe period. Note that the gate signal lines are actually selected in this case only in the first half of the sub-gate signal line selection period. The gate signal line is not selected in the second half of the sub-gate signal line selection period, and input of a signal to the pixels is not performed. This operation is performed from the first stage through to the final stage. An address (write in) period is a period from the selection of the first stage gate signal line until the selection of the final stage of the gate signal line, and the length of the address (write in) period is therefore the same in any subframe period.

The second subframe period begins next. Signals are similarly input to the pixels one stage at a time here as well. The input is only performed in the first half of the sub-gate signal line selection period in this case as well. This operation is performed from the first stage until the final stage.

A fixed voltage is applied to a cathode wiring of all of the pixels at this point. A sustain (turn on) period of the pixels in a certain subframe period is therefore a period from when a signal has been written into the pixels in a certain subframe period until a signal starts to be written into the pixels in the next subframe period. The sustain (turn on) periods in each stage have differing times and equal lengths.

The third subframe period is explained next. First, consider a case in which, similar to the first and the second subframe periods, the gate signal line is selected in the first half of the sub-gate signal line selection period, and a signal is written into the pixels. In this case, when write in of the signal to the pixels near the final stage begins, a write in period for the first stage of pixels in the next frame period, namely the address (write in) period, has already begun. As a result, the write in to the pixels near the final stage in the third subframe period and the write in to the first half of the pixels in the first subframe period of the next frame period overlap. Signals of two differing stages cannot be normally written into pixels of two differing stages. The gate signal line therefore is selected in the latter half sub-gate signal line selection period during the third subframe period. The selection of the gate signal line in the first subframe period (this subframe period belongs to the next frame period) is performed in the first half of the sub-gate signal line selection period, and therefore write in of signals simultaneously to the pixels of two differing stages can be avoided.

For a case in which an address (write in) period of a certain subframe period overlaps with an address (write in) period in a separate subframe period, the actual gate signal line selection timing is made so as to not overlap by performing distribution of the write in periods utilizing a plurality of sub-gate signal line selection periods with the driving method of the present invention, and therefore normal write in of the signals to the pixels can be performed. As a result, it becomes possible at a certain instant in the address (write in) period of a certain row, to turn on the OLED elements of another row, without any dependence on the number of gradation bits, and a high duty ratio is achieved.

Embodiments

Embodiments of the present invention are discussed below.

Embodiment 1

A case in which there are a plurality of subframe periods having sustain (turn on) periods which are shorter than address (write in) periods when dividing one frame period is given as an example and explained in Embodiment 1.

Figure 2A:
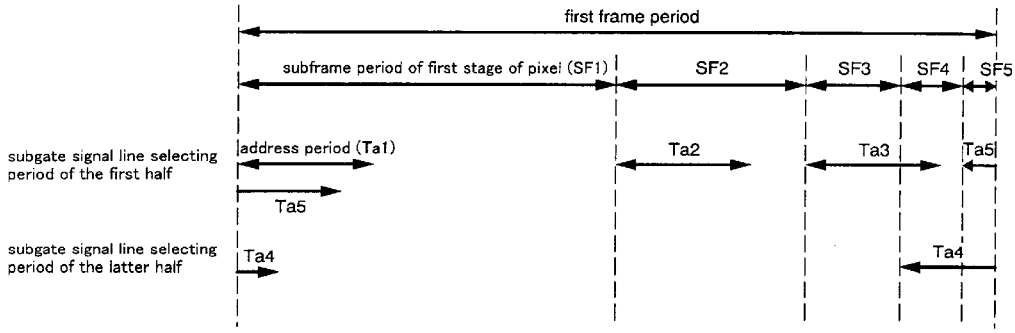
FIGS. 2A and 2B are diagrams showing a timing chart in which address (write in) period redundancy develops.
Figure 2B:
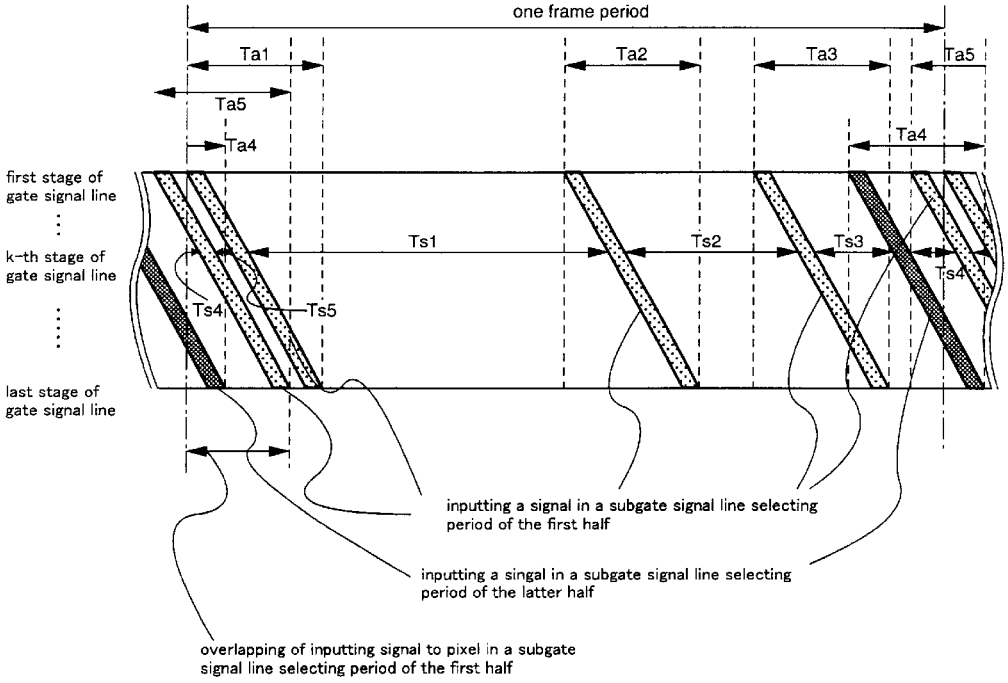

FIGS. 2A and 2B are referred to. FIGS. 2A and 2B show timing charts when dividing one frame period into five subframe periods. In this case, it can be seen that even if the gate signal line selection period is divided into the first half and the second half sub-gate signal line selection periods, and write in of a signal is performed, an address (write in) period $Ta_5$ and an address (write in) period $Ta_1$ of the next frame period will overlap. Normal signal write in therefore cannot be performed at this timing.

Figure 3A:
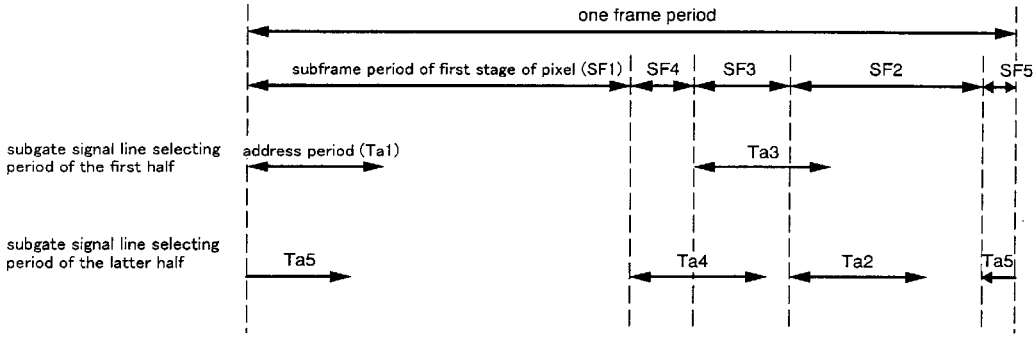
FIGS. 3A and 3B are timing charts in accordance with a method of driving of the present invention shown in Embodiment 1.
Figure 3B:
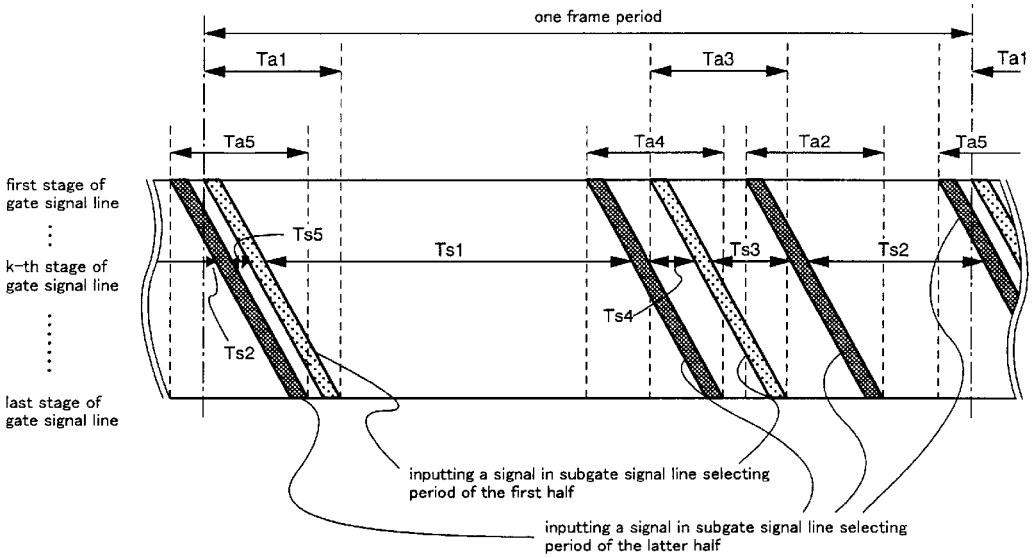

This problem can be resolved in accordance with interchanging the order of long subframe periods and short subframe periods, as one method. FIGS. 3A and 3B are referenced. FIGS. 3A and 3B show timing charts when dividing one frame period into five subframe periods, similar to FIGS. 2A and 2B. With the subframe period order taken as $SF_1 \rightarrow SF_4 \rightarrow SF_3 \rightarrow SF_2 \rightarrow SF_5$, and in addition by suitably partitioning the gate signal line selection timing to the first half and the second half of the sub-gate signal line selection periods, overlap of the address (write in) periods does not occur within the same sub-gate signal line selection period (See FIG. 3B.) The length of each subframe period and address (write in) period is similar to those shown in FIGS. 2A and 2B, but normal write in to the pixels can be performed by using the method shown in Embodiment 1. It is possible to implement the method of Embodiment 1 without performing changes on the circuit side.

Embodiment 2

A method of avoiding overlap of address (write in) periods by a means which differs from that of Embodiment 1 is explained in Embodiment 2.

Figure 4A:
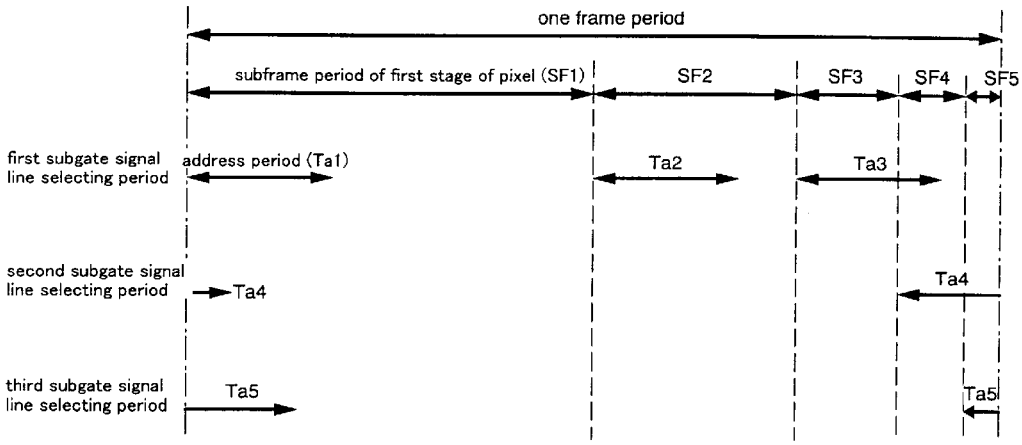
FIGS. 4A and 4B are timing charts in accordance with a method of driving of the present invention shown in Embodiment 2.
Figure 4B:
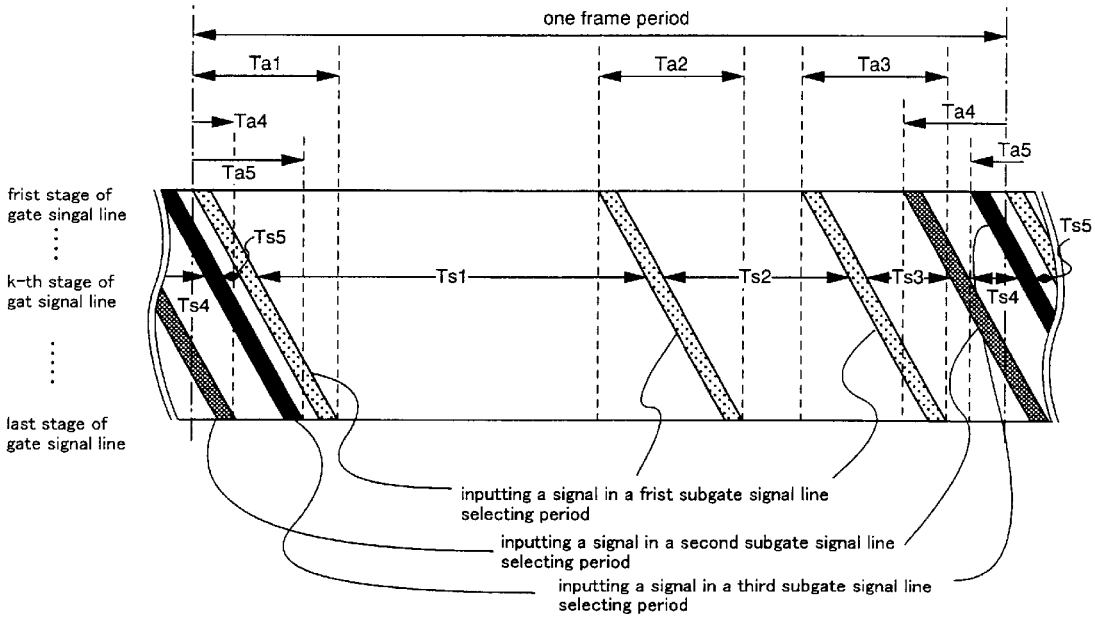

In FIGS. 2A and 2B, the address (write in) periods which overlap are $Ta_5$ and $Ta_1$ of the next frame period. This problem can be resolved by dividing the gate signal line selection periods into three sub-gate signal line selection periods and partitioning the write in of a signal into a first, a second, and a third sub-gate signal line selection period. FIGS. 4A and 4B are referred to. Signal write in is performed in $Ta_1$, $Ta_2$, and $Ta_3$ in the first sub-gate signal line selection period, signal write in is performed in $Ta_4$ in the second sub-gate signal line selection period, and signal write in is performed in $Ta_5$ in the third sub-gate signal line selection period. As a result, signal write in is performed at a timing like that shown in FIG. 4B, and overlap of a plurality of address (write in) periods within each sub-gate signal line selection period can be avoided.

While the number of divisions of the gate signal line selection periods increases, the sub-gate signal line selection periods becomes shorter, and the signal write in time is reduced in accordance with the method explained in Embodiment 2, although this method is effective in cases where the method shown in Embodiment 1 cannot be employed (for example, for a case in which the address (write in) period is long and even if the order is interchanged, there are portions which overlap).

Embodiment 3

A method of avoiding overlap of address (write in) periods by a means which differs from that of Embodiment 1 and Embodiment 2 is explained in Embodiment 3.

Figure 5A:
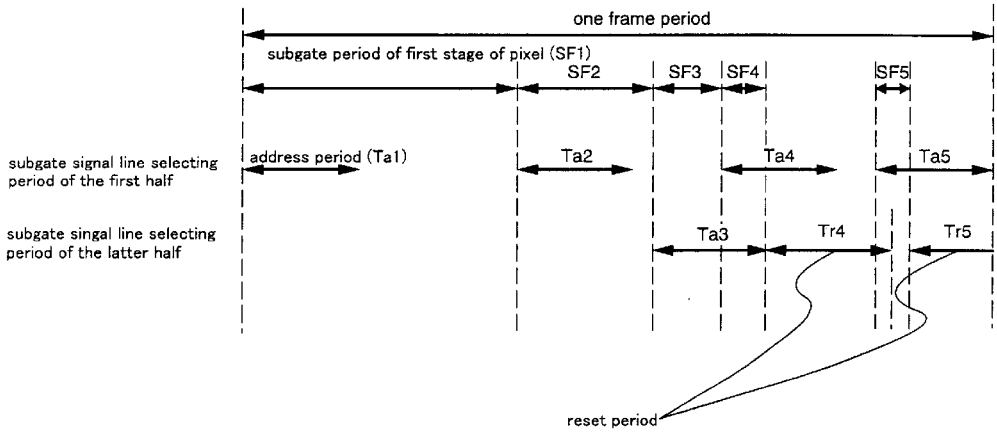
FIGS. 5A and 5B are timing charts in accordance with a method of driving of the present invention shown in Embodiment 3.
Figure 5B:
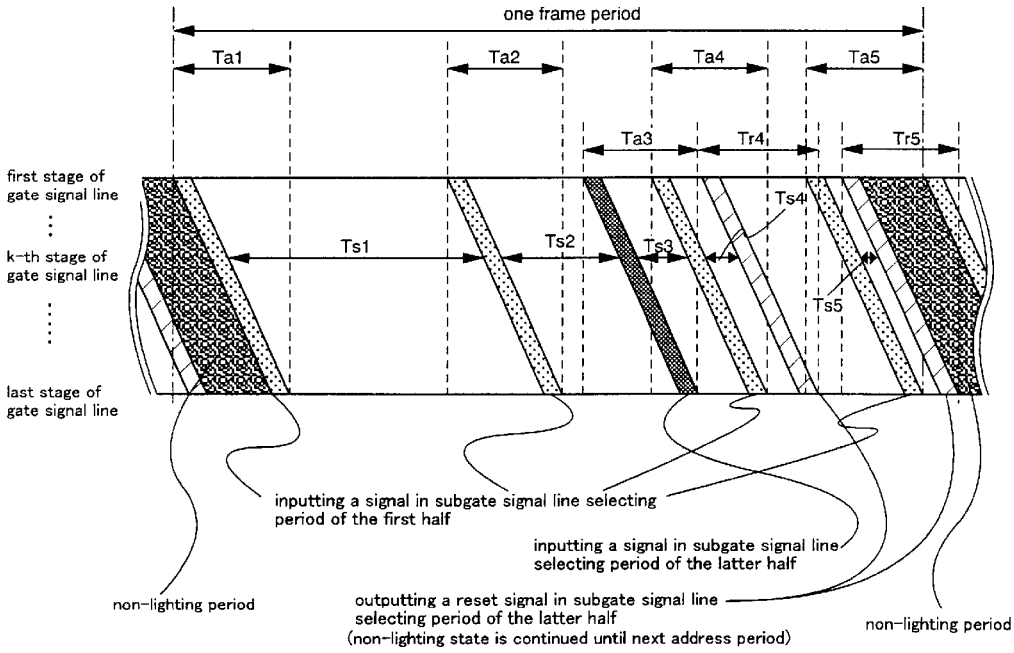

FIGS. 5A and 5B are referred to. The period of $SF_4$ and $SF_5$ themselves is short, and overlap of address (write in) periods cannot be avoided at a normal timing. Reset periods $Tr_4$ and $Tr_5$ are therefore formed after $SF_4$ and $SF_5$, respectively. A signal is input during the reset periods such that the OLED elements do not turn on. Specifically, the write in voltage may be a voltage in which electric charge does not accumulate in the storage capacitor. This signal is hereafter referred to as a reset signal. By changing the period from when the signal is written into the pixels until the reset signal is input, the lengths of the subframe periods $SF_4$ and $SF_5$ can be regulated, and the timing may be set such that each address (write in) period and reset period do not overlap.

A problem develops in that the OLED elements do not turn on in a period after input of the reset signal until the next address (write in) period appears if the method given in Embodiment 3 is used, but it is also possible to use the reset signal of Embodiment 3 with the aim of time regulation for cases in which the sustain (turn on) period does not fit well within one frame period.

Embodiment 4

Methods of avoiding overlap of address (write in) periods by regulating the timing of drive signals in accordance with the circuit structure shown in the embodiment mode are explained in Embodiments 1 to 3. A case of a circuit structure in which a gate signal line and a switching TFT are added is explained in Embodiment 4. Specifically, a case is given in which one gate signal line selection period is divided into two sub-gate signal line selection periods.

Figure 6A:
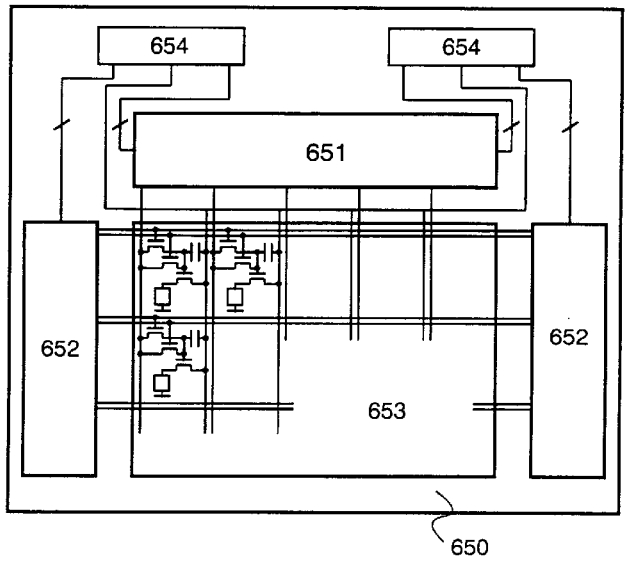
FIGS. 6A and 6B are circuit diagrams of a driver circuit of the present invention shown in Embodiment 4.
Figure 6B:
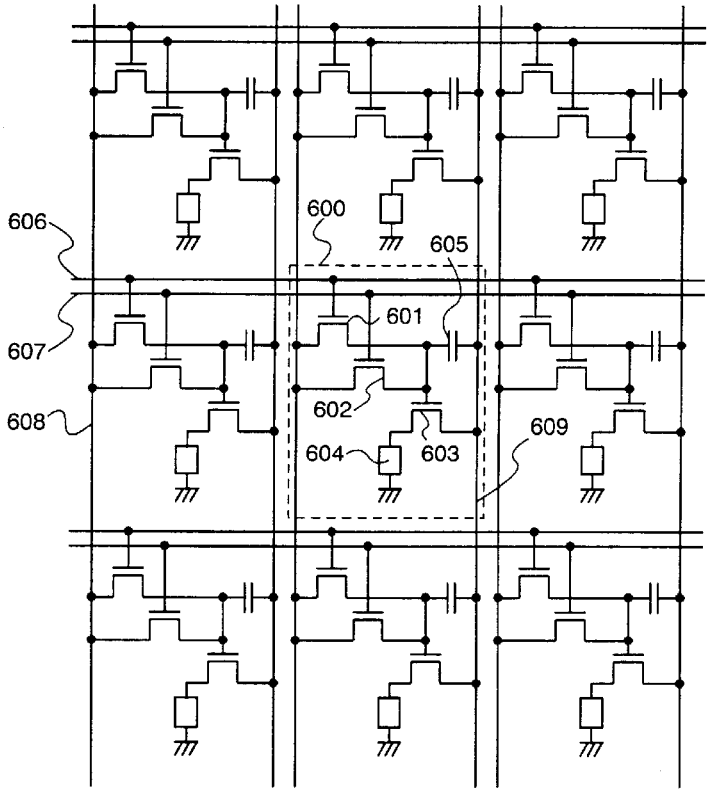
Figure 34A:
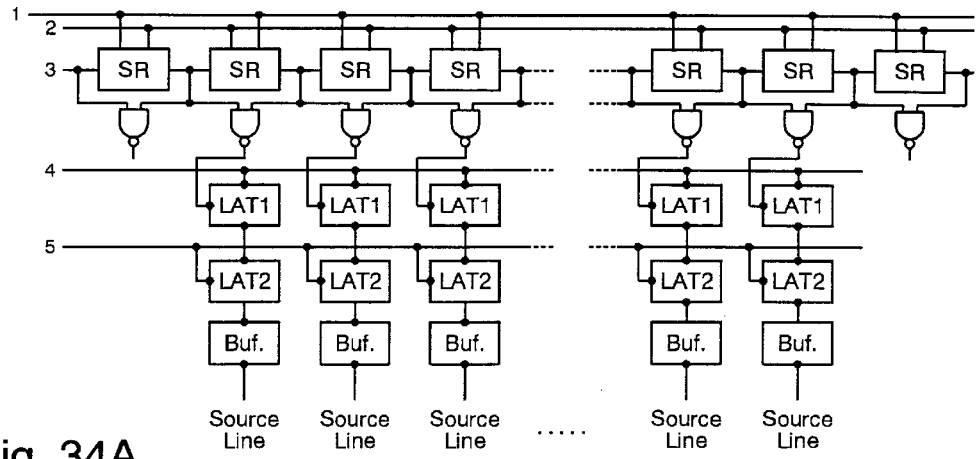
FIGS. 34A and 34B are diagrams showing examples of structures of gate signal line driver circuits for implementing the present invention.
Figure 34B:
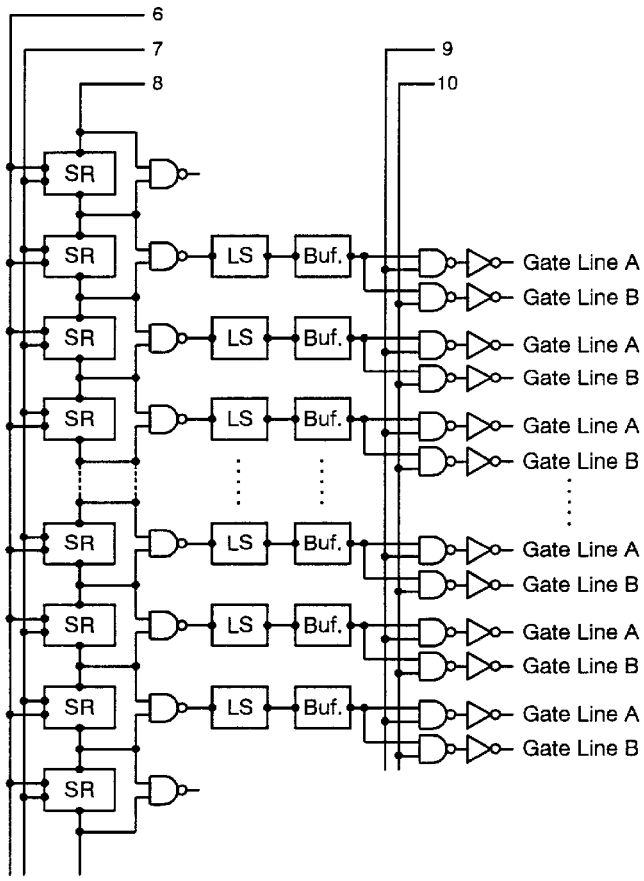

FIG. 6A is referenced. A source signal line driver circuit 651, a gate signal line driver circuit 652, and a pixel portion 653 are arranged on a substrate 650. In FIGS. 6A and 6B, the gate signal line driver circuit 652 is arranged on both sides, but it may also be formed on only one side. Two gate signal lines pass through one row of pixels in the circuit shown by Embodiment 4. A detailed diagram of a driver circuit in the electronic device shown in FIG. 6A is shown in FIGS. 34A and 34B. FIG. 34A is a source signal line driver circuit, and the series of paths from a shift register to a NAND to a first latch circuit to a second latch circuit to a buffer, and then to a source signal line may be made similar to a conventional example.

FIG. 34B is a gate signal line driver circuit. From a shift register to a buffer output, it may be made similar to a conventional example. The buffer output is input to two NAND circuits. The logical product of the buffer output and the sub-gate period selection pulse input from pins 9 and 10 is taken in each NAND circuit, and output to gate signal lines (GatOLEDines A and B). This may be considered to be an operation similar to that shown by FIG. 27B in the embodiment mode. In other words, sub-gate signal line selection pulses are output in order from two NAND circuits in one gate signal line selection period.

FIG. 6B is a diagram showing an enlargement of the pixel portion. The portion surrounded by a dotted line frame 600 is one pixel, and the pixel has a first switching TFT 601, a second switching TFT 602, an OLED driver TFT 603, an OLED element 604, a storage capacitor 605, a first gate signal line 606, a second gate signal line 607, a source signal line 608, and an electric current supply line 609. A selection pulse is input to the first gate signal line 606 from Gate Line A shown in FIG. 34B, and a selection pulse is input to the second gate signal line 607 from Gate Line B (the reverse may also be used).

As one example of a method of driving, input of the selection signals of the first half and the second half gate signal lines is provided by the two switching TFTs for a case such as that of Embodiment 1 in which the gate signal line selection period is divided into two sub-gate signal line selection periods. A signal is input from the first gate signal line 606 when the gate signal line in the first half sub-gate signal line selection period is selected, driving the first switching TFT 601, while a signal may be input from the second gate signal line 607 for a case in which the gate signal line is selected in the second half sub-gate signal line selection period, driving the second switching TFT 602.

Embodiment 5

An example of manufacturing an OLED (electroluminescence) display device having a driver circuit of the present invention is explained in Embodiment 5.

Figure 7A:
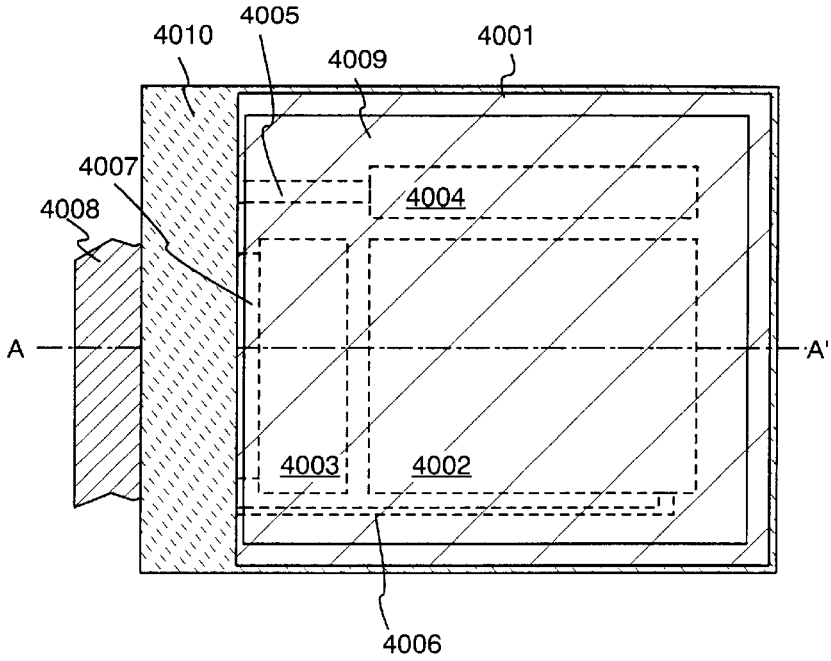
FIGS. 7A and 7B are a top surface diagram and a cross sectional diagram, respectively, of an OLED display device shown in Embodiment 5.

FIG. 7A is a top surface diagram of an OLED display device using the present invention. Reference numeral 4001 denotes a substrate in FIG. 7A, while reference numeral 4002 denotes a pixel portion, 4003 denotes a source signal line driver circuit, and 4004 denotes a gate signal line driver circuit. The respective driver circuits are connected to an external equipment via wirings 4005, 4006, and 4007 leading to an FPC 4008.

A cover material 4009, an airtight sealing material 4010, and a sealing material (also referred to as a housing material) 4011 (shown in FIG. 7B) are formed at this time so as to surround at least the pixel portion, and preferably the driver circuit and the pixel portion.

Figure 7B:
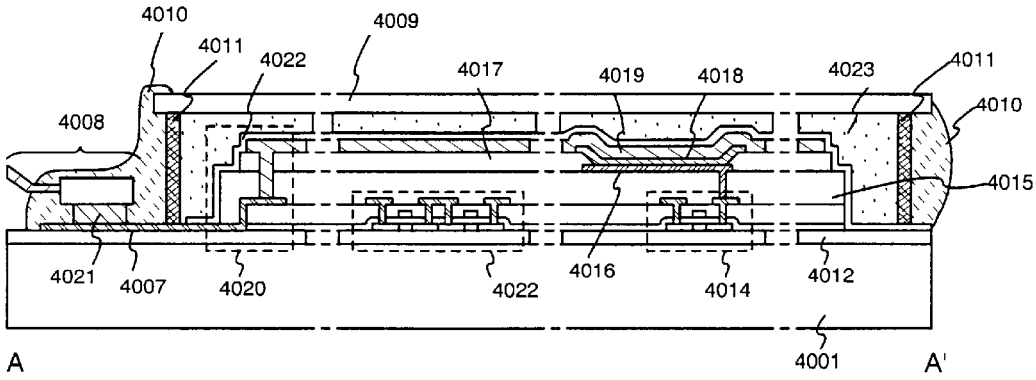

Further, FIG. 7B is a cross sectional structure of the OLED display device of Embodiment 5, and a driver circuit TFT (note that a CMOS circuit in which an n-channel TFT and a p-channel TFT are combined is shown in the figures here) 4013 and a pixel portion TFT 4014 (note that only an OLED driver TFT for controlling the electric current to the OLED element is shown in the figures here) are formed on a base film 4012 on the substrate 4001. Known structures (top gate structures or bottom gate structures) may be used for these TFTs.

After completing the driver circuit TFT 4013 and the pixel portion TFT 4014 by using a known method of manufacturing, a pixel electrode 4016 made from a transparent conducting film for electrically connecting to a drain of the pixel portion TFT 4014 is formed on an interlayer insulating film (leveling film) 4015 made from a resin material. A compound of indium oxide and tin oxide (referred to as ITO) and a compound of indium oxide and zinc oxide can be used as the transparent conducting film. An insulating film 4017 is formed once the pixel electrode 4016 is formed, and an open portion is formed on the pixel electrode 4016.

An OLED layer 4018 is formed next. A lamination structure of a known OLED material (hole injecting layer, hole transporting layer, light emitting layer, electron transporting layer, and electron injecting layer), or a single layer structure, may be used for the OLED layer 4018. Further, there are low molecular weight materials and high molecular weight materials (polymer materials) for the OLED material. An evaporation method is used when a low molecular weight material is used, but it is possible to use a simple method such as printing or spin coating of ink-jet printing when a high molecular weight material is used.

The OLED layer 4018 is formed by evaporation using a shadow mask in Embodiment 5. Color display becomes possible by forming light emitting layers (a red color light emitting layer, a green color light emitting layer, and a blue color light emitting layer) capable of emitting light at different wavelength for each pixel using the shadow mask. In addition, a method of combining a color changing layer (CCM) and a color filter, and a method of combining a white color light emitting layer and a color filter are available, and both may be used. Of course, a single color light emitting OLED display device can also be made.

After forming the OLED layer 4018, a cathode 4019 is formed on the OLED layer. It is preferable to remove as much moisture and oxygen as possible from the interface between the cathode 4019 and the OLED layer 4018. A method in which the OLED layer 4018 and the cathode 4019 are formed in succession within a vacuum, or in which the OLED layer 4018 is formed in an inert environment and the cathode 4019 is then formed without exposure to the atmosphere is therefore necessary. The above film formation can be performed by using a multi-chamber method (cluster tool method) film formation apparatus.

Note that a lamination structure of a LiF (lithium fluoride) film and an Al (aluminum) film is used as the cathode 4019 in Embodiment 5. Specifically, a 1 nm thick LiF (lithium fluoride) film is formed by evaporation on the OLED layer 4018, and a 300 nm thick aluminum film is formed on the LiF film. An MgAg electrode, which is a known cathode material, may of course also be used. The cathode 4019 is then connected to the wiring 4007 in a region denoted by reference numeral 4020. The wiring 4007 is an electric power source supply line for applying a predetermined voltage to the cathode 4019, and is connected to the FPC 4008 through a conducting paste material 4021.

The cathode 4019 and the wiring 4007 are electrically connected in the region shown by reference numeral 4020, and therefore it is necessary to form contact holes in the interlayer insulating film 4015 and in the insulating film 4017. These contact holes may be formed during etching of the interlayer insulating film 4015 (when the pixel electrode contact hole is formed) and during etching of the insulating film 4017 (when forming the open portion before forming the OLED layer). Further, etching may also be performed together through to the interlayer insulating film 4015 when etching the insulating film 4017. A contact hole having a good shape can be formed in this case provided that the interlayer insulating film 4015 and the insulating film 4017 are formed by the same resin material.

A passivation film 4022, a filler material 4023 and the cover material 4009 are formed covering the surface of the OLED element thus formed.

In addition, the sealing material 4011 is formed on the inside of the cover material 4009 and the substrate 4001 so as to surround the OLED element portion. The airtight sealing material (the second sealing material) 4010 is formed on the outside of the sealing material 4011.

The filler material 4023 functions as an adhesive for bonding the cover material 4009. PVC (polyvinyl chloride), epoxy resin, silicone resin, PVB (polyvinyl butyral) and EVA (ethylene vinyl acetate) can be used as the filler material 4023. A moisture absorption effect can be maintained if a drying agent is formed on the inside of the filler material 4023, and therefore it is preferable to do so. Further, deterioration of the OLED layer may be suppressed by arranging a material such as an oxidation preventing agent having an oxygen capturing effect inside the filler material 4023.

Furthermore, spacers may be included within the filler material 4023. The spacers may be made from a powdered substance composed of a material such as BaO, giving the spacers themselves moisture absorbency.

The passivation film 4022 can relieve the spacer pressure for cases of forming the spacers. Further, a film such as a resin film, separate from the passivation film, may also be formed for relieving the spacer pressure.

Further, a glass plate, an aluminum plate, a stainless steel plate, an FRP (fiberglass-reinformed plastic) plate, a PVF (polyvinyl fluoride) film, a mylar film, a polyester film, and an acrylic film can be used as the cover material 4009. Note that when using PVB or EVA as the filler material 4023, it is preferable to use a sheet having a structure in which several 10 of μm of aluminum foil is sandwiched by a PVF film or a mylar film (as the cover material 4009).

Note that, depending upon the direction of light emitted from the OLED elements (light emission direction), it may be necessary for the cover material 4009 to have light transmitting characteristics.

Further, the wiring 4007 is electrically connected to the FPC 4008 through a gap between the sealing material 4011 and the airtight sealing material 4010, and the substrate 4001. Note that, although the wiring 4007 is explained here, the other wirings 4005 and 4006 are also electrically connected to the FPC 4008 by passing under the sealing material 4011 and the airtight sealing material 4010.

Note that the cover material 4009 is bonded after forming the filler material 4023 in Embodiment 5, and that the sealing material 4011 is attached so as to the side surface (exposed surface) of the filler material 4023, but the filler material 4023 may also be formed after attaching the cover material 4009 and the sealing material 4011. A filler material injection port passing through the gap formed by the substrate 4001, the cover material 4009 and the sealing material 4011 is formed in this case. The gap is then placed in a vacuum state (equal to or less than $10^{-2}$ torr), and after immersing the injection port in a tank containing the filler material, the pressure on the outside of the gap is made higher than the pressure within the gap, and the filler material fills the space.

Embodiment 6

In this embodiment, an example in which an OLED display device different from Embodiment 5 is manufactured, is described with reference to FIGS. 8A and 8B. Since the same reference numerals as those in FIGS. 7A and 7B denote the same portions in FIGS. 8A and 8B, an explanation is omitted.

Figure 8A:
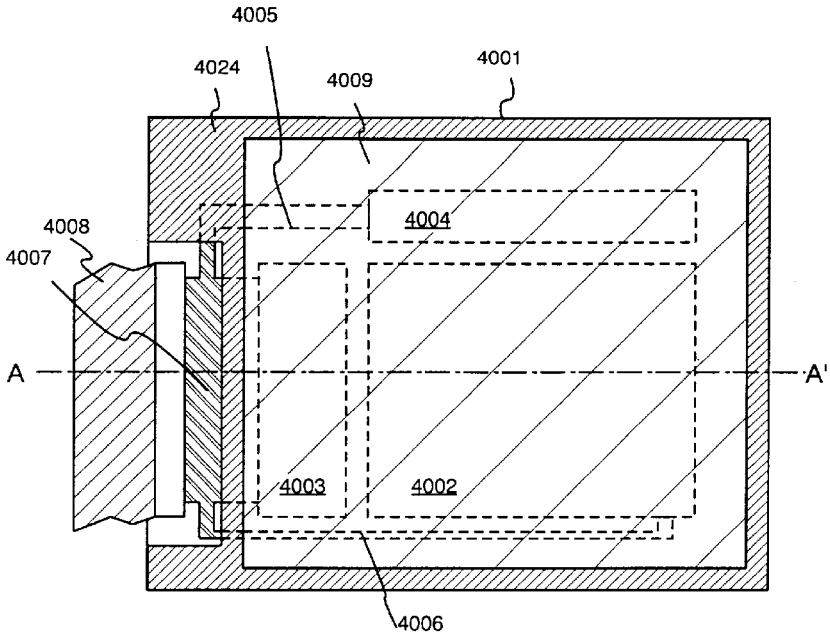
FIGS. 8A and 8B are a top surface diagram and a cross sectional diagram, respectively, of an OLED display device display device shown in Embodiment 6.
Figure 8B:
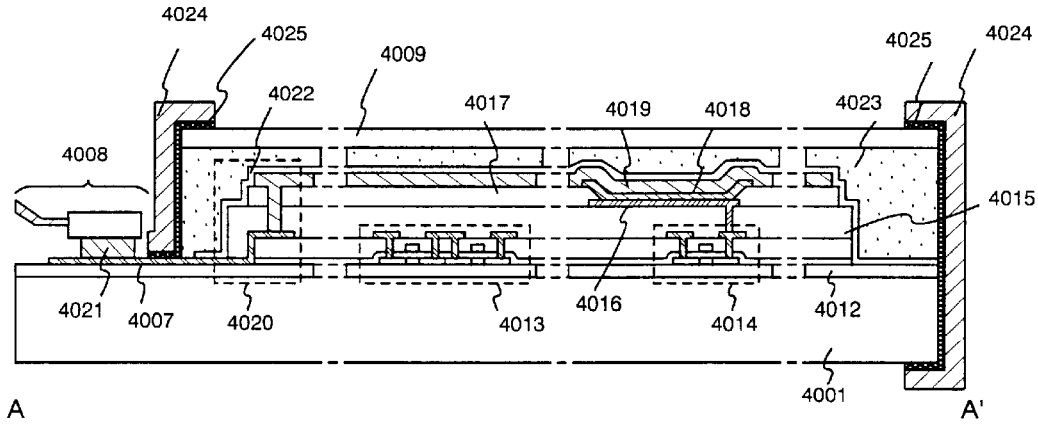

FIG. 8A is a top view of an OLED display device of this embodiment. FIG. 8B is a sectional view of the OLED display device taken along line A–A' of FIG. 8A.

In accordance with Embodiment 5, steps are carried out until a passivation film 4022 covering the surface of an OLED element is formed.

Further, a filler material 4023 is provided so as to cover the OLED element. This filler material 4023 functions also as an adhesive for bonding a cover material 4009. As the filler material 4023, PVC (polyvinyl chloride), epoxy resin, silicone resin, PVB (polyvinyl butyral) or EVA (ethylene-vinyl acetate) can be used. It is preferable that a drying agent is provided in the inside of this filler material 4023, since a moisture absorption effect can be held. It is also preferable that antioxidant or the like which can capture oxygen, is provided in the inside of this filler material 4023, since deterioration of the OLED layer can be prevented.

A spacer may be contained in the filler material 4023. At this time, the spacer is a granular material made of BaO or the like, thereby the spacer itself may be made to have a moisture absorption property.

In the case where the spacer is provided, the passivation film 4022 can relieve spacer pressure. In addition to the passivation film, a resin film or the like for relieving the spacer pressure may be provided.

As the cover material 4009, a glass plate, an aluminum plate, a stainless plate, an FRP (Fiberglass-Reinforced Plastics) plate, a PVF (polyvinyl fluoride) film, a Mylar film, a polyester film, or an acrylic film can be used. In the case where PVB or EVA is used for the filler material 4023, it is preferable to use a sheet of a structure in which an aluminum foil of several tens of μm is interposed between PVF films or Mylar films.

However, according to the direction of light emission (radiation direction of light) from the OLED element, it is necessary that the cover material 6000 has transparency.

Next, after the cover material 4009 is bonded by using the filler material 4023, a frame member 4024 is attached so as to cover the side (exposed surface) of the filler material 4023. The frame member 4024 is bonded by a sealing material (functioning as an adhesive) 4025. At this time, as the sealing material 4025, although it is preferable to use a photo-curing resin, if heat resistance of the OLED layer permits, a thermosetting resin may be used. Incidentally, it is desirable that the sealing material 4025 is a material which is as impermeable as possible to moisture and oxygen. A drying agent may be added in the inside of the sealing material 4025.

Further a wiring 4007 is electrically connected to an FPC 4008 through a gap between the sealing material 4025 and a substrate 4001. Here, although description is made on the wiring 4007, other wirings 4005 and 4006 are also electrically connected to the FPC 4008 through a space under the sealing material 4025 in the same manner.

In Embodiment 6, the cover material 4009 is bonded after forming the filler material 4023, and the frame member 4024 is attached so as to cover the side surfaces (exposed surfaces) of the filler material 4023, but the filler material 4023 may also be formed after attaching the cover material 4009, sealing material 4025, and the frame member 4024. In this case, a filler material injection opening is formed through a gap formed by the substrate 4001, the cover material 4009, sealing material 4025 and the frame member 4024. The gap is set into a vacuum state (a pressure equal to or less than $10^{-2}$ Torr), and after immersing the injection opening in the tank holding the filler material, the air pressure outside of the gap is made higher than the air pressure within the gap, and the filler material fills the gap.

[Embodiment 7]

Figure 9:
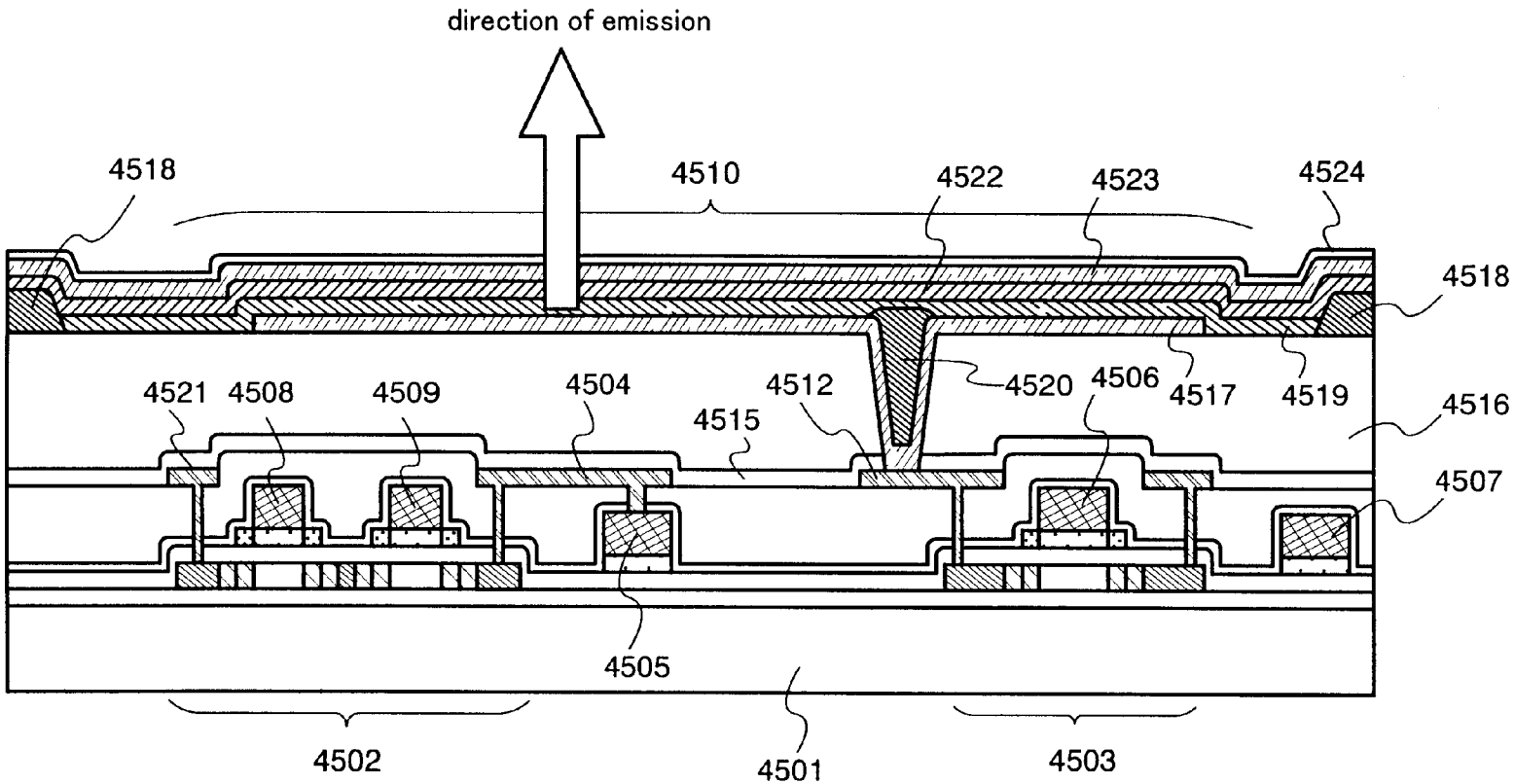
FIG. 9 is a cross sectional diagram of an OLED display device shown in Embodiment 7.
Figure 10A:
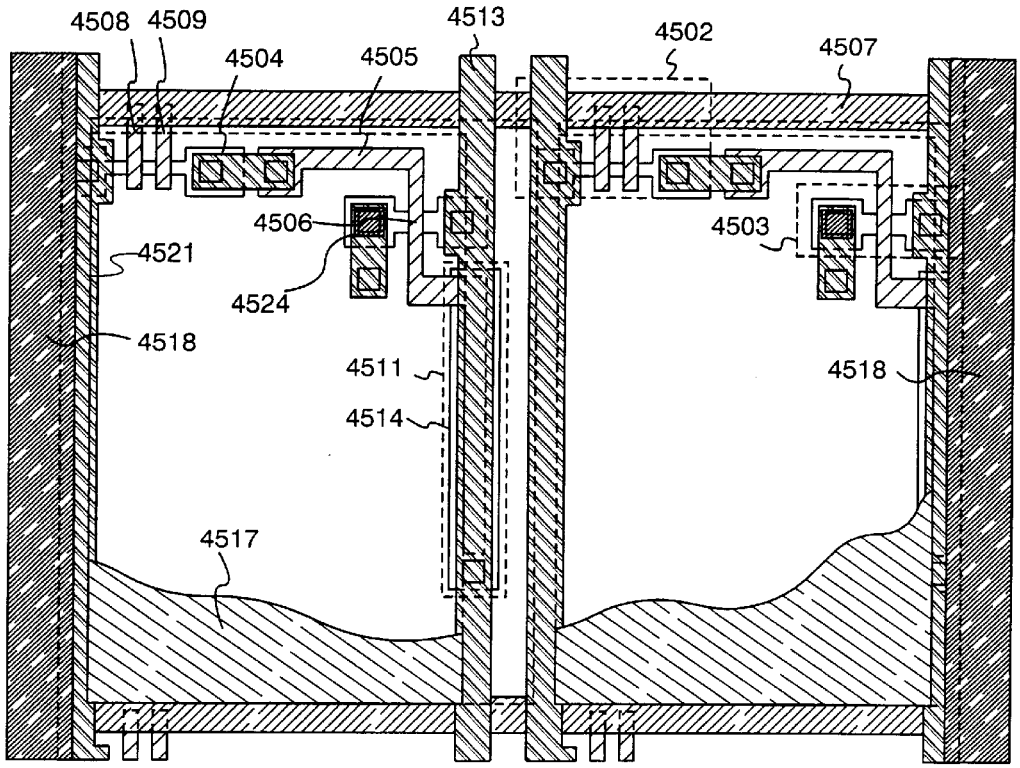
FIGS. 10A and 10B are a diagram of a pixel matrix portion, and its equivalent circuit diagram, respectively, of the OLED display device shown in Embodiment 7.
Figure 10B:
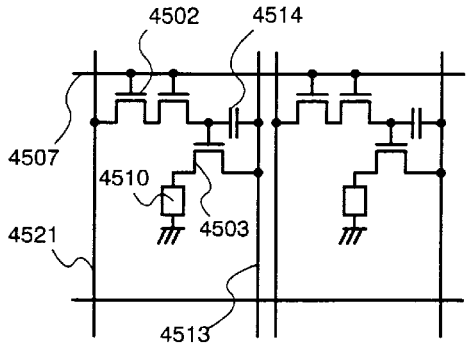

Here, a more detailed sectional structure of a pixel portion of an OLED display device is shown in FIG. 9, its upper structure is shown in FIG. 10A, and its circuit diagram is shown in FIG. 10B. In FIGS. 9, 10A and 10B, since common marks are used, reference may be made to one another.

In FIG. 9, a switching TFT 4502 provided on a substrate 4501 is formed by using an n-channel TFT formed by a known method. In this embodiment, although a double gate structure is used, since there is no big difference in the structure and fabricating process, explanation is omitted. However, a structure in which two TFTs are substantially connected in series with each other is obtained by adopting the double gate structure, and there is a merit that an off current value can be decreased. Incidentally, although the double gate structure is adopted in this embodiment, a single gate structure may be adopted, or a triple gate structure or a multi-gate structure having more gates may be adopted. Further, it may be formed by using a p-channel TFT formed by a known method.

Further, an OLED driver TFT 4503 is formed by using an n-channel TFT formed by a known method. A drain wiring 4504 of the switching TFT 4502 is electrically connected to a gate electrode 4506 of the OLED driver TFT 4503 through a wiring 4505. A wiring designated by reference numeral 4507 is a gate wiring for electrically connecting gate electrodes 4508 and 4509 of the switching TFT 4502.

Since the OLED driver TFT 4503 is an element for controlling the amount of current flowing through an OLED element 4510, a large current flows and it is an element having high fear of deterioration due to heat or deterioration due to hot carriers. Thus, it is very effective to adopt a structure in which an LDD region is provided at a drain side of the OLED driver TFT 4503 so as to overlap with a gate electrode through a gate insulating film.

In this embodiment, although the OLED driver TFT 4503 is shown as a single gate structure, a multi-gate structure in which a plurality of TFTs are connected in series with each other may be adopted. Further, such a structure may be adopted that a plurality of TFTs are connected in parallel with each other to substantially divide a channel forming region into plural portions, so that radiation of heat can be made at high efficiency. Such structure is effective as a countermeasure against deterioration due to heat.

Further, as shown in FIG. 10A, the wiring 4505 including the gate electrode 4506 of the OLED driver TFT 4503 overlaps with a drain wiring 4512 of the OLED driver TFT 4503 through an insulating film in a region designated by 4511. At this time, a storage capacitor is formed in the region designated by 4511. The storage capacitor 4511 is formed between the semiconductor film 4514 connected electrically to the power supply line 4513, an insulating film (not shown in figures) which is the same layer of the gate insulating film, and the wiring 4505. Further, the capacitor, which is formed from the wiring 4505, the same layer (not shown in figures) of a first interlayer insulating film and the power supply line 4513 can be also used as a storage capacitor. The storage capacitor 4511 functions to store a voltage applied to the gate electrode 4506 of the OLED driver TFT 4503. The drain region of the OLED driver TFT 4503 is connected to the power supply line (power source line) 4513 so as to be always supplied with a constant voltage.

A first passivation film 4515 is provided on the switching TFT 4502 and the OLED driver TFT 4503, and a flattening film 4516 made of a resin insulating film is formed thereon. It is very important to flatten a stepped portion due to the TFT by using the flattening film 4516. Since a light emitting layer 4519 formed later is very thin, there is a case where light emission defect occurs due to the existence of the stepped portion. Thus, it is desirable to conduct flattening prior to formation of a pixel electrode 4517 so that the light emitting layer 4519 can be formed on the flat surface.

Reference numeral 4517 designates a pixel electrode (cathode of the OLED element) made of a conductive film having high reflectivity, and is electrically connected to the drain region of the OLED driver TFT 4503 through contact holes provided on the first passivation film 4515 and the flattening film 4516. As the pixel electrode 4517, it is preferable to use a low resistance conductive film, such as an aluminum alloy film, a copper alloy film or a silver alloy film, or a lamination film of those. Of course, a laminate structure with another conductive film may be adopted.

Then, an organic resin film is formed on a pixel electrode 4517 and the flattening film 4516, and the organic resin film is patterned to form a bank 4518 and a tap 4520. The bank 4518 is formed to separate a light emitting layer or an OLED layer of adjacent pixels from each other. The tap 4520 is provided on a portion where the pixel electrode 4517 is connected with the drain wiring 4512 of the OLED driver TFT 4503. Since there is a case where the pixel electrode 4517 has a step at a contact hole portion, it is preferable to make flattening by providing the tap 4520 in order to prevent poor light emission of the light emitting layer 4519 formed later. Note that the bank 4518 and the tap 4520 may not be formed to the same thickness, and can be suitably set in accordance with the thickness of the later formed light emitting layer 4519.

An OLED layer 4519 is formed in a groove (corresponding to a pixel) formed by banks 4518. In FIG. 10A, though one of banks is eliminated to clarify the position of the storage capacitor 4511, banks are provided between pixels to cover the power supply line 4513 and one portion of the source wiring 4521. Herein, only two pixels are shown, however, light emitting layers corresponding to each color of R (red), G (green), and B (blue) may be formed. As an OLED material used for the light emitting layer, a π-conjugate polymer material is used. Typical examples of the polymer material include polyparaphenylene vinylene (PPV), polyvinyl carbazole (PVK), and polyfluorene.

Although various types exist as the PPV typed OLED material, for example, a material as disclosed in "H. Shenk, H. Becker, O GOLEDsen, E. Kluge, W. Kreuder, and H. Spreitzer, "Polymers for Light Emitting Diodes", Euro Display, Proceedings, 1999, p. 33–37" or Japanese Patent Application Laid-open No. Hei. 10-92576 may be used.

As a specific light emitting layer, it is appropriate that cyanopolyphenylene-vinylene is used for a light emitting layer emitting red light, polyphenylenevinylene is used for a light emitting layer emitting green light, and polyphenylenevinylene or polyalkylphenylene is used for a light emitting layer emitting blue light. It is appropriate that the film thickness is made 30 to 150 nm (preferably 40 to 100 nm).

However, the above examples are an example of the OLED material which can be used for the light emitting layer, and it is not necessary to limit the invention to these. The OLED layer (layer in which light emission and movement of carriers for that are performed) may be formed by freely combining a light emitting layer, a charge transporting layer and a charge injecting layer.

For example, although this embodiment shows the example in which the polymer material is used for the light emitting layer, a low molecular OLED material may be used. It is also possible to use an inorganic material, such as silicon carbide, as the charge transporting layer or the charge injecting layer. As the OLED material or inorganic material, a well-known material can be used.

This embodiment adopts the OLED layer having a lamination structure in which a hole injecting layer 4522 made of PEDOT (polythiophene) or PAni (polyaniline) is provided on the light emitting layer 4519. An anode 4523 made of a transparent conductive film is provided on the hole injecting layer 4522. In the case of this embodiment, since light generated in the light emitting layer 4519 is radiated to an upper surface side (to the upper side of the TFT), the anode must be translucent. As the transparent conductive film, a compound of indium oxide and tin oxide or a compound of indium oxide and zinc oxide can be used. However, since the film is formed after the light emitting layer and the hole injecting layer having low heat resistance is formed, it is preferable that film formation can be made at the lowest possible temperature.

At the point when the anode 4523 was formed, an OLED element 4510 is completed. Incidentally, the OLED element 4510 here indicates a storage capacitor formed of the pixel electrode (cathode) 4517, the light emitting layer 4519, the hole injecting layer 4522 and the anode 4523. As shown in FIG. 11A, since the pixel electrode 4517 is almost coincident with the area of the pixel, the whole pixel functions as the OLED element. Thus, use efficiency of light emission is very high, and bright image display becomes possible.

In this embodiment, a second passivation film 4524 is further provided on the anode 4523. As the second passivation film 4524, a silicon nitride film or a silicon nitride oxide film is desirable. This object is to insulate the OLED element from the outside, and has both meaning of preventing deterioration due to oxidation of the OLED material and suppressing degassing from the OLED material. By doing this, the reliability of the OLED display device is improved.

As described above, the OLED display panel described in the Embodiment 7 includes the pixel portion comprising the pixel having the structure as shown in FIG. 9, and includes the switching TFT having a sufficiently low off current value and the OLED driver TFT resistant to hot carrier injection. Thus, it is possible to obtain the OLED display panel which has high reliability and can make excellent image display.

[Embodiment 8]

Figure 11:
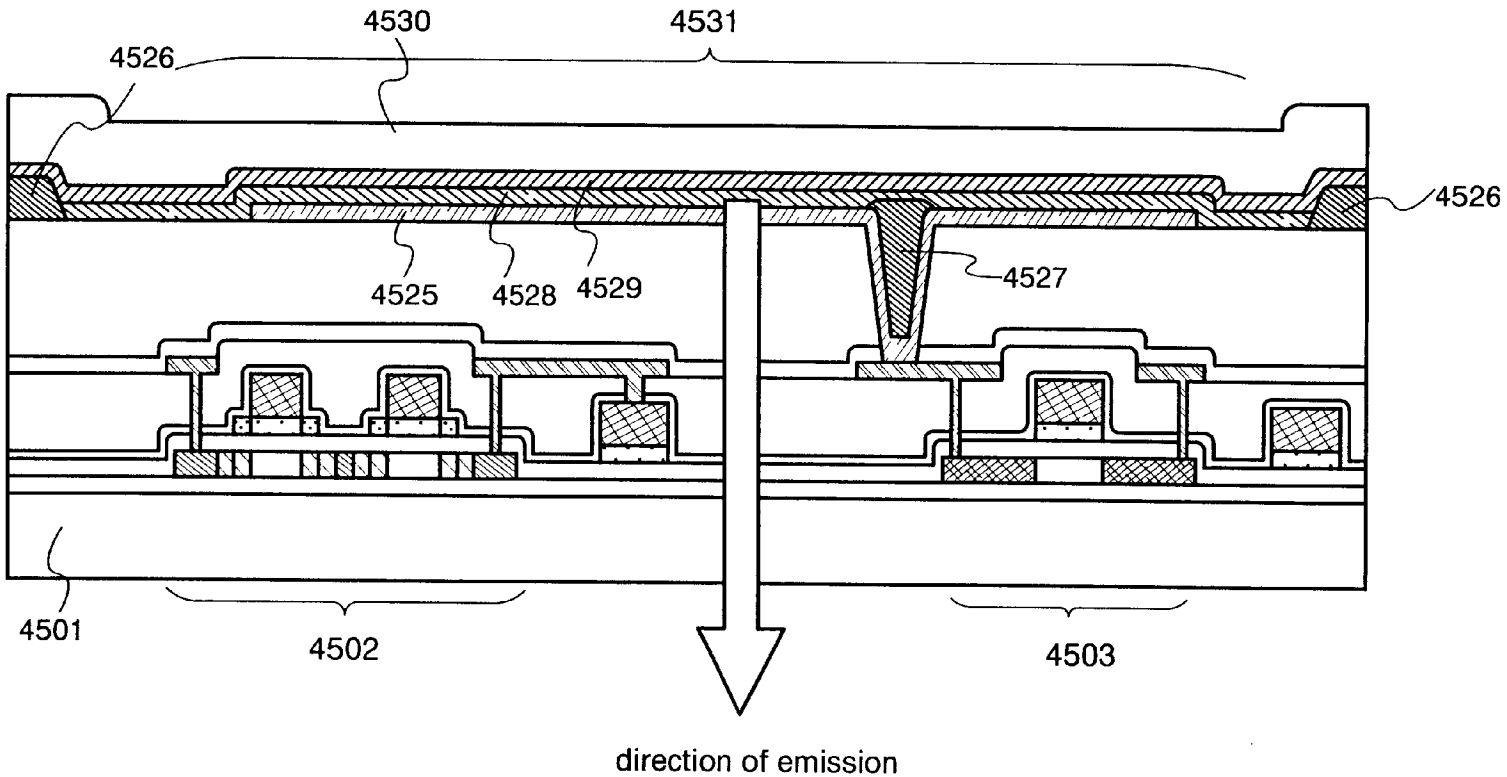
FIG. 11 is a cross sectional diagram of an OLED display device shown in Embodiment 8.

In this embodiment, a description will be made on a structure in which the structure of the OLED element 4510 is inverted in the pixel portion shown in Embodiment 7. FIG. 11 is used for the description. Incidentally, points different from the structure of FIG. 9 are only a portion of an OLED element and an OLED driver TFT, the other explanation is omitted.

In FIG. 11, an OLED driver TFT 4503 is formed by using a p-channel TFT formed by a known method.

In this embodiment, a transparent conductive film is used as a pixel electrode (anode) 4525. Specifically, a conductive film made of a compound of indium oxide and zinc oxide is used. Of course, a conductive film made of a compound of indium oxide and tin oxide may be used.

After a bank 4526 and a tap 4527 made of insulating films are formed, a light emitting layer 4528 made of polyvinylcarbazole is formed by solution application. An electron injecting layer 4529 made of potassium acetylacetonate (expressed as acacK), and a cathode 4530 made of aluminum alloy are formed thereon. In this case, the cathode 4530 functions also as a passivation film. In this way, an OLED element 4531 is formed.

In the case of an OLED element having the structure described in Embodiment 8, light generated in the light emitting layer 4528 is radiated to the substrate on which TFTs are formed as indicated by an arrow.

[Embodiment 9]

In this embodiment, an example of a case where a pixel is made to have a structure different from the circuit diagram shown in FIG. 10B will be described with reference to FIGS. 12A to 12C. In this embodiment, reference numeral 3801 designates a source signal line functioning as a source wiring of a switching TFT 3802; 3803 designates a gate signal line functioning as a gate electrode of the switching TFT 3802; 3804 designates an OLED driver TFT; 3805 designates a storage capacitor; 3806 and 4808 designate power supply lines; and 3807 designates an OLED element.

Figure 12A:
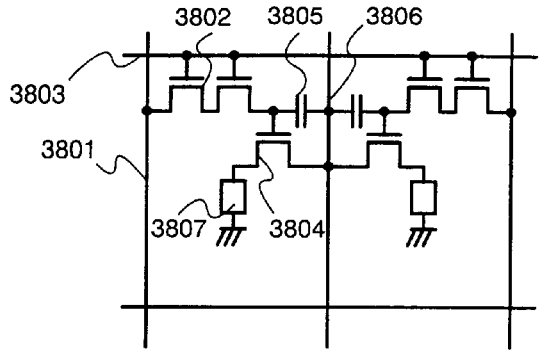
FIGS. 12A to 12C are examples of circuit structures of a pixel portion of an OLED display device shown in Embodiment 9.

FIG. 12A shows an example in which the power supply line 3806 is made common between adjacent two pixels. That is, it is characterized in that the adjacent two pixels are formed to become axisymmetric with respect to the power supply line 3806. In this case, since the number of power supply lines can be decreased, the pixel portion can be made further fine.

Figure 12B:
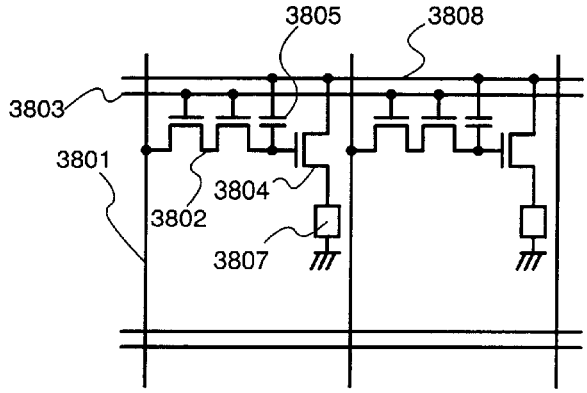

FIG. 12B shows an example in which the power supply line 3808 is provided in parallel with the gate signal line 3803. Incidentally, although FIG. 12B shows the structure in which the power supply line 3808 does not overlap with the gate signal line 3803, if both are wirings formed in different layers, they can be provided so that they overlap with each other through an insulating film. In this case, since an occupied area can be made common to the power supply line 3808 and the gate signal line 3803, the pixel portion can be further made fine.

Figure 12C:
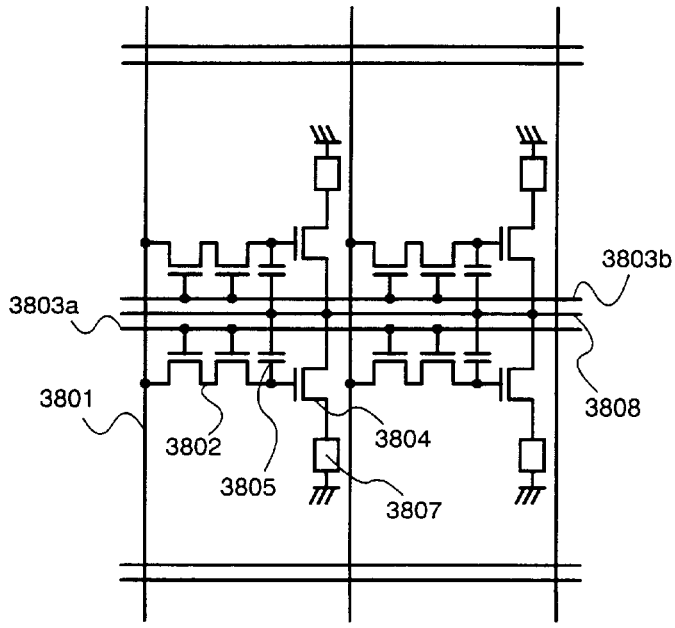

The structure of FIG. 12C is characterized in that the power supply line 3808 is provided in parallel with the gate signal line 3803 similarly to the structure of FIG. 12B, and further, two pixels are formed so that they become axisymmetric with respect to the power supply line 3808. Besides, it is also effective to provide the power supply line 3808 in such a manner that it overlaps with either one of the gate signal line 3803. In this case, since the number of power supply lines can be decreased, the pixel portion can be made further fine.

[Embodiment 10]

Although FIGS. 10A and 10B of Embodiment 7 show the structure in which the storage capacitor 4511 is provided to hold the voltage applied to the gate electrode of the OLED driver TFT 4503, the storage capacitor 4511 can also be omitted. In the case of Embodiment 7, since an n-channel TFT formed by a known method as the OLED driver TFT 4503, the GOLD region is provided so as to overlap with the gate electrode through the gate insulating film. Although a parasitic capacitance generally called a gate capacitance is formed in this overlapping region, this embodiment is characterized in that this parasitic capacitance is positively used instead of the storage capacitor 4511.

Since the capacity of this parasitic capacitance is changed by the overlapping area of the gate electrode and the GOLD region, it is determined by the length of the GOLD region contained in the overlapping region.

Also in the structures shown in FIGS. 12A, 12B and 12C of Embodiment 9, the storage capacitor 3805 can be similarly omitted.

Embodiment 11

As an example method of manufacturing an OLED (electroluminescence) display device explained by Embodiments 1 to 10: a method of forming an OLED driver TFT, which is a switching element of a pixel portion, and a TFT of a driver circuit (such as a source signal line driver circuit and a gate signal line driver circuit) formed in the periphery of the pixel portion on the same substrate is explained in Embodiment 11 in accordance with the press steps. Note that, in order to simplify the explanation, a CMOS circuit, which is a fundamental structure circuit of a driver circuit portion, is shown in the figures as the driver circuit portion, and a switching TFT and an OLED driver TFT are shown in the figures as a pixel portion.

Figure 13A:
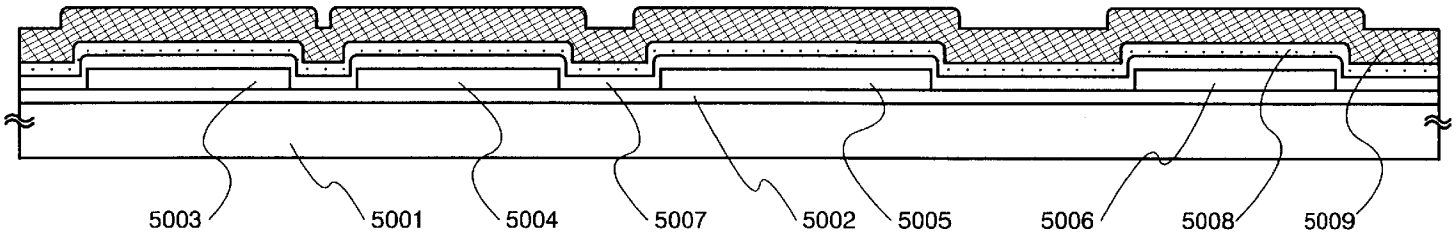
FIGS. 13A to 13C are diagrams showing a process of manufacturing an OLED display device shown in Embodiment 11.
Figure 13B:
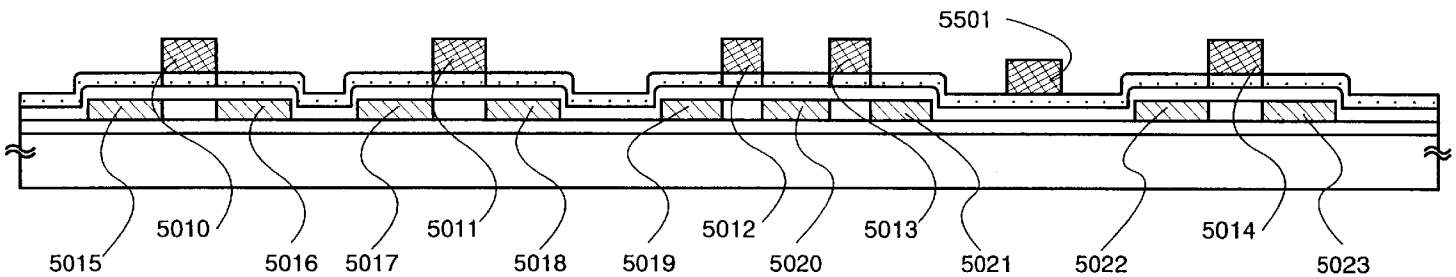
Figure 13C:
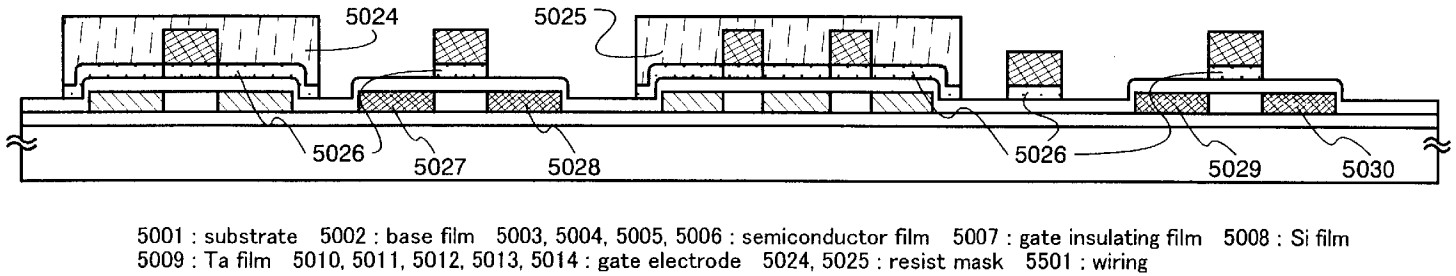

Refer to FIGS. 13A to 13C. A non-alkaline glass substrate is used in a substrate 5001, typically, a Corning Corp. 1737 glass substrate, for example. A base film 5002 is then formed by plasma CVD or sputtering on a surface of the substrate 5001 on which TFTs will be formed. Although not shown in the figures, the base film 5002 is formed from a 25 to 100 nm thick silicon nitride film, 50 nm here, and a 50 to 300 nm thick silicon oxide film, 150 nm here and laminated. Further, the base film 5002 may also use only a silicon nitride film or only a silicon nitride oxide film.

Next, a 50 nm thick amorphous silicon film is formed on the base film 5002 by plasma CVD. Although depending upon the amount of hydrogen contained in the amorphous silicon film, dehydrogenation is performed by heat treatment preferably for several hours between 400 and 550° C., and a crystallization process is preferably performed with the amount of contained hydrogen equal to or less than 5 atom %. Further, the amorphous silicon film may also be formed by another method of manufacturing, such as sputtering or evaporation, but it is preferable that the amount of impurity element such as oxygen and nitrogen contained within the film be sufficiently reduced.

The base film and the amorphous silicon film are both manufactured by plasma CVD here, and the base film and the amorphous silicon film may also be formed in succession within a vacuum. By using a process in which there is no exposure to the atmosphere of the surface of the base film after forming the base film 5002, it becomes possible to prevent surface contamination, and dispersion in the characteristics of the manufactured TFT can be reduced.

A known laser crystallization technique of thermal crystallization technique may be used for a process of crystallizing the amorphous silicon film. Crystallization is performed in Embodiment 11 by condensing light from a pulse emission KrF excimer laser into a linear shape and then irradiating it onto the amorphous silicon film, forming a crystalline silicon film.

Note that, although a method of crystallizing an amorphous silicon film using laser or thermal crystallization for forming a semiconductor layer is employed in Embodiment 11, a microcrystalline silicon film may also be used, and direct film formation of a crystalline silicon film may also be used.

The crystalline silicon film thus formed is patterned, forming island shape semiconductor layers 5003, 5004, 5005, and 5006.

A gate insulating film 5007 is formed next from a material having silicon oxide or silicon nitride as its main constituent, covering the island-shaped semiconductor layers 5003 to 5006. The gate insulating film 5007 may be formed from a silicon nitride oxide film having a thickness of 10 to 200 nm, preferably from 50 to 150 nm, manufactured by plasma CVD with $N_2O$ and $SiH_4$ as raw materials. A 100 nm thickness is formed in this embodiment.

A first conducting film 5008 which becomes a first gate electrode, and a second conducting film 5009 which becomes a second gate electrode, are then formed on the gate insulating film 5007. The first conducting film 5008 may be formed by a semiconductor film of one element selected from the group consisting of Si and Ge, or from a semiconductor film having one of the elements as its main constituent. Further, the thickness of the first conducting film 5008 must be from 5 to 50 nm, preferable between 10 and 30 nm. A 20 nm thick Si film is formed in this embodiment.

An impurity element which imparts n-type or p-type conductivity may be added to the semiconductor film used as the first conducting film. A known method may be followed for the method of manufacture of this semiconductor film. For example, it can be manufactured by reduced pressure CVD with a substrate temperature between 450 and 500° C., and disilane ($Si_2H_6$) introduced at 250 SCCM and helium (He) introduced at 300 SCCM. 0.1 to 2% of $PH_3$ may also be simultaneously mixed in to $Si_2H_6$ at this time, forming an n-type semiconductor film.

The second conducting film 5009 which becomes the second gate electrode may be formed from a conducting material having etching selectivity, or from a compound material having one such conducting material as its main constituent. This is in consideration of lowering the electric resistance of the gate electrode, and, for example, an Mo-W compound may be used. Ta is used here, and is formed by sputtering to a thickness of 200 to 1000 nm, typically 400 nm. (See FIG. 13A.)

A resist mask is formed next using a known patterning technique, and a step of etching the second conducting film 5009 and forming second gate electrodes is performed. The second conducting film 5009 is formed by a Ta film, and therefore dry etching is performed. Dry etching is performed with the following conditions: $Cl_2$ introduced at 80 SCCM, a pressure of 100 mTorr, and a high frequency electric power input of 500 W. Second gate electrodes 5010, 5011, 5012, 5013, 5014 and 5015 are thus formed as shown in FIG. 12B.

Even if a slight residue is confirmed after etching, it can be removed by washing with SPX cleaning liquid or a solution such as EKC.

Further, the second conducting film 5009 can also be removed by wet etching. For example, it can easily be removed by a fluorine etching liquid when Ta is used.

A process of adding an n-type conductivity imparting first impurity element is performed next. This process is one for forming a second impurity regions. Ion doping is performed here using phosphine ($PH_3$). Phosphorous (P) is added to through the gate insulating film 5007 and the first conducting film 5008 and into the semiconductor layers below by this process, and therefore the acceleration voltage is set high at 80 keV. The concentration of phosphorous added to the semiconductor layers is preferably in a range from $1\times10^{16}$ to $1\times10^{19}$ atoms/cm$^3$, and is set to $1\times10^{18}$ atoms/cm$^3$ here. Phosphorous added regions 5015, 5016, 5017, 5018, 5019, 5020, 5021, 5022, and 5023 are thus formed in the semiconductor layers. (See FIG. 13B.)

This phosphorous is also added to a region in the first conducting film 5008 which does not overlap with the second gate electrodes 5010 to 5014 and a wiring 5501. The phosphorous concentration of this region is not prescribed in particular, but an effect of lowering the resistivity of the first conducting film can be obtained.

Next, regions which form n-channel TFTs are covered by resist masks 5024 and 5025, and a process of removing a portion of the first conducting film 5008 is performed. This is performed by dry etching in Embodiment 11. The first conducting film 5008 is Si, and therefore dry etching is performed with the following conditions: $CF_4$ introduced at 50 SCCM, $O_2$ introduced at 45 SCCM, a pressure of 50 mTorr, and a high frequency electric power input of 200 W. As a result, portions covered by the resist masks 5024 and 5025, and by the second gate conducting film, namely a first conducting film 5026, remain.

A process of adding a third p-type conductivity imparting impurity element into regions which form p-channel TFTs is then performed. The impurity element is added by ion doping using diborane ($B_2H_6$). The acceleration voltage is also set to 80 keV here, and boron is added at a concentration of $2\times10^{20}$ atoms/cm$^3$. Third impurity regions 5027, 5028, 5029, and 5030 in which boron is added at high concentration are formed. (See FIG. 13C.)

Figure 14A:
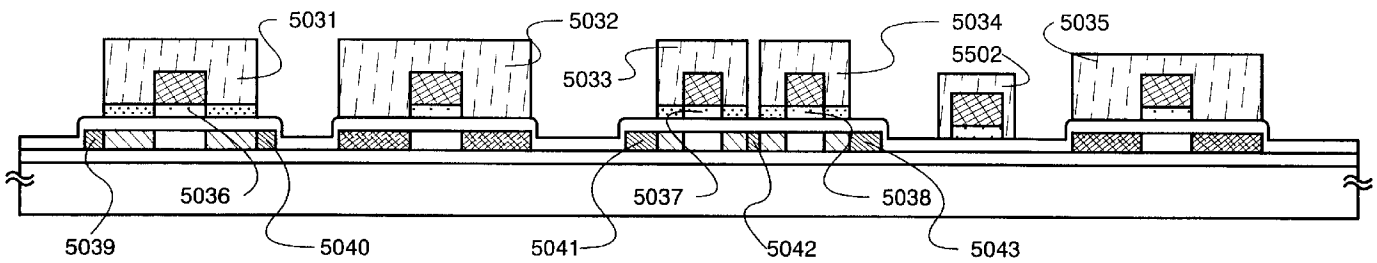
FIGS. 14A to 14C are diagrams showing the process of manufacturing the OLED display device shown in Embodiment 11.
Figure 14B:
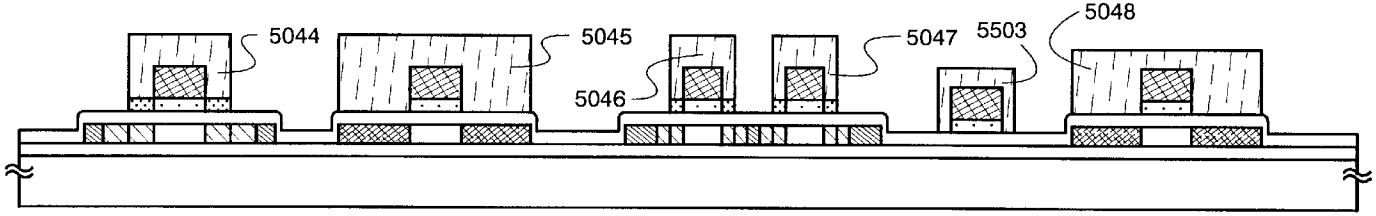
Figure 14C:
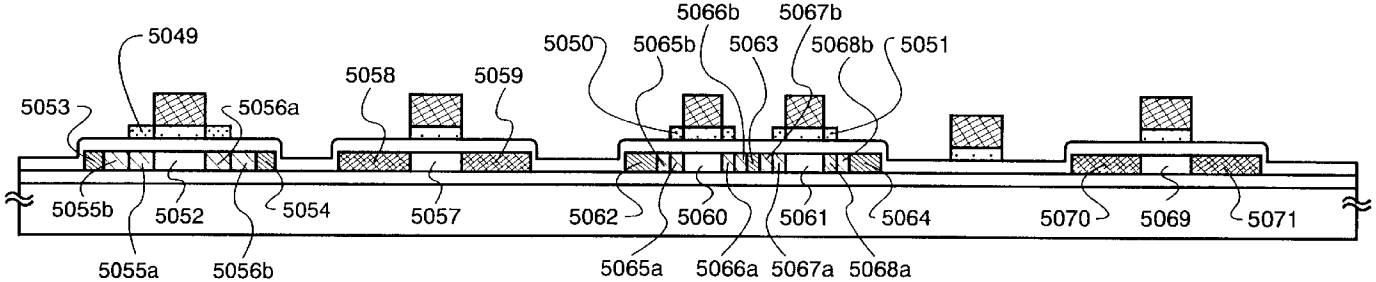

FIGS. 14A to 14C are referred to. The resist masks 5024 and 5025 are completely removed after adding the third impurity element, and new resist masks 5031, 5032, 5033, 5034, 5035, and 5502 are formed. The first conducting film is then etched using the resist masks 5031, 5033, and 5034, and new first conducting films 5036, 5037, and 5038 are formed. (See FIG. 14A.)

A process of adding a second n-type impurity element is then performed. Ion doping using phosphine ($PH_3$) is performed here. Phosphorous is added through the gate insulating film 5007 and into the active layers below, and therefore a high acceleration voltage of 80 keV is also used by this process. Phosphorous added regions 5039, 5040, 5041, 5042, and 5043 are formed. The concentration of phosphorous in these regions is high when compared to the process of adding the first n-type conductivity imparting impurity element, and it is preferable that it be from $1\times10^{19}$ to $1\times10^{21}$ atoms/cm$^3$. The concentration is set to $1\times10^{20}$ atoms/cm$^3$ in this embodiment. (See FIG. 14A.)

In addition, the resist masks 5031 to 5035 and 5502 are removed, and new resist masks 5044, 5045, 5046, 5047, 5048, and 5503 are formed, and etching of the first conducting film is performed. The length in the channel longitudinal direction of the resist masks 5044, 5046, and 5047, which form n-channel TFTs, is very important in determining the TFT structure. The resist masks 5044, 5046, and 5047 are formed with an aim of removing portions of the first conducting films 5036, 5037, and 5038. Whether the second impurity regions overlap with the first conducting film or do not overlap can be freely determined within a certain range by the lengths of the resist masks 5044, 5046, and 5047. (See FIG. 14B).

As shown in FIG. 14C, first gate electrodes 5049, 5050, and 5051 are formed.

A channel forming region 5052, first impurity regions 5053 and 5054, and second impurity regions 5055 and 5056 are formed in the n-channel TFT of the CMOS circuit by the above process. The second impurity regions are formed here by regions which overlap with a gate electrode (GOLD regions) 5055*a* and 5056*a*, and by regions with do not overlap with the gate electrode (LDD regions) 5055*b* and 5056*b*, respectively. The first impurity region 5053 becomes a source region, and the first impurity region 5054 becomes a drain region.

A clad structure gate electrode is similarly formed in the p-channel TFT, and a channel forming region 5057, and third impurity regions 5058 and 5059 are formed. The third impurity region 5059 becomes a source region, and the third impurity region 5058 becomes a drain region.

The switching n-channel TFT of the pixel portion is a multi-gate TFT, and channel forming regions 5060 and 5061, first impurity regions 5062, 5063, and 5064, and second impurity regions 5065, 5066, 5067, and 5068 are formed. The second impurity regions are formed by regions which overlap a gate electrode 5065*a*, 5066*a*, 5067*a*, and 5068*a*, and by regions which do not overlap the gate electrode 5065*b*, 5066*b*, 5067*b*, and 5068*b*, respectively.

Further, the OLED driver p-channel TFT has a structure similar to that of the p-channel TFT of the CMOS circuit, and a channel forming region 5069 and third impurity regions 5070 and 5071 are formed. The third impurity region 5070 becomes a source region, and the third impurity region 5071 becomes a drain region. (See FIG. 14C.)

A process of forming a silicon nitride film 5504 and a first interlayer insulating film 5072 is performed next. The silicon nitride film 5504 is formed first with a thickness of 50 nm. The silicon nitride film 5504 is formed by plasma CVD under the following conditions: $SiH_4$ introduced at 5 SCCM, $NH_3$ introduced at 40 SCCM, and $N_2$ introduced at 100 SCCM, a pressure of 0.7 Torr, and a high frequency electric power input of 300 W. The first interlayer insulating film 5072 is formed next. A single layer of an insulating film containing silicon may be used as the first interlayer insulating film 5072, and a lamination film in which such a film is incorporated may also be used. Further, the film thickness may be from 400 nm to 1.5 μm. A structure in which an 800 nm thick silicon oxide film is laminated on a silicon oxynitride film having a thickness of 200 nm is used in Embodiment 11 (not shown in the figures).

In addition, heat treatment is performed for 1 to 12 hours at 300 to 450° C. in an atmosphere containing hydrogen between 3 and 100%, performing a hydrogenation process. This process is one of hydrogen termination of dangling bonds in the semiconductor films by thermally activated hydrogen. Plasma hydrogenation (in which hydrogen activated by a plasma is used) may also be performed as another means of hydrogenation.

Note that the hydrogenation process may also be performed during formation of the first interlayer insulating film 5072. Namely, the above hydrogenation process may be performed after forming the 200 nm thick silicon oxynitride film, and then the remaining 800 nm thick silicon oxide film may be formed.

Contact holes are formed next in the first interlayer insulating film 5072, and source wirings 5073, 5075, 5076, and 5078, and drain wirings 5074, 5077, and 5079 are formed. Note that, although not shown in the figures, a three layer structure in which a 100 nm thick Ti film, a 300 nm thick Al film containing Ti, and a 150 nm thick Ti film formed in succession by sputtering is used in Embodiment 11. Other conducting films may also be used, of course.

Figure 15A:
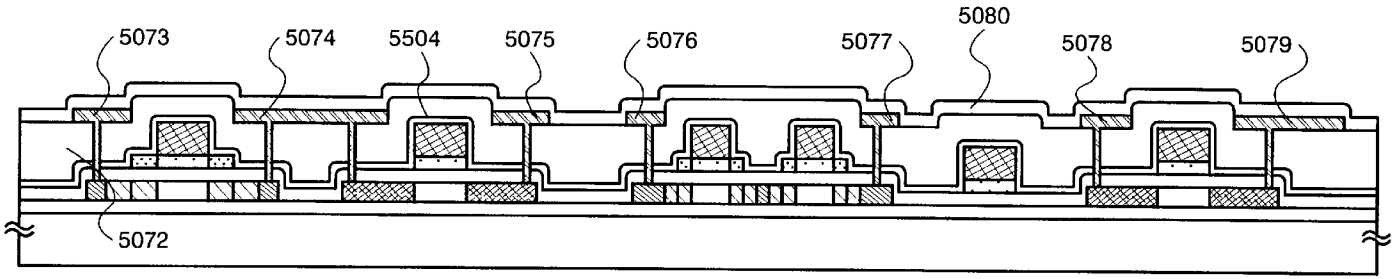
FIGS. 15A and 15B are diagrams showing the process of manufacturing the OLED display device shown in Embodiment 11.

A first passivation film 5080 is formed next with a thickness of 50 to 500 nm (typically between 200 and 300 nm). A 300 nm thick silicon oxynitride film is used as the first passivation film 5080 in Embodiment 11. A silicon nitride film may also be substituted. Note that it is effective to perform plasma processing using a gas containing hydrogen, such as $H_2$ or $NH_3$ as a preprocess before forming the silicon oxynitride film. Hydrogen excited by this preprocess is supplied to the first interlayer insulating film 5072, the film quality of the first passivation layer 5080 is improved by performing heat treatment. At the same time, the hydrogen added to the first interlayer insulating film 5072 is diffused to the lower layer side, and the active layers can be effectively hydrogenated. (See FIG. 15A.)

A second interlayer insulating film 5081 is formed next from an organic resin. A material such as polyiimide, polyamide, acrylic, and BCB (benzocyclobutene) can be used as the organic resin. In particular, the second interlayer insulating film 5081 has strong meaning in leveling, and it is preferable to use acrylic, which has superior levelness. An acrylic film is formed with a film thickness capable of sufficiently leveling the steps due to the TFTs in Embodiment 11. The film thickness may be set from 1 to 5 μm (preferably between 2 and 4 μm).

Figure 15B:
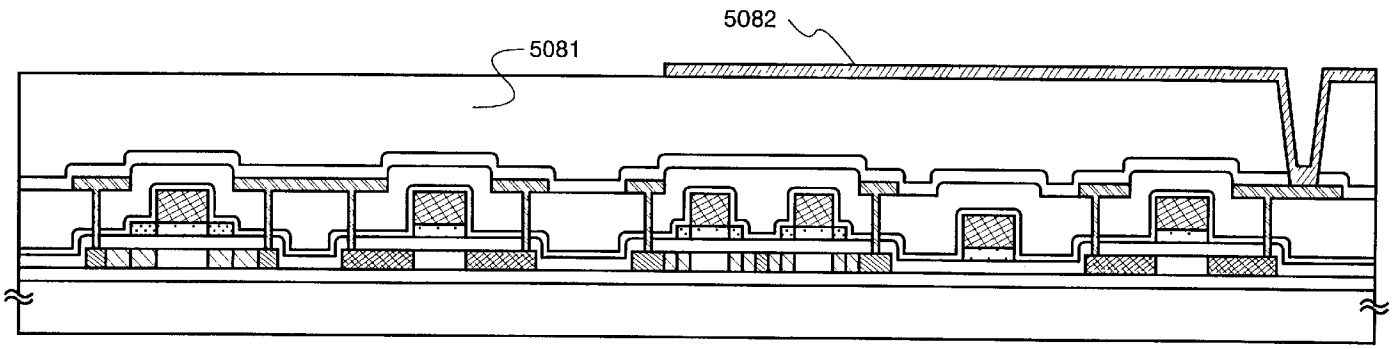

A contact hole for reaching the drain wiring 5079 is formed next in the second interlayer insulating film 5081 and the first passivation film 5080, and a pixel electrode 5082 is formed. A transparent conducting film composed of indium oxide, to which 10 to 20% by weight zinc oxide has been added, is formed with a thickness of 120 nm as the pixel electrode 5082 in Embodiment 11. (See FIG. 15B.)

Figure 16:
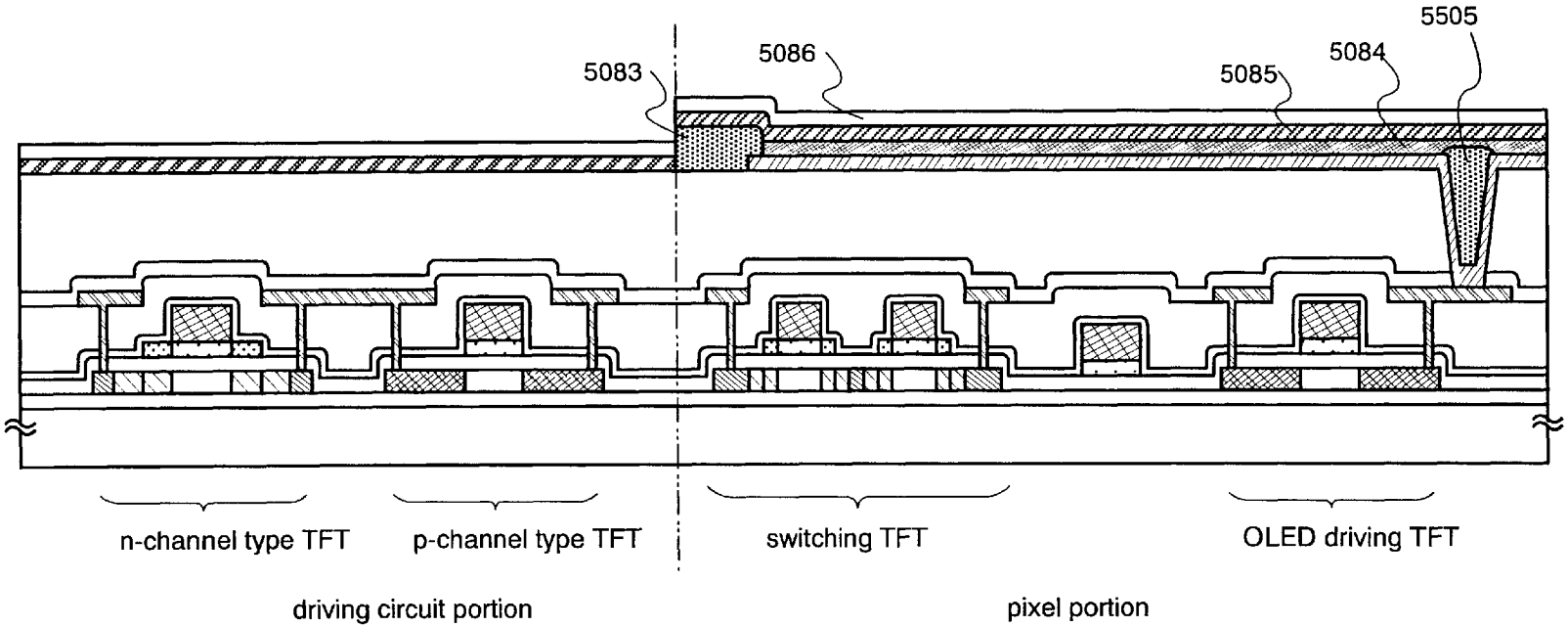
FIG. 16 is a diagram showing the process of manufacturing the OLED display device shown in Embodiment 11.

A bank 5083 and a tap 5505 are formed next from a resin material, as shown in FIG. 16. The bank 5083 may be formed by patterning an acrylic film or a polyimide film having a thickness of 1 to 2 μm. The bank 5083 is formed between pixels in a stripe shape. The bank 5083 is formed on and along the source wiring 5083, and it may be formed on and along the wiring 5501. Note that the bank may also be used as a shielding film by mixing a pigment into the resin material which forms the bank 5083.

An OLED layer 5084 and a cathode (MgAg electrode) 5085 are formed next in succession, without exposure to the atmosphere, using vacuum evaporation. Note that the film thickness of the OLED layer 5084 may be set from 80 to 200 nm (typically between 100 and 120 nm), and the thickness of the cathode 5085 may be set from 180 to 300 nm (typically 200 to 250 nm). Note also that while only one pixel is shown in the figures in Embodiment 11, an OLED layer which emits red color light, an OLED layer which emits green color light, and an OLED layer which emits blue color light are formed simultaneously at this point.

The OLED layer 5084 and the cathode 5085 are formed one after another with respect to pixels corresponding to the color red, pixels corresponding to the color green, and pixels corresponding to the color blue. However, the OLED layer 5084 is weak with respect to a solution, and therefore each of the colors must be formed separately without using a photolithography technique. It is preferable to cover areas outside of the desired pixels using a metal mask, and selectively form the OLED layer 5084 and the cathode 5085 only in the locations necessary.

In other words, a mask is first set so as to cover all pixels except for those corresponding to the color red, and the OLED layer for emitting red color light and the cathode are selectively formed using the mask. Next, a mask is set so as to cover all pixels except for those corresponding to the color green, and the OLED layer for emitting green color light and the cathode are selectively formed using the mask. Similarly, a mask is set so as to cover all pixels except for those corresponding to the color blue, and the OLED layer for emitting blue color light and the cathode are selectively formed using the mask. Note that the use of all different masks is stated here, but the same mask may also be reused. Further, it is preferable to process without releasing the vacuum until the OLED layers and the cathodes are formed for all of the pixels.

Note that the OLED layer 5084 is a single layer structure of a light emitting layer in Embodiment 11, but the OLED layer may also have, in addition to the light emitting layer, layers such as a hole transporting layer, a hole injecting layer, an electron transporting layer, and an electron injecting layer. Various examples of these types of combinations have already been reported upon, and all of the structure may be used. A known material can be used as the OLED layer 5084. Considering the OLED driver voltage, it is preferable to use a known material which is an organic material. Further, an example of using an MgAg electrode as the cathode of the OLED element is shown in Embodiment 11, but it is also possible to use other known materials.

Finally, a second passivation film 5086 is formed. An active matrix substrate having a structure as shown in FIG. 16 is thus completed. Note that it is effective to process from after forming the bank 5083 up through the formation of the second passivation film 5086 in succession, without exposure to the atmosphere, using a multi-chamber method (or an in-line method) thin film formation apparatus.

The active matrix substrate of Embodiment 11 may be applied not only to the pixel portion, but to TFTs having suitable structures which are arranged in the driver circuit portion. An extremely high reliability is thus shown, and the operating characteristics are also improved. It is also possible to add a metallic catalyst such as Ni in the crystallization step, thereby increasing crystallinity. It therefore becomes possible to set the driving frequency of the source signal line driver circuit to 10 MHZ or higher.

First, a TFT having a structure in which hot carrier injection is reduced without decreasing the operating speed is used as an n-channel TFT of a CMOS circuit forming the driver circuit portion. Note that the driver circuit referred to here includes circuits such as a shift register, a buffer, a level shifter, a latch in line-sequential drive, and a transmission gate in dot-sequential drive.

In Embodiment 11, the active layer of the n-channel TFT contains the source region 5053, the drain region 5054, the GOLD regions 5055*a* and 5056*a*, the LDD regions 5055*b* and 5056*b*, and the channel forming region 5052, as shown in FIGS. 14C and 16, and the GOLD regions 5055*a* and 5056*a* overlap with the gate electrode 5049 through the gate insulating film.

Further, there is not much need to worry about degradation due to hot carrier injection with the p-channel TFT of the CMOS circuit, and therefore LDD regions are not formed in particular. It is of course possible to form LDD regions similar to those of the n-channel TFT, as a measure against hot carriers.

In addition, when using a CMOS circuit in which electric current flows in both directions in the channel forming region, namely a CMOS circuit in which the roles of the source region and the drain region interchange, it is preferable LDD regions be formed on both sides of the channel forming region of the n-channel TFT forming the CMOS circuit, sandwiching the channel forming region. A circuit such as a transmission gate used in dot-sequential drive can be given as an example of such. Further, when a CMOS circuit in which it is necessary to suppress the value of the off current as much as possible is used, the n-channel TFT forming the CMOS circuit preferably has a structure in which a portion of the LDD region overlaps with the gate electrode through the gate insulating film. A circuit such as the transmission gate used in dot-sequential drive can be given as an example of such.

Note that, in practice, it is preferable to perform packaging (sealing), without exposure to the atmosphere, using a protecting film (such as a laminated film and an ultraviolet cured resin film) having good airtight characteristics and little outgassing, and a transparent sealing material, after completing through the state of FIG. 16. The reliability of the OLED element is increased when doing so by making an inert atmosphere on the inside of the sealing material and by arranging a drying agent (barium oxide, for example) inside the sealing material.

Furthermore, after the airtight properties have been increased in accordance with the packaging process, a connector (flexible printed circuit, FPC) is attached in order to connect terminals led from the elements and circuits formed on the substrate with external signal terminals. And a finished product is complete. This state at which the product is ready for delivery is referred to as an OLED display (or OLED module) throughout this specification.

Embodiment 12

A circuit structure for implementing a method of driving of the present invention is explained in Embodiment 12.

Figure 17A:
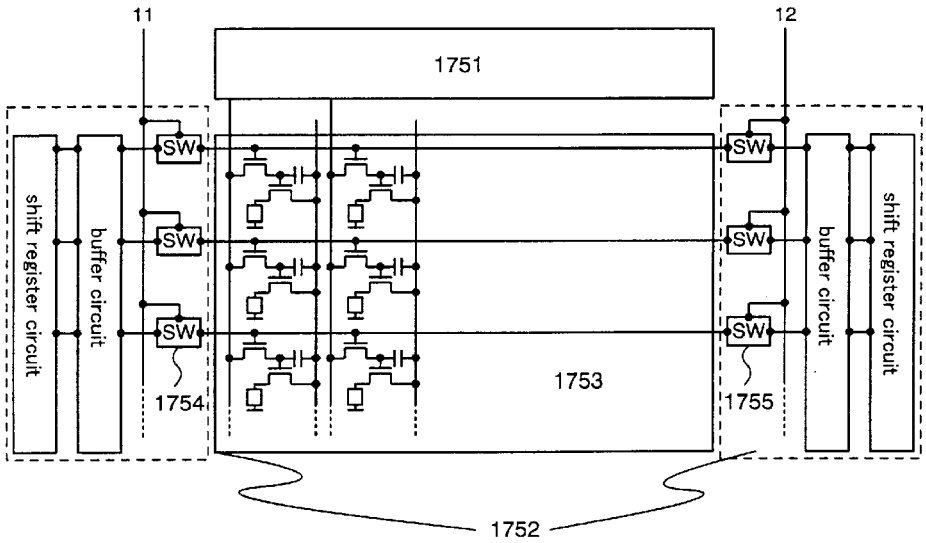
FIGS. 17A to 17C are diagrams showing examples of circuit structures of an OLED display device shown in Embodiment 12.
Figure 17B:
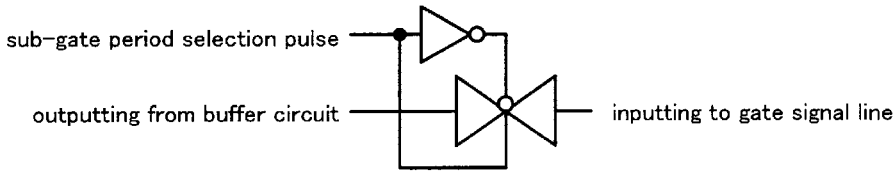
Figure 17C:
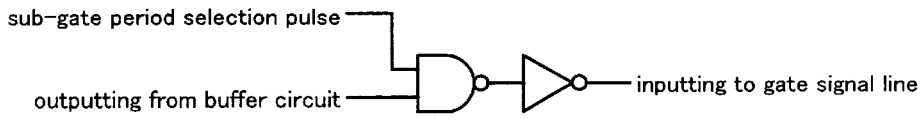

FIGS. 17A to 17C are referenced. FIG. 17A shows a circuit structure relating to a gate signal line driver circuit in order to perform multiple alternating selection of gate signal lines of the present invention. A case of dividing a gate signal line selection period into two sub-gate signal line selection periods is explained as an example in Embodiment 12 for simplification. Gate signal line driver circuits 1752 are arranged on both sides of a pixel portion 1753, and a switching circuits 1754 and 1755 are formed between the output of a buffer of each gate signal line driver circuit and the pixel portion 1753. Example structures of the switching circuits 1754 and 1755 are shown in FIGS. 17B and 17C.

Gate signal line selection timing switch-over signals are input to the switching circuits 1754 and 1755 through one or a plurality of signal lines. In FIG. 17A, this signal is input to the switching circuits within each gate signal line driver circuit by the pins 11 and 12, but the gate signal line selection timing switch-over signals input to one of the switching circuits may also be inverted using an inverter and input to the other switching circuit. The switching circuits 1754 and 1755 operate exclusively, and are controlled so that both do not open at the same time. By opening one switching circuit, the switching circuit 1754, during the first half sub-gate signal line selection period, and the other switching circuit, the switching circuit 1755, during the second half sub-gate signal line selection period, selection of the gate signal lines in the two sub-gate signal line selection periods is performed normally.

Figure 18B:
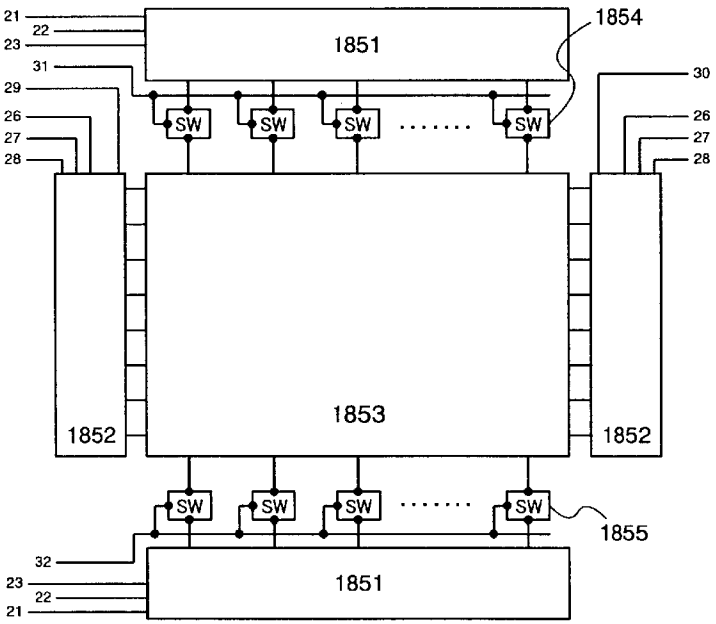
FIGS. 18A and 18B are diagrams showing examples of circuit structures of the OLED display device shown in Embodiment 12.
Figure 18A:
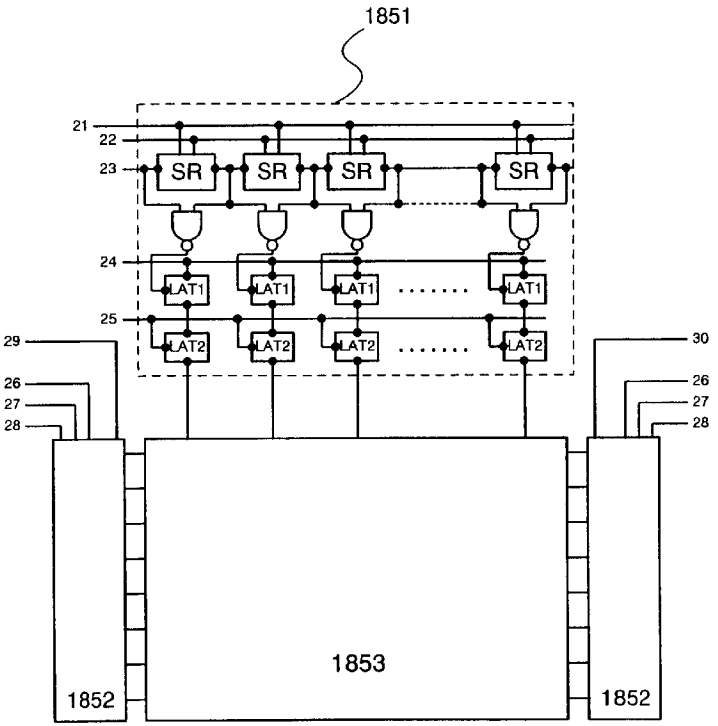

FIGS. 18A and 18B are referred to. FIGS. 18A and 18B show circuit structures related to a source signal line driver circuit used for a case of performing multiple alternating selection of gate signal lines of the present invention.

FIG. 18A is a diagram showing an example of using a source signal line driver circuit having a structure similar to a conventional structure. A clock signal is input through pins 21 and 22, and a start pulse is input through pin 23, in a shift register circuit SR, and pulses are output in sequence. These become first latch pulses. A digital image signal is input through pin 24 in a first latching circuit LAT1, and storage of the digital signal is performed in accordance with the first latch pulse timing. When a second latch pulse is then input within a horizontal return period through pin 25, the digital signal stored in the first latching circuit is transferred all at once to a second latching circuit LAT2, and the digital image signal is written into pixels in line-sequence. Write in to the pixels and turn on is then performed in the first half and second half of the next gate signal line selection period.

For a case of the gate signal line selection period having two sub-gate signal line selection periods at this point, in order to complete sampling and latching of the signal written in during the two sub-gate signal line selection periods of the first half and the second half of one gate signal line selection period on the source signal line side, it is necessary to multiply the operational clock frequency of the source signal line driver circuit by two. This is explained while referring to FIGS. 29 and 30.

Figure 29:
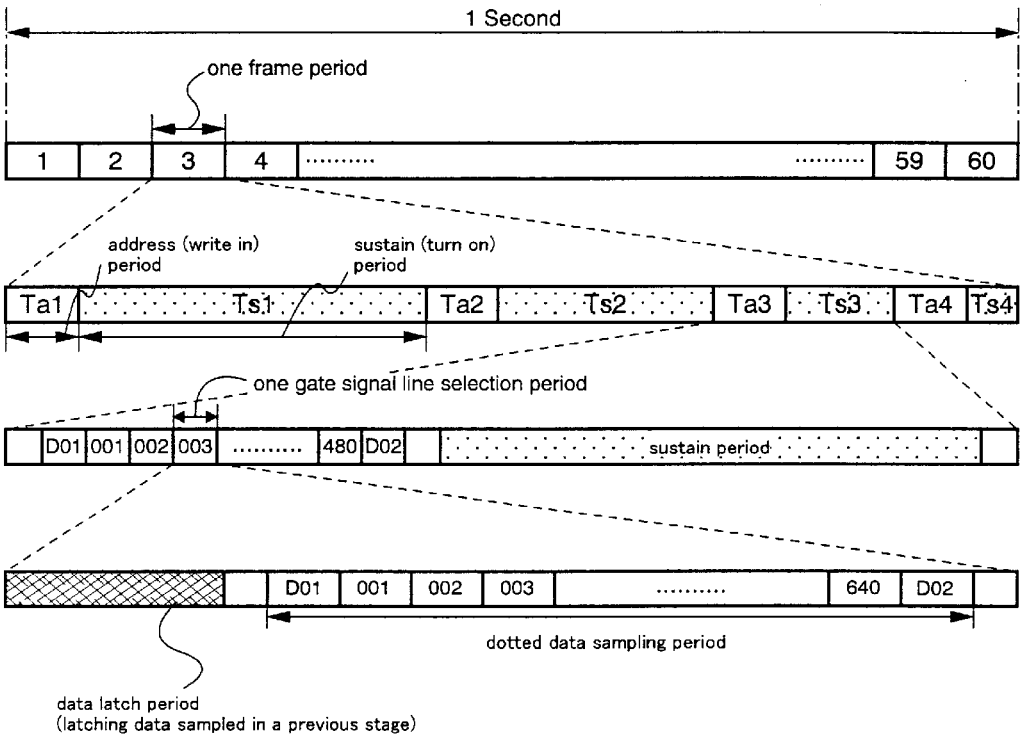
FIG. 29 is a diagram showing an example of a timing chart in a time gray scale display method.

FIG. 29 is a timing chart in a normal time gray scale method. This figure is for a case of a VGA, 4-bit gray scales and a frame frequency of 60 Hz (display of 60 frames within one second performed.)

A period in which one display region portion of the image is displayed is referred to as one frame. One frame period has a plurality of subframe periods, as shown in FIGS. 1 to 5B, and one subframe period has an address (write in) period ($Ta_n$, where n=1, 2, . . . ) and one sustain (turn on) period ($Ts_n$, where n=1, 2, . . . ). The number of subframe periods in one frame periods equals the number of bits of the gray scales displayed, and in order to express n-bit gray scales, the length of the sustain periods is set such that $Ts_1$: $Ts_2$: . . . :$Ts_n$=$2^{n-1}$:$2^{n-2}$: . . . :$2^1$:$2^0$, and brightness is controlled by the lengths of the turn on periods. In FIG. 29, there are 4-bit gray scales, and therefore $Ts_1$:$Ts_2$:$Ts_3$:$Ts_4$= $2^3$:$2^2$:$2^1$:$2^0$.

The address (write in) period has 482 stages (480 stages+2 dummy stages) of gate signal line selection periods (horizontal periods). One horizontal period portion of data is stored in the first latching circuit in a dot data sampling period of the first half of one gate signal line selection period. In a later line data latch period, one horizontal period portion of data is transferred all at once to the second latching circuit.

Figure 30:
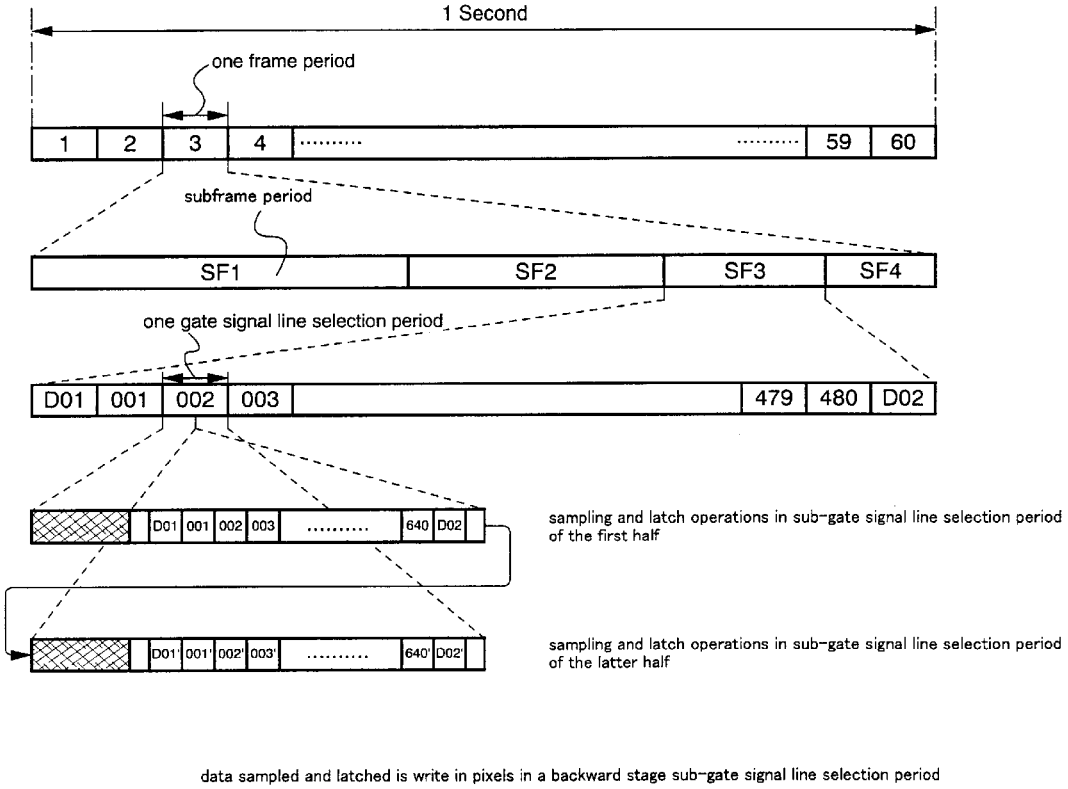
FIG. 30 is a diagram showing an example of a timing chart in a circuit structure of Embodiment 12.

FIG. 30 shows a timing chart for implementing a method of driving of the present invention using the circuits shown in FIGS. 17A and 18A. One frame period has a number of subframe periods equal to the number of display bits, similar to FIG. 29, but when using the method of driving of the present invention, one gate signal line selection period has a plurality (two in Embodiment 12) of sub-gate signal line selection periods. While write in is performed in a certain sub-gate signal line selection period, pixels in which write in was performed by the directly previous sub-gate signal line selection period are already turned on, and therefore the address (write in) period and the sustain (turn on) periods do not appear to be separate.

One gate signal line selection period (horizontal period) is divided into two sub-gate signal line selection periods in this example. One source signal line driver circuit therefore must complete sampling and latching of signals written in during each period within one horizontal period, the first half and the second half sub-gate signal line selection periods. In other words, as can be seen in FIG. 30, the dot data sampling period and the data latching period have lengths which are one-half those of the case of FIG. 29. It is therefore necessary to have a doubled clock frequency for driving the source signal line driver circuit when implementing the driving method of the present invention using the source signal line driver circuit shown by Embodiment 12.

FIG. 18B is an example of arranging two groups of source signal line driver circuits on both sides of a pixel matrix. The circuit explained in Embodiment 12 has switching circuits 1854 and 1855 between a second latching circuit and a pixel portion. The operation of a first latching circuit and the second latching circuit series is similar to that of FIG. 18A, and an explanation is omitted here, but one of the two source signal line driver circuits handles write in during the first half sub-gate signal line selection period, while the other source signal line driver circuit handles write in during the second half sub-gate signal line selection period. The circuit shown in FIG. 17A may be used for a gate signal line driver circuit 1852.

Latch output switch-over signals are input to the switching circuits 1854 and 1855 through one or a plurality of signal lines. In FIG. 18B, these signals are input to the switching circuits within each gate signal line driver circuit by the pins 31 and 32, but the gate signal line selection timing switch-over signals input to one of the switching circuits may also be inverted using an inverter and input to the other switching circuit. Namely, the switching circuits 1854 and 1855 operate exclusively, and are controlled so that both do not open at the same time. One switching circuit, the switching circuit 1854, is opened during the first half sub-gate signal line selection period, and the other switching circuit, the switching circuit 1855, is opened during the second half sub-gate signal line selection period. The order may also be performed in reverse. By using a circuit having this type of structure, write in of signals to the pixels in each of the two sub-gate signal line selection periods can be performed normally without increasing the driving frequency of the source signal line driver circuit. On the other hand, the driver circuits are placed on both sides of the pixel matrix, and therefore the area occupied by the entire device expands.

Figure 31:
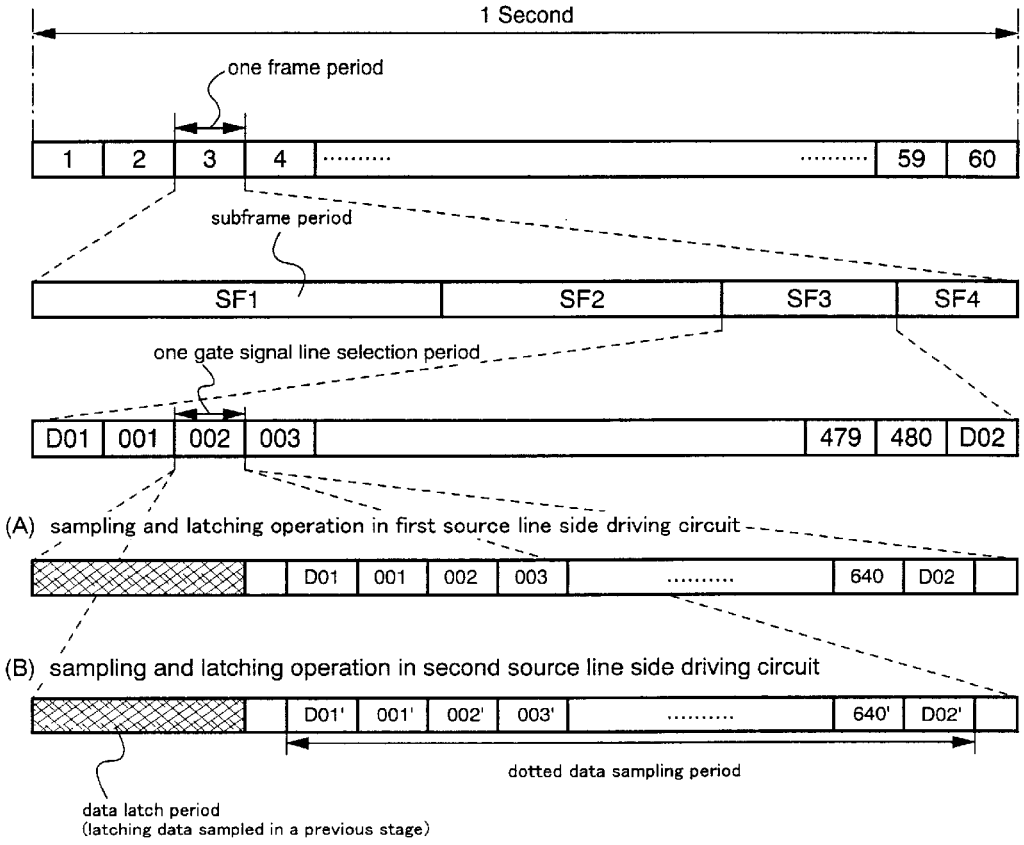
FIG. 31 is a diagram showing examples of timing charts in circuit structures of Embodiments 12 to 14.

FIG. 31 is referred to. FIG. 31 shows a timing chart for implementing the driving method of the present invention using the circuits shown in FIGS. 17A and 18B. One frame period has a number of subframe periods equal to the number of display bits, and in addition, the subframe periods have 482 stages (480 stages and 2 dummy stages) of gate signal line selection periods (horizontal periods), similar to FIG. 30.

One source signal line is driven by using a plurality (two in an example is shown in Embodiment 12) of source signal line driver circuits, as shown in FIG. 18B, and when a signal from any of the source signal line driver circuits is input to a source signal line by the switching circuit, write in to differing sub-gate signal line selection periods can be performed by parallel processing by apportioning to each of the source signal line driver circuits, differing from the circuit of FIG. 18A. Therefore, as shown in FIG. 31, the write in of the first half sub-gate signal line selection period and the second half sub-gate signal line selection period can each be performed by sampling and latching operations in parallel within one horizontal period by separate source signal line driver circuits. Consequently, it becomes possible to have processing which is equivalent to the circuit shown in FIG. 18A without increasing the operational clock frequency of the source signal line driver circuit.

Note that the switching circuit shown by Embodiment 12 may have any type of structure provided that it is one in which a conducting state and a non-conducting state can be set in accordance with a control signal input from the outside. As a simple example, a circuit similar to the switching circuit used by the gate signal line driver circuit (shown in FIGS. 17B and 17C) may be used.

Embodiment 13

An example of a structure of a source signal line driver circuit which differs from that of Embodiment 12 is explained in Embodiment 13. A case in which a gate signal line selection period is divided into two sub-gate signal line selection periods and driving is performed is explained in Embodiment 13 for simplicity.

Figure 19A:
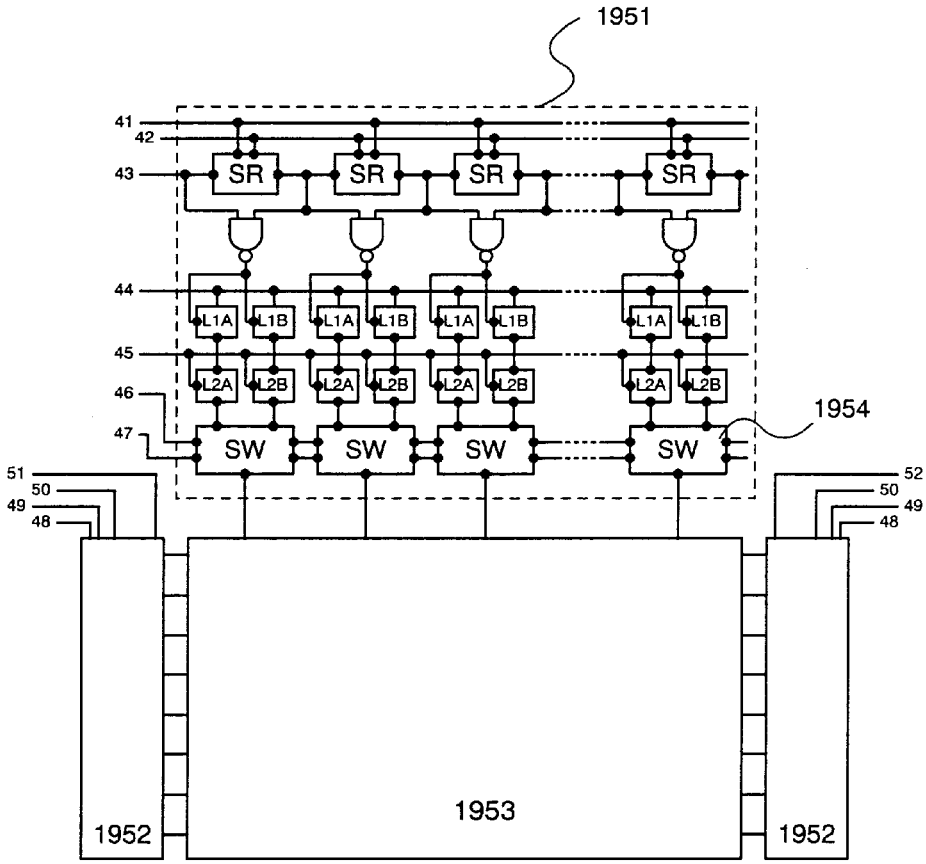
FIGS. 19A and 19B are diagrams showing examples of circuit structures of an OLED display device shown in Embodiment 13.
Figure 19B:
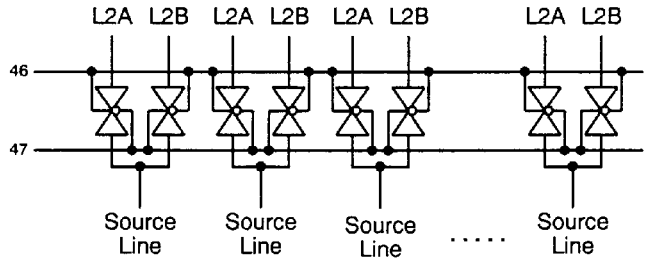

FIGS. 19A and 19B are referred to. FIGS. 19A and 19B show circuit structures for cases of arranging two groups of source signal line driver circuits on one side of a pixel matrix in accordance with sharing a shift register circuit. In FIG. 18B shown by Embodiment 12, if one circuit is taken a first source signal line driver circuit and the other circuit as a second source signal line driver circuit, then in FIG. 19A, a shift register circuit SR is shared, and a portion structured by the shift register circuit and by flowing from a first latching circuit (A) L1A to a second latching circuit (A) L2A and a switching circuit SW corresponds to the first source signal line driver circuit. A portion structured by the shift register circuit and by flowing from a first latching circuit (B) L1B to a second latching circuit (B) L2B and the switching circuit SW corresponds to the second source signal line driver circuit. The circuit shown by FIG. 17A may be used as a gate signal line driver circuit.

Circuit operation is explained. In the shift register circuit, a clock signal is input through pins 41 and 42, and a start pulse is input through pin 43, and pulses are output in order to the first latching circuits L1A and L1B. These become a first latch pulse. Digital signals 1 and 2 are input to the first latching circuits L1A and L1B through pin 44, and data is The first latch circuits L1A and L1B share the first latch pulse at this point, and therefore the first source signal line driver circuit and the second source signal line driver circuit operate simultaneously. A second latch pulse is input through pin 45 within a horizontal return period, and the data written into the first latching circuits L1A and L1B is transferred to the second latching circuits L2A and L2*b*, respectively, all at once. At this point, data which is written in during the first half sub-gate signal line selection period (denoted by data A) is output from L2A from the first source signal line driver circuit, while data which is written in during the second half sub-gate signal line selection period (denoted by data B) is output from L2B from the second source signal line driver circuit.

Then, in the next gate signal line selection period, a switching circuit 1945 placed between the second latching circuits and the pixel matrix selects one of the data A and the data B and outputs this to the pixel portion in accordance with a latching output switch-over signal input through one or a plurality of the signal lines, performing signal write in. By using this type of circuit, it becomes possible to have a smaller surface area circuit compared to the circuit example shown by FIG. 12.

It is also possible to perform sampling and latching of each of the signals written in during the two sub-gate signal line selection periods in parallel with the circuit shown in Embodiment 13. It therefore becomes possible to perform processing equivalent to that shown in FIG. 18A without increasing the operational clock frequency of the source signal line driver circuit.

Note that, with respect to the structure of the circuits shown in Embodiment 13, conventional circuits may be used as is for the shift register circuit and the latching circuit. In addition, any structure may be used for the switching circuit provided that one input can be selected from among a plurality of inputs (two inputs in Embodiment 13) and then output. Further, an example of the switching circuit 1954 in Embodiment 13 is shown in FIG. 19B. An example of two inputs and one output is shown here, but a circuit which is fundamentally similar may also be used for a case of three or more input by adding switches. Note that the circuit structure is not limited by this.

Embodiment 14

An example of a circuit structure differing the circuits shown by a portion of Embodiment 12 and by Embodiment 13 is explained in Embodiment 14. A case in which a gate signal line selection period is divided into two sub-gate signal line selection periods and driving is performed is explained in Embodiment 14 for simplicity.

Figure 20:
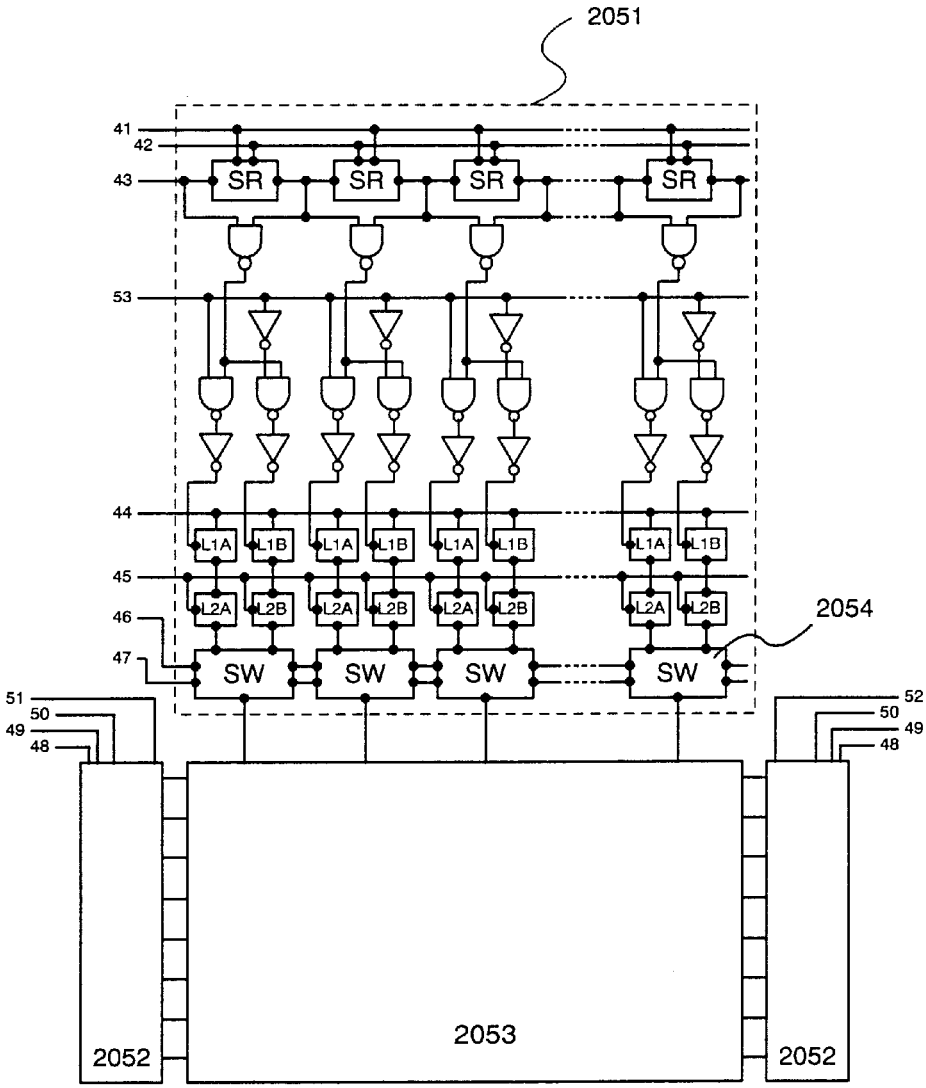
FIG. 20 is a diagram showing an example of a circuit structure of an OLED display device shown in Embodiment 14.
Figure 21A:
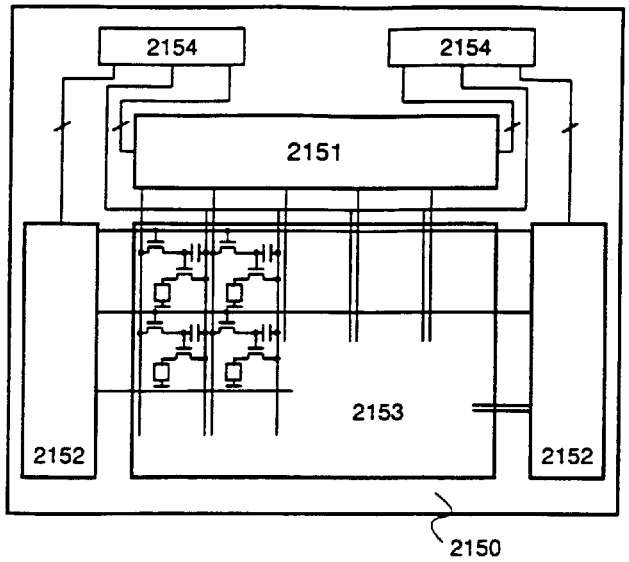
Fig. 21A (PRIOR ART)
FIGS. 21A and 21B are circuit diagrams of a pixel portion of an OLED display device.
Figure 21B:
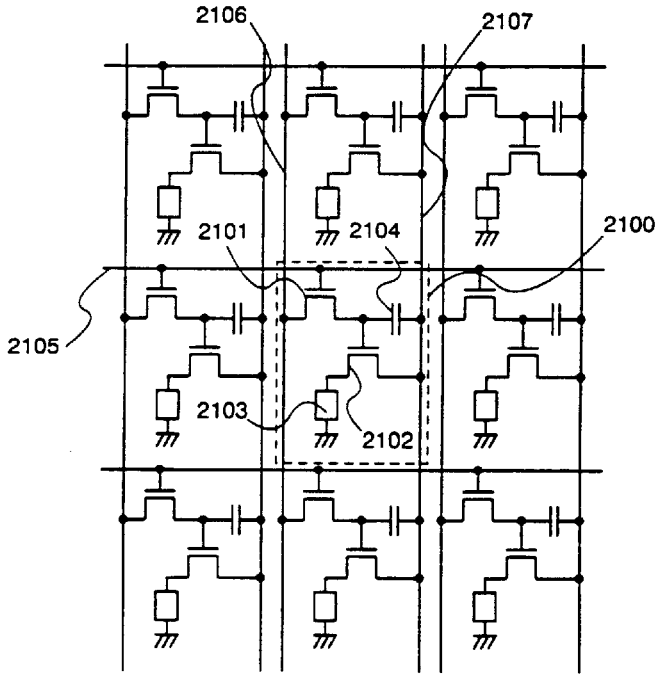
Fig. 21B (PRIOR ART)
Figure 22A:
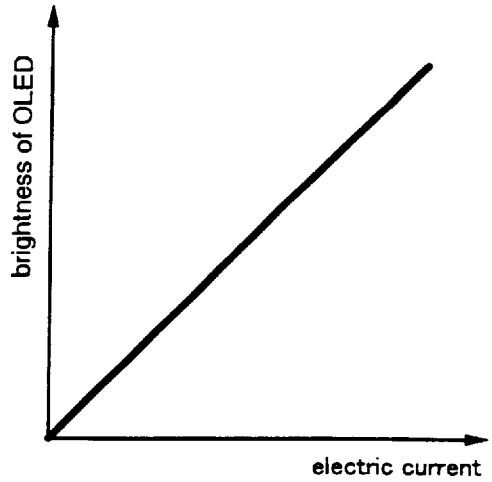
Fig. 22A (PRIOR ART)
FIGS. 22A to 22C are diagrams schematically showing the brightness characteristics and the electric voltage—electric current characteristics of an OLED element.
Figure 22B:
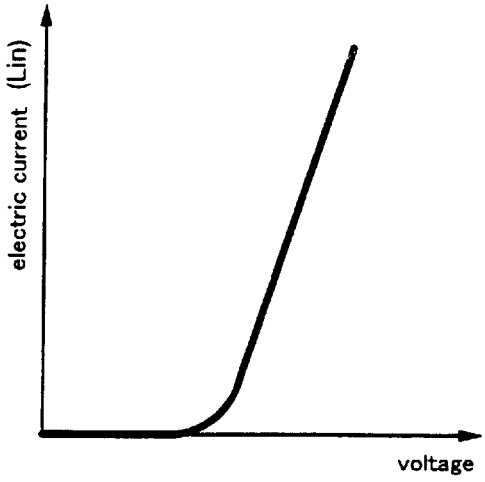
Fig. 22B (PRIOR ART)
Figure 22C:
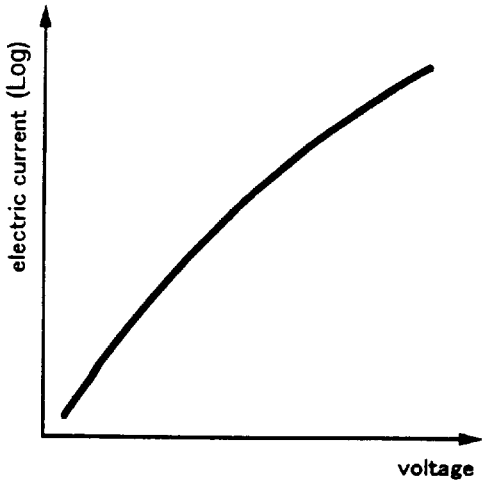
Fig. 22C (PRIOR ART)
Figure 23A:
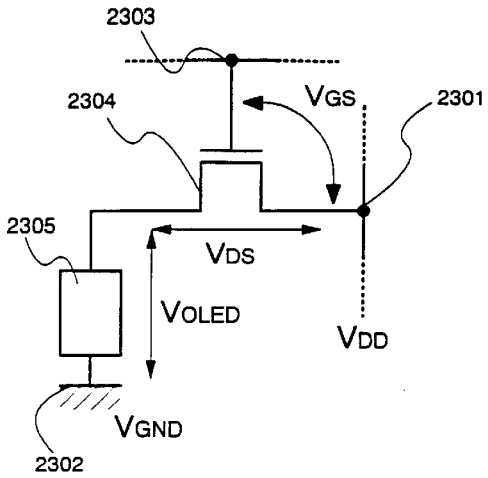
Fig. 23A (PRIOR ART)
FIGS. 23A and 23B are diagrams showing operation points of an OLED element.
Figure 23B:
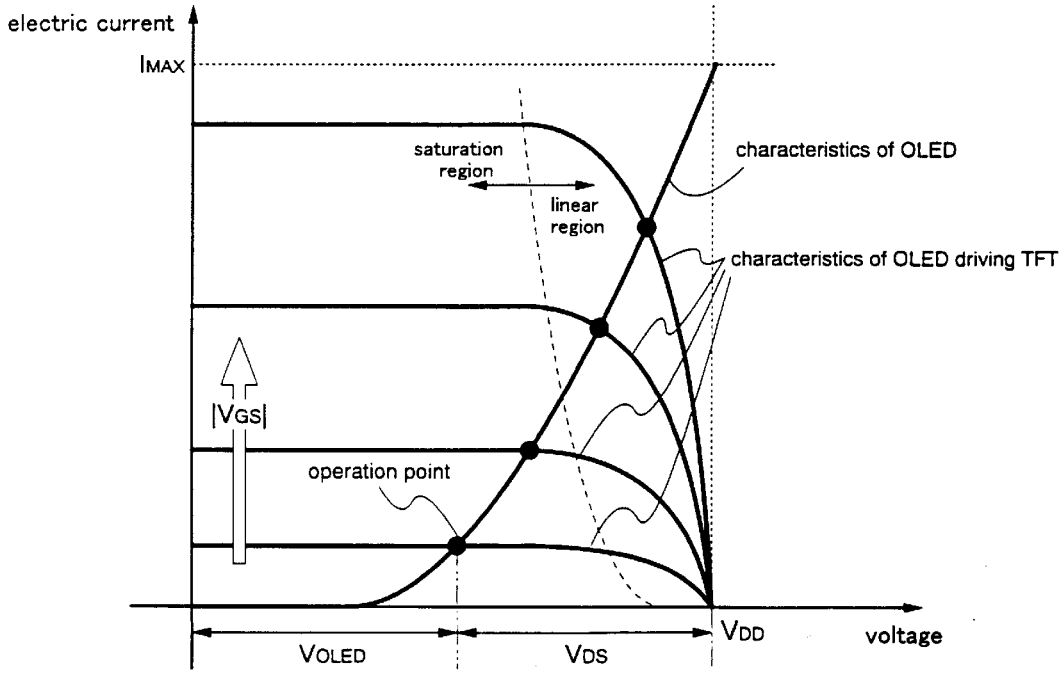
Fig. 23B (PRIOR ART)
Figure 24:
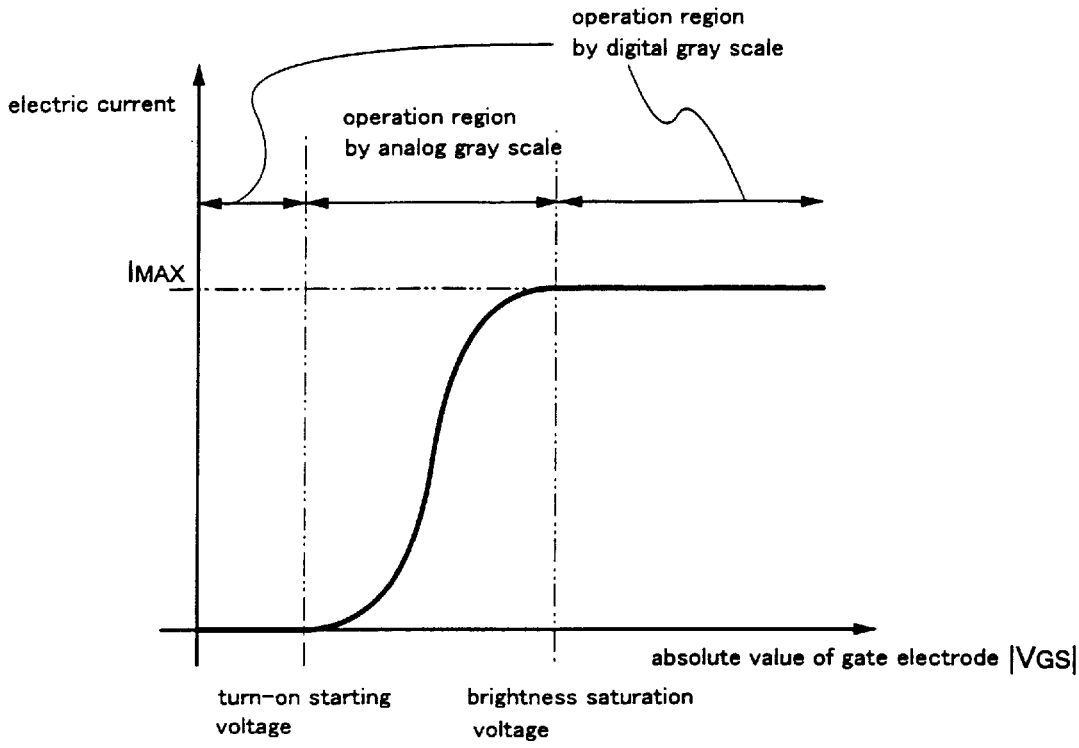
Fig. 24 (PRIOR ART)
FIG. 24 is a diagram showing operation regions of OLED elements in analog gray scale and digital gray scale.
Figure 25:
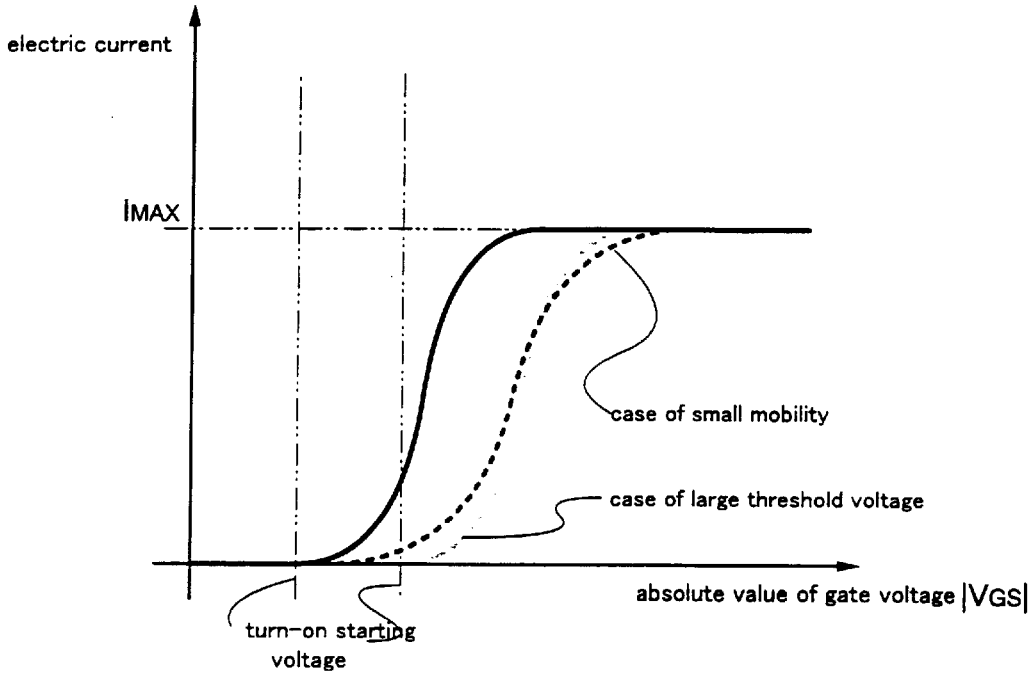
Fig. 25 (PRIOR ART)
FIG. 25 is a diagram showing the influence of threshold value and mobility of an OLED driver TFT on OLED switch on voltage.
Figure 26:
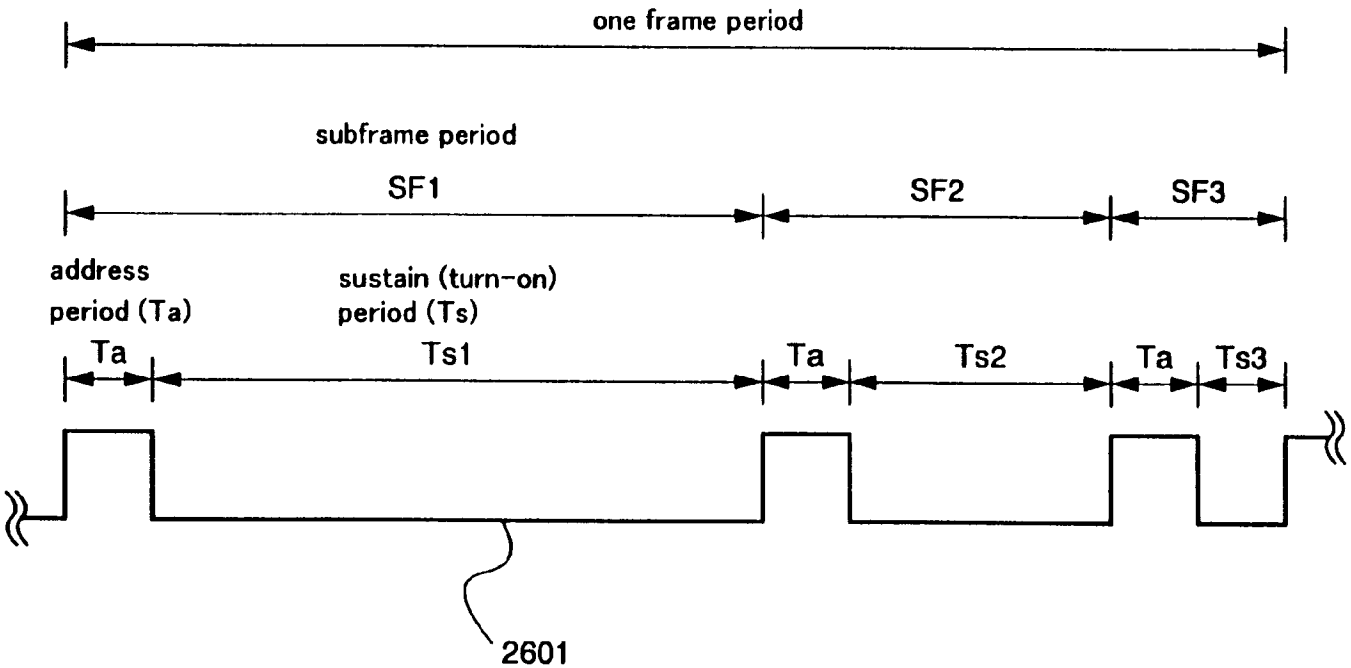
Fig. 26 (PRIOR ART)
FIG. 26 is a diagram showing an example of a dividing a frame period.

FIG. 20 is referred to. FIG. 20, similar to FIGS. 19A and 19B, shows examples of integrating source signal line driver circuits on one side in accordance with the sharing of a shift register circuit by two systems of latching circuits. The circuit shown by Embodiment 14 has characteristically a dual input type NAND circuit between a shift register circuit and a first latch circuit. The dual input type NAND circuit is expressed by a NAND-A connected to an output line of the first latching circuit L1A and a NAND-B connected to an output line of the first latching circuit L1B. A driver circuit shown by Embodiment 14 has a form similar to that of Embodiment 13 in which the two source signal line driver circuits are unified, sharing the shift register circuit. These are a first source signal line driver circuit and a second source signal line driver circuit, respectively. Furthermore, the circuit shown by FIG. 17A may be used as a gate signal line driver circuit, similar to Embodiment 13.

Circuit operation is explained. A clock signal (hereafter referred to as a first clock signal) is input to the shift register circuit through the pins 41 and 42, and a start pulse is input through the pin 43, and pulses are output in order. These pulses are input to one terminal of the two terminals of the NAND circuit. A signal having a frequency which is twice that of the first clock signal input to the shift register circuit (hereafter referred to as a second clock signal) is input to the remaining input terminal of the NAND-A, and a signal which is an inversion of the second clock signal is input to the remaining input terminal of the NAND-B. Pulses having a pulse width which is half that of the pulse output from the shift register circuit is thus input to the first latch circuits L1A and L1B. The pulse input to L1A at this point is a portion output at a timing of the first half of the pulse output from the shift register circuit. The pulse input to L1B is a portion output in the second half of the pulse output from the shift register circuit. Write in to the pixel portion is performed subsequently in accordance with the operational method explained by Embodiment 13.

In other words, in accordance with using the circuit shown by Embodiment 14, operation subsequent to the first latch circuit is achieved similar to that of the circuit shown by Embodiment 13, and the shift register operational clock can be suppressed by half of that of the circuit shown by Embodiment 13, and this is therefore effective in increasing circuit reliability. On the other hand, the number of elements within the driver circuit slightly increases.

A dot data sampling period and a line data latching period in the source signal line driver circuit can be performed at the same time for a case of normal time gray scale display with the circuit shown in Embodiment 14, and therefore it becomes possible to perform processing equivalent to the circuit shown in FIG. 18A without raising the operational clock frequency of the source signal line driver circuit. In addition, it is possible to additionally suppress the operational clock frequency in the shift register circuit portion by half compared to a case of normal time gray scale display.

Note that, regarding the structure of the circuits shown in Embodiment 14, conventional circuits may be used as is for the shift register circuit, the latching circuit, and the NAND circuit, and provided that one input from among a plurality of inputs (two inputs in Embodiment 14) can be selected and then output, any structure may be used for a switching circuit 2054. As a simple example, circuits similar to those used in Embodiment 13 and shown in FIG. 19B may be used. Further, an inverter may be used to invert the second clock signal and make the inverted second clock signal input to NAND-B in FIG. 20, or an inverted second clock signal may be input directly from outside.

Embodiment 15

Cases of problems caused by timing shifts, due to signal delays developing inside a circuit, which develop when using the driving method of the present invention in an actual electronic device are considered. The driving method is explained in Embodiment 15 while based on these problems.

Generally, design is performed while ensuring a margin so as to have a certain amount of permissible delay for cases in which timing shifts develop due to signal delays in the inside of a driver circuit. For example, assuming 1 frame period=1 horizontal period x number of gate signal lines+return period, even if a delay in a gate signal line selection pulse develops, that delay is absorbed by the return period, and there is no influence on the next frame period.

Figure 35A:
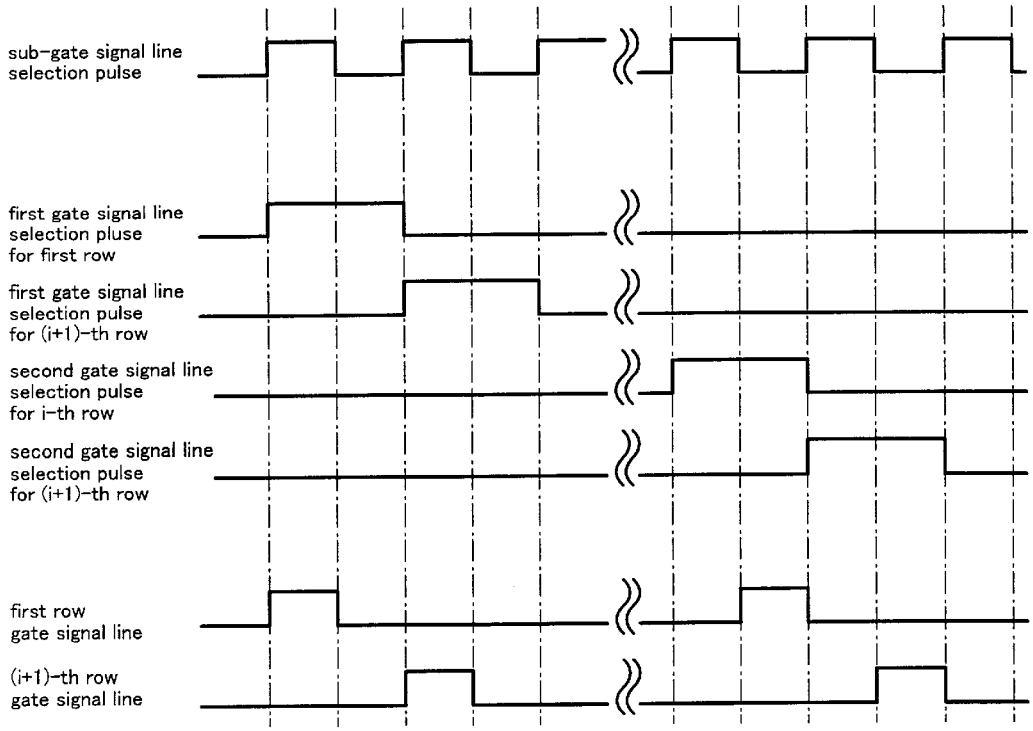
FIGS. 35A and 35B are diagrams showing a normal timing chart and a signal write in state, respectively, in accordance with a driving method of the present invention shown in Embodiment 15.
Figure 35B:
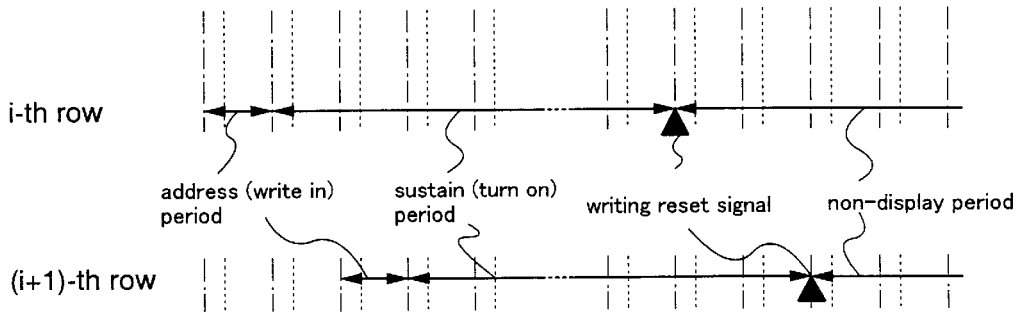

When one horizontal period is divided into two sub-gate signal line selection periods, for example, sub-gate period selection pulses are output with the present invention in FIG. 35. The output timing of the sub-gate period selection pulses must be such that the width of one gate signal line selection pulse fits into one period portion. This is shown in FIG. 35 as the sub-gate period selection pulses (normal). The respective pulse widths of a number i row first gate signal line selection pulse, a number i+1 row first gate signal line selection pulse, a number i row second gate signal line selection pulse, and a number i+1 row second gate signal line selection pulse can be seen to just fit into one period portion of the sub-gate period selection pulse (normal).

In the first half of the sub-gate signal line selection period, the number i row gate signal line is selected when the sub-gate period selection pulse is HI and the number i row first gate signal selection pulse is HI (selected state; this may also be LO in the selected state, depending upon the circuit architecture). In the second half of the sub-gate signal line selection period, the number i row gate signal line is selected when the sub-gate period selection pulse is LO and the number i row second gate signal line selection pulse is HI (selected state; this may also be LO in the selected state, depending upon the circuit architecture).

A case in which timing shifts develop in the sub-gate period selection pulse and in the gate signal line selection pulse is considered here. A case in which the sub-gate period selection pulse is late with respect to the gate signal line selection pulse, and conversely a case in which the gate signal line selection pulse is late with respect to the sub-gate period selection pulse can be considered. In order to clarify the explanation, the gate signal line selection pulse is taken as a standard, and cases in which the sub-gate period selection pulse is output late, and cases in which it is conversely output early, are considered relatively.

(1) A case in which the sub-gate period selection pulse is output late.

Figure 36A:
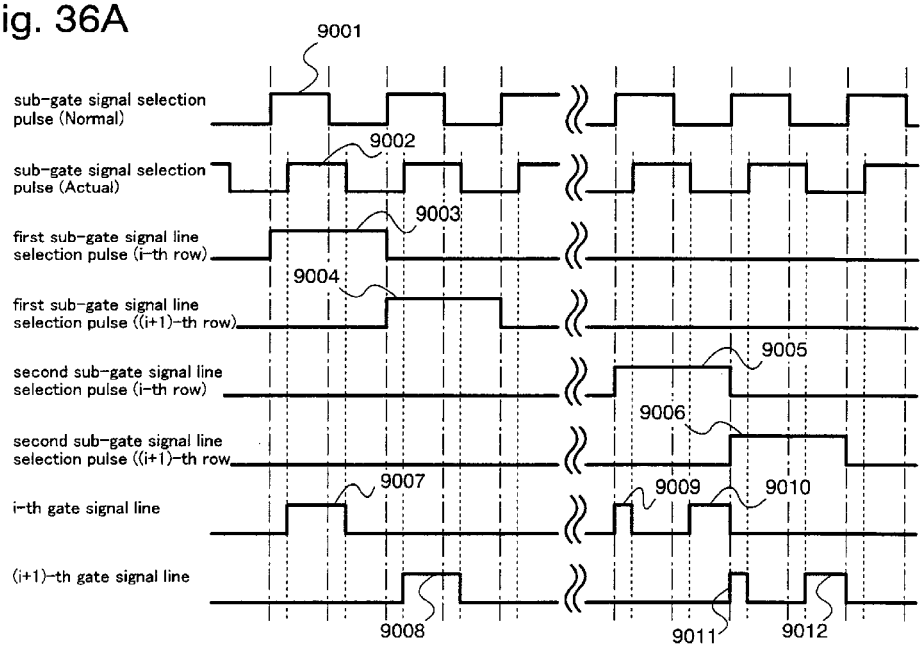
FIGS. 36A to 36C are diagrams showing a timing chart and a signal write in state, respectively, for a case accompanying a lag in accordance with a signal delay or the like in the method of driving of the present invention shown in Embodiment 15.

FIG. 36A is referred to. A case of a sub-gate period selection pulse output at a normal timing is denoted by reference numeral 9001, while a sub-gate period selection pulse which is output late is denoted by reference numeral 9002. Each of the gate signal lines in the figure is selected in the first half gate signal line selection period when the sub-gate period selection pulse is HI, and selected in the second half gate signal line selection period when the sub-gate period selection pulse is LO.

In the first half gate signal line selection period, a number i row first gate signal line selection pulse 9003 is output, and then the sub-gate period selection pulse 9002 becomes HI after a slight delay. The number i row gate signal line is therefore in a selected state during a period shown by a pulse 9007. On the other hand, in the second half gate signal line selection period, the sub-gate period selection pulse is delayed at the instant at which the number i row second gate signal line selection pulse is output, and therefore is not still HI. Consequently, the number i row gate signal line is in a selected state in a period shown by pulse 9009. The sub-gate period selection pulse becomes HI next, and after it becomes LO one again, the number i row gate signal line is in a selected state in a period until the number i row second gate signal line selection pulse becomes LO (unselected state), namely a period shown by pulse 9010. Regarding the number i+1 row gate signal line, selection is performed only in periods denoted by pulses 9008, 9011, and 9012.

The kinds of operations at this point for a case of performing signal write in during the first half and the second half of the sub-gate signal line selection period is considered. A case of write in of an image signal in one sub-gate signal line selection period, and write in of a reset signal in the remaining sub-gate signal line selection period, is considered as a specific example.

(1-1) A case of write in of an image signal in the first half, and write in of a reset signal in the second half.

A period in which the number i and the number i+1 row gate signal lines are in a selected state, in the first half sampling period, develops slight delays from the original timing, as shown by the reference numerals 9007 and 9008, but a large problem in order to write in the number i row image signal at this timing does not develop.

Figure 36B:
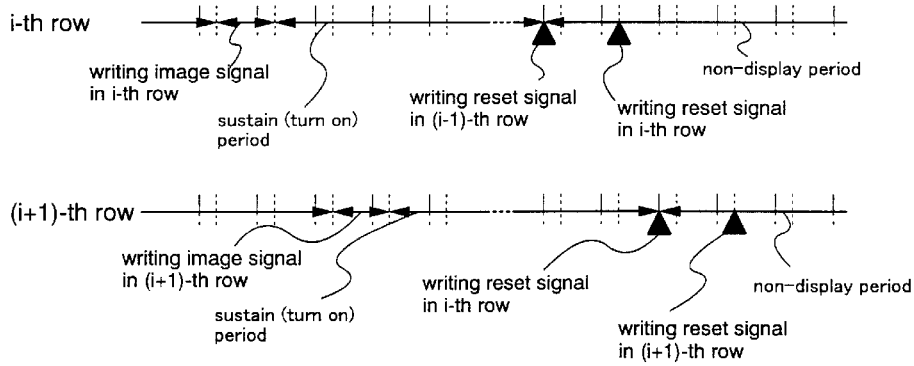

On the other hand, a period in which the number i row and the number i+1 row gate signal lines are each in a selected state in the second half sub-gate period separates into two periods within each gate signal line selection period, as shown by the reference numerals 9009, 9010, 9011, and 9012. In this case, a period in which the number i row gate signal line is selected at the timing shown by reference numeral 9009 is a period in which, originally, the number i−1 row gate signal line must be selected. Similarly, a period in which the number i+1 row gate signal line is selected at the timing shown by reference numeral 9011 is a period in which, originally, the number i row gate signal line must be selected. In other words, in the number i row, the reset signal written into the number i−1 row is written in at the timing shown by reference numeral 9009, and in the number i+1 row, the reset signal written into the number i row is written in at a the timing shown by reference numeral 9011. As a result, OLED elements turn off at a timing which is faster than the original timing by one horizontal period portion. There is a slight drop in gray-scales, but overall there is no gray-scale reversal which develops, and therefore this is not a large problem. Further, after write in of the reset signal of the previous row, the original reset signals are output by the number i row and the number i+1 row at the timings shown by reference numerals 9010 and 9012. However, the OLED elements are already extinguished, and therefore there is no change due to this operation. (See FIG. 36B.)

(1-2) A case of write in of the reset signal in the first half, and the image signal in the second half.

Similar to the above, when the gate signal line is selected in the first half sub-gate selection period, the selection period simply delayed, and a problem does not develop. After completing the correct length sustain period, the reset signal is written in, and the OLED element turns off.

Figure 36C:
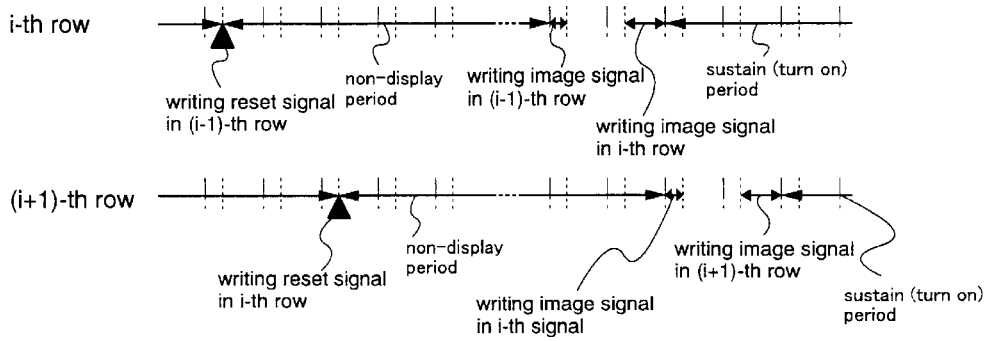

When the number i row and the number i+1 row gate signal lines are selected in the periods shown by reference numerals 9009 and 9011, the number i−1 row image signal is written in the number i row, and the number i row image signal is written in during the number i+1 row. Note that the gate signal lines are again placed in a selected state directly afterward at the timings shown by reference numerals 9010 and 9012, and that the correct image signal is written in during this period, and consequently the image signals of the respective rows are over written. This does not become a large problem. (See FIG. 36C.)

(2) a case in which the sub-gate period selection pulse is output early.

Figure 37A:
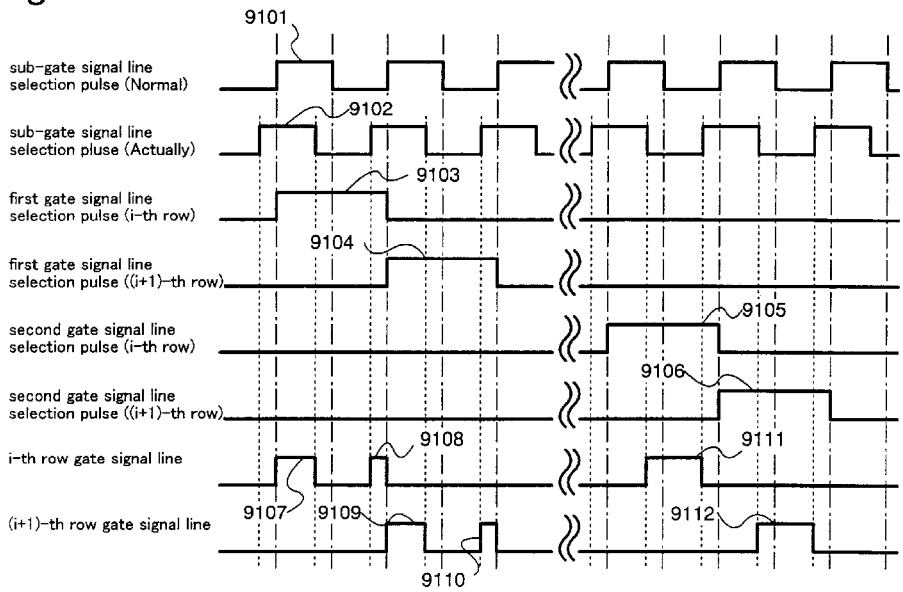
FIGS. 37A and 37B are diagrams showing a timing chart and a signal write in state, respectively, for a case accompanying a lag in accordance with a signal delay or the like in the method of driving of the present invention shown in Embodiment 15.

FIG. 37A is referred to. A case of a sub-gate period selection pulse output at a normal timing is denoted by reference numeral 9101, while a sub-gate period selection pulse which is output early is denoted by reference numeral 9102. Each of the gate signal lines in the figure are selected in the first half gate signal line selection period when the sub-gate period selection pulse is HI, and selected in the second half gate signal line selection period when the sub-gate period selection pulse is LO.

In the first half gate signal line selection period, at the instant a number i row first gate signal line selection pulse 9103 is output, the sub-gate period selection pulse is already HI (9102), and therefore the number i row gate signal line is immediately selected (9107). Next, the sub-gate period selection pulse becomes LO, and the number i row gate signal line returns to an unselected state, but the sub-gate period selection pulse once again becomes HI soon afterward, and therefore the number i row gate signal line again becomes selected (9108). On the other hand, in the second half gate signal line selection period, a number i row second gate signal line selection pulse output 9106 becomes HI, and is in a selected state in the period in which the sub-gate period selection pulse is LO (9111). For the number i+1 row gate signal line as well, selection is performed only in periods shown by pulses 9109, 9110, and 9112.

Similar to what is stated above, a case in which an image signal is written into one sub-gate signal line selection period, and a reset signal is written into the remaining sub-gate signal line selection period, is considered.

(2-1) A case if writing an image signal in the first half, and a reset signal in the second half.

Figure 37B:
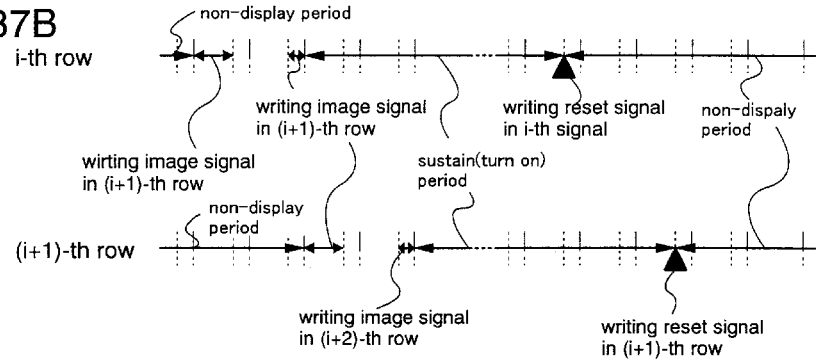

A period in which the number i row and the number i+1 row gate signal lines are in a selected state in the first half sub-gate period is divided into two periods within each gate signal line selection period, as shown by the reference numerals 9107, 9108, 9109, and 9110. In this case, the period in which the number i row gate signal line is selected at the timing shown by 9108 is a period in which the number i+1 gate signal line originally must be selected. Similarly, the period in which the number i+1 row gate signal line is selected at the timing shown by 9110 is a period in which a number i+2 row gate signal line must be selected originally. If the image signal is written in during the first half of the gate signal line selection period at this point, then write in of the image signal is performed by the period shown by 9107 to the number i row. However, directly afterward in the period shown by 9108, write in of the image signal which must be written in to the number i+1 row is performed, and in the subsequent sustain (turn on) period, the image of the number i+1 row is displayed in its written in state. Alternatively, the period shown by 9108 is short, and therefore the sustain period is entered while the image signal of the number i+1 row is in a state of not being fully written. In this case, normal turn on of the OLED elements cannot be done. A problem develops similarly for the number i+1 row in that, directly after the original image signal write in is complete, the next image signal is written, and therefore normal display is not possible. (See FIG. 37B.)

On the other hand, since the timing at which the gate signal line is in a selected state is a little early in the second half of the gate signal line selection period, the reset signal is written slightly early. Namely, each sustain (turn on) period becomes shorter by the timing shift of the output of the sub-gate period selection pulse and the gate signal line selection pulse, and this does not become a problem.

(2-2) A case in which the reset signal is written during the first half, and the image signal is written during the second half.

Figure 37C:
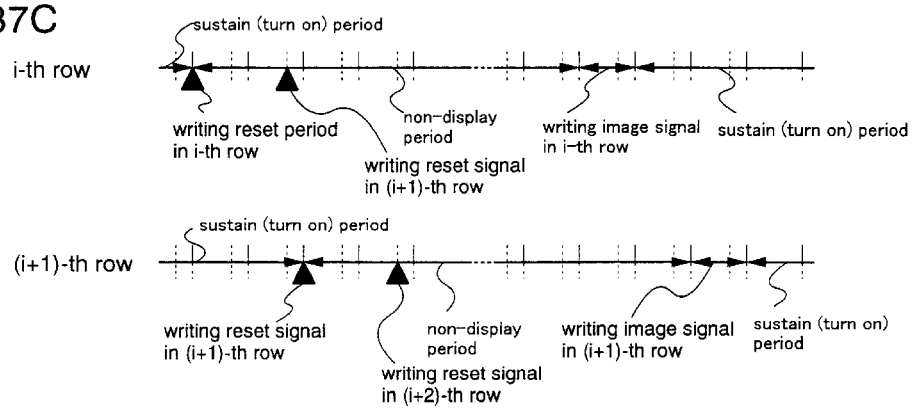

Consider a case in which reset signals are written in by portions shown by the reference numerals 9107, 9108, 9109, and 9110 with the selection periods of the gate signal lines. The reset signal is then written to the number i row and the number i+1 row at a normal timing and this becomes a non-display period, as shown in FIG. 37C. Directly afterward, at the timings shown by 9108 and 9110, the reset signal of the number i+1 row is written to the number i row, and the reset signal of the number i+2 row is written to the number i+1 row, but at that point each of the rows is already in a non-display period, and therefore there is no change, and this does not become a problem.

Thus, when a shift in the pulse output timing develops, whether or not this becomes a large problem depends upon which processes are being performed in the first half and the second half of the gate signal line selection periods. Considering all of the cases explained here, it is preferable to perform writing the reset signal in the first half of the gate signal line selection period is performed (the reset signal referred to here is a signal for forming a non-display period in each row after a sustain (turn on) in the prior subframe period), and to perform write in of the image signal in the second half of the gate signal line selection period.

The electronic device of the present invention and the method of driving the electronic device can be easily implemented. The implementation may be performed using any method shown in Embodiments 1 to 15, and it may be performed by combining a plurality of the embodiments.

[Embodiment 16]

An OLED display has superior visibility in bright locations in comparison to a liquid crystal display device because it is of a self-luminous type, and moreover viewing angle is wide. Accordingly, it can be used as a display portion for various electronic instruments. For example, it is appropriate to use the OLED display of the present invention as a display portion of an OLED display device (a display incorporating the OLED display in its casing) having a diagonal equal to 30 inches or greater (typically equal to 40 inches or greater) for appreciation of TV broadcasts by a large screen.

Note that all displays exhibiting (displaying) information such as a personal computer display, a TV broadcast reception display, or an advertisement display are included as the OLED display device. Further, the OLED display of the present invention can be used as a display portion of the other various electronic instruments.

The following can be given as examples of such electronic instruments: a video camera; a digital camera; a goggle type display (head mounted display); a car navigation system; an audio reproducing device (such as a car audio system, an audio compo system); a notebook personal computer; a game equipment; a portable information terminal (such as a mobile computer, a mobile telephone, a mobile game equipment or an electronic book); and an image playback device provided with a recording medium (specifically, a device which performs playback of a recording medium and is provided with a display which can display those images, such as a digital video disk (DVD)). In particular, because portable information terminals are often viewed from a diagonal direction, the wideness of the field of vision is regarded as very important. Thus, it is preferable that the OLED display device is employed. Examples of these electronic instruments are shown in FIGS. 32 and 33.

Figure 32A:
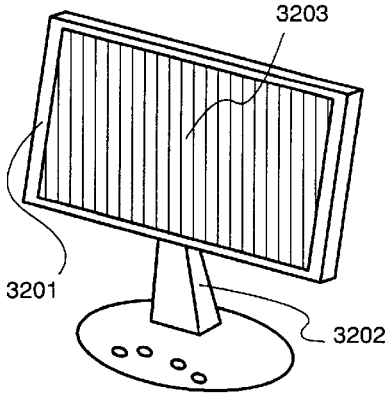
FIGS. 32A to 32F are diagrams showing examples of electronic equipment using OLED display devices which incorporate an electronic device of the present invention.

FIG. 32A illustrates an OLED display which includes a frame 3201, a support table 3202, a display portion 3203, or the like. The present invention can be used as the display portion 3203. The OLED display device is of a self-luminous type and therefore requires no back light. Thus, the display portion thereof can have a thickness thinner than that of the liquid crystal display device.

Figure 32B:
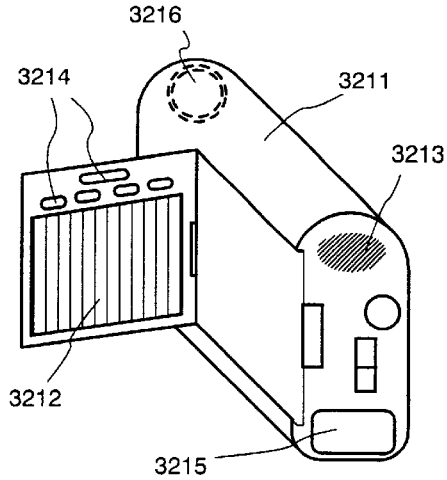

FIG. 32B illustrates a video camera which includes a main body 3211, a display portion 3212, an audio input portion 3213, operation switches 3214, a battery 3215, an image receiving portion 3216, or the like. The OLED display in accordance with the present invention can be used as the display portion 3212.

Figure 32C:
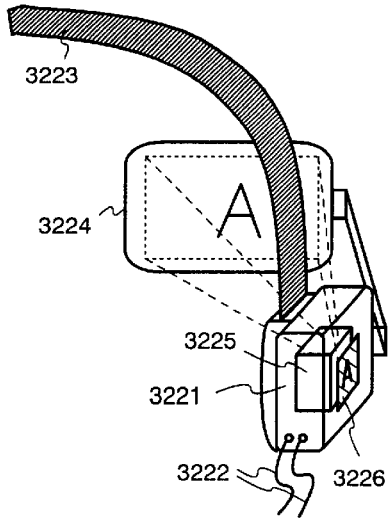

FIG. 32C illustrates a portion (the right-half piece) of an OLED display of head-mounted type which includes a main body 3221, signal cables 3222, a head mount band 3223, a display portion 3224, an optical system 3225, an OLED display 3226, or the like. The present invention can be used as the OLED display 3226.

Figure 32D:
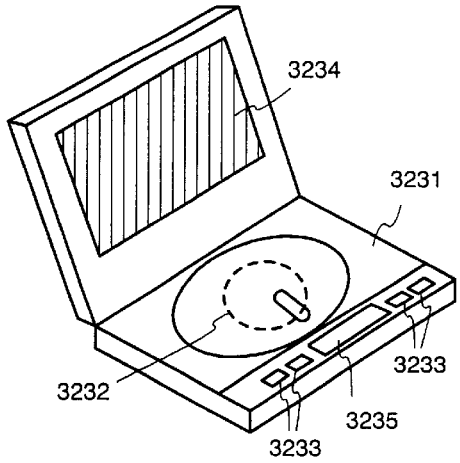

FIG. 32D illustrates an image reproduction apparatus which includes a recording medium (more specifically, a DVD reproduction apparatus), which includes a main body 3231, a recording medium (a DVD or the like) 3232, operation switches 3233, a display portion (a) 3234, another display portion (b) 3235, or the like. The display portion (a) 3234 is used mainly for displaying image information, while the display portion (b) 3235 is used mainly for displaying character information. The OLED display in accordance with the present invention can be used as these display portions (a) 3234 and (b) 3235. The image reproduction apparatus including a recording medium further includes a domestic game equipment or the like.

Figure 32E:
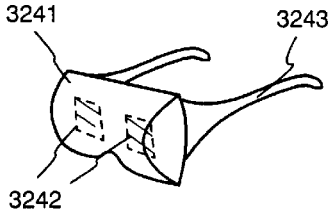

FIG. 32E illustrates a goggle type display (head-mounted display) which includes a main body 3241, a display portion 3242, an arm portion 3243. The OLED display in accordance with the present invention can be used as the display portion 3242.

Figure 32F:
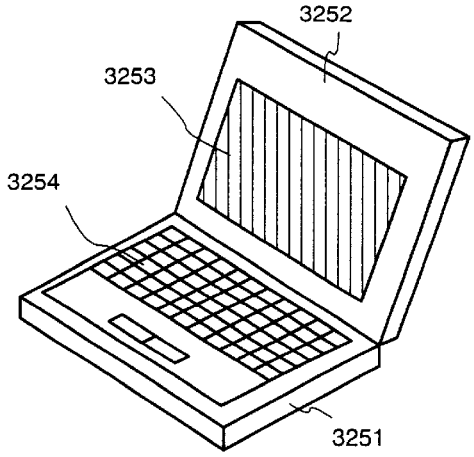

FIG. 32F illustrates a personal computer which includes a main body 3251, a frame 3252, a display portion 3253, a key board 3254, or the like. The light-emitting device in accordance with the present invention can be used as the display portion 3253.

Note that if emission luminance of an OLED material becomes higher in the future, it will be applicable to a front-type or rear-type projector in which light including output image information is enlarged by means of lenses or the like to be projected.

The above mentioned electronic instruments are more likely to be used for display information distributed through a telecommunication path such as Internet, a CATV (cable television system), and in particular likely to display moving picture information. The OLED display is suitable for displaying moving pictures since the OLED material can exhibit high response speed.

Further, since a light emitting portion of the OLED display consumes power, it is desirable to display information in such a manner that the light emitting portion therein becomes as small as possible. Accordingly, when the OLED display is applied to a display portion which mainly displays character information, e.g., a display portion of a portable information terminal, and more particular, a portable telephone or an audio reproducing device, it is desirable to drive the OLED display so that the character information is formed by a light-emitting portion while a non-emission portion corresponds to the background.

Figure 33A:
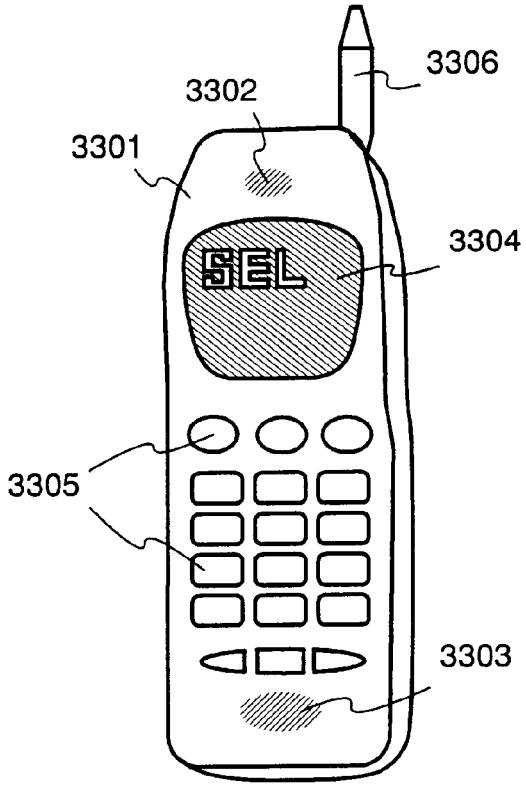
FIGS. 33A and 33B are diagrams showing examples of electronic equipment using OLED display devices which incorporate an electronic device of the present invention.

FIG. 33A illustrates a portable telephone which includes a main body 3301, an audio output portion 3302, an audio input portion 3303, a display portion 3304, operation switches 3305, and an antenna 3306. The OLED display in accordance with the present invention can be used as the display portion 3304. Note that the display portion 3304 can reduce power consumption of the portable telephone by displaying white-colored characters on a black-colored background.

Figure 33B:
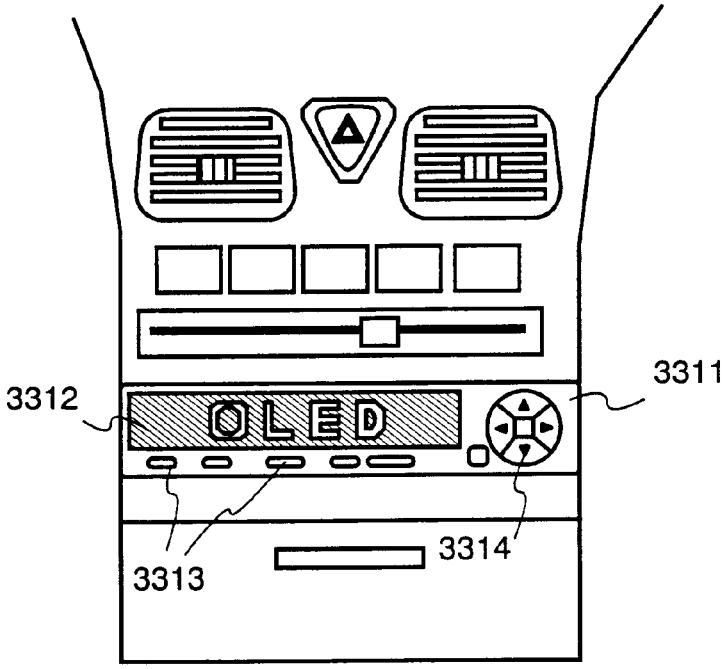

Further, FIG. 33B illustrates a sound reproduction device, specifically, a car audio equipment, which includes a main body 3311, a display portion 3312, and operation switches 3313 and 3314. The OLED display in accordance with the present invention can be used as the display portion 3312. Although the car audio equipment of the mount type is shown in the present embodiment, the present invention is also applicable to a portable type or domestic sound reproducing device. The display portion 3312 can reduce power consumption by displaying white-colored characters on a black-colored background, which is particularly advantageous for the portable type sound reproduction device.

As set forth above, the present invention can be applied variously to a wide range of electronic instruments in all fields. The electronic instruments in the present embodiment may use an OLED display having any one of configurations shown in Embodiments 1 to 14.

The effect of the present invention is explained. With the method of driving of the present invention, a signal can be written to pixels of a plurality of stages within one gate signal line selection period by dividing the gate signal line selection period into a plurality of sub-gate signal line selection periods. With the pixels of a certain stage, the time from when a signal is input until the input of the next signal can thus be arbitrarily set to a certain extent provided that the write in time to the pixels is secured. Therefore, without separating address (write in) periods and sustain (turn on) periods as in a conventional method of driving, the sustain period can be arbitrarily set, and the duty ratio can be increased up to a maximum of 100%. Problems which develop due to a small duty ratio can therefore be avoided.

Further, OLED elements can be turned on even within the address (write in) period. Therefore, compression of the sustain (turn on) periods can be avoided even in cases in which the address (write in) periods becomes long. In other words, even for a case of slow circuit operation, sufficient sustain (turn on) periods can be maintained. As a result, the operational frequency of the driver circuit can be reduced, and the electric power consumption can be made smaller.

Furthermore, in a certain subframe period, before the write in to the previous state of pixels is complete, write in to the pixels can begin again, and therefore cases in which the pixel signal storage performance is low do not become problems as a result, the size of the switching TFTs and the storage capacitors can be designed smaller.

The pixel structure may be the same as a conventional structure, and therefore the number of components such as TFTs, capacitors, and wirings is few as a result, the aperture ratio of the pixel portion can be increased.

What is claimed is:

1. A method of driving an electronic device having n-bit grey scale comprising a step of:

controlling a length of a turn on period of each of self light emitting elements, wherein:

one frame period is divided into n subframe periods $SF_1, SF_2, \ldots, SF_n$;

said n subframe periods have address periods $Ta_1, Ta_2, \ldots, Ta_n$, and sustain periods $Ts_1, Ts_2, \ldots, Ts_n$, respectively;

each of said n subframe periods includes a plurality of gate signal line selection periods;

each of said plurality of gate signal line selection periods has first and second sub-gate signal line selection periods; and a first gate signal line is selected within said first sub-gate signal line selection period, and a second gate signal line is selected within said second sub-gate signal line selection period.

2. The method of driving an electronic device according to claim 1, wherein said electronic device is a device selected from the group consisting of an OLED display, a video camera, head mounted display a DVD player, a personal computer, a portable telephone and a car audio.

3. A method of driving an electronic device having n-bit grey scale comprising a step of:

controlling a length of a turn on period of each of self light emitting elements, wherein:

one frame period is divided into n subframe periods $SF_1, SF_2, \ldots, SF_n$;

said n subframe periods have address periods $Ta_1, Ta_2, \ldots, Ta_n$ and sustain periods $Ts_1, Ts_2, \ldots, Ts_n$, respectively;

there are a plurality of gate signal line selection periods within each of said n subframe periods, each of said plurality of gate signal line selection periods has m sub-gate signal line selection periods, and m is an integer which is greater than or equal to 2;

at most one gate signal line is selected within each of said m sub-gate signal line selection periods; and at most (m×n)-th times of vertical scanning are performed in said one frame period.

4. The method of driving an electronic device according to claim 3, wherein said electronic device is a device selected from the group consisting of: an OLED display, a video camera, head mounted display a DVD player, a personal computer, a portable telephone and a car audio.

5. A method of driving an electronic device having n-bit grey scale comprising a step of:

controlling a length of a turn on period of each of self light emitting elements, wherein:

one frame period is divided into n subframe periods $SF_1, SF_2, \ldots, SF_n$;

said n subframe periods have address periods $Ta_1, Ta_2, \ldots, Ta_n$ and sustain periods $Ts_1, Ts_2, \ldots, Ts_n$, respectively;

there are a plurality of gate signal line selection periods within each of said n subframe periods, each of said plurality of gate signal line selection periods has m sub-gate signal line selection periods, and m is an integer which is greater than or equal to 2;

at most one gate signal line is selected within each of said m sub-gate signal line selection periods; and at most m gate signal lines are selected within each of said plurality of gate signal line selection periods.

6. The method of driving an electronic device according to claim 5, wherein said electronic device is a device selected from the group consisting of: an OLED display, a video camera, head mounted display a DVD player, a personal computer, a portable telephone and a car audio.

7. A method of driving an electronic device having n-bit grey scale comprising a step of:

controlling a length of a turn on period of each of self light emitting elements, wherein:

one frame period is divided into n subframe periods $SF_1, SF_2, \ldots, SF_n$;

said n subframe periods have address periods $Ta_1, Ta_2, \ldots, Ta_n$ and sustain periods $Ts_1, Ts_2, \ldots, Ts$, respectively;

there are a plurality of gate signal line selection periods within each of said n subframe periods, each of said plurality of gate signal line selection periods has m sub-gate signal line selection periods, and m is an integer which is greater than or equal to 2, at most one gate signal line is selected within each of said m sub-gate signal line selection periods;

at most m gate signal lines are selected within each of said plurality of gate signal line selection periods;

reset signal is inputted within such a period that an address period within one of said n subframe periods and an address period within another one of said n subframe periods overlap; and said self light emitting elements are in turn off state within such a period that said reset signal is inputted.

8. The method of driving an electronic device according to claim 7, wherein said electronic device is a device selected from the group consisting of: an OLED display, a video camera, head mounted display a DVD player, a personal computer, a portable telephone and a car audio.

9. An electronic device comprising: a source signal line driver circuit; a gate signal line driver circuit; and a pixel portion having a plurality of self light emitting elements arranged in a matrix shape; wherein:

n-bit grey scale control for controlling the length of a turn on period of the self light emitting elements is performed;

one frame period has n subframe periods $SF_1, SF_2, SF_n$;

the n subframe periods $SF_1, SF_2, \ldots, SF_n$ have: address (write in) periods $Ta_1, Ta_2, \ldots, Ta_n$, respectively; and sustain (turn on) periods $Ts_1, Ts_2, \ldots, Ts_n$, respectively;

each of said n subframe periods includes a plurality of gate signal line selection periods;

each of said plurality of gate signal line selection periods has first and second sub-gate signal line selection periods; and a first gate signal line is selected within said first sub-gate signal line selection period, and a second gate signal line is selected within said second sub-gate signal line selection period.

10. An electronic device according to claim 9, wherein said electronic device is a device selected from the group consisting of: an OLED display, a video camera, head mounted display a DVD player, a personal computer, a portable telephone and a car audio.

11. An electronic device comprising: a source signal line driver circuit; a gate signal line driver circuit; and a pixel portion having a plurality of self light emitting elements arranged in a matrix shape; wherein:

n-bit grey scale control for controlling the length of a turn on period of the self light emitting elements is performed;

one frame period has n subframe periods $SF_1, SF_2, \ldots, SF_n$;

the n subframe periods $SF_1, SF_2, \ldots, SF_n$ have: address (write in) periods $Ta_1, Ta_2, \ldots, Ta_n$, respectively; and sustain (turn on) periods $Ts_1, Ts_2, \ldots, Ts_n$, respectively; and there are a plurality of gate signal line selection periods within each of said n subframe periods, each of said plurality of gate signal line selection periods has m sub-gate signal line selection periods, and m is an integer which is greater than or equal to 2;

at most one gate signal line is selected within each of said m sub-gate signal line selection periods; and at most (m×n)-th times of vertical scanning are performed in said one frame period.

12. An electronic device according to claim 11, wherein said electronic device is a device selected from the group consisting of: an OLED display, a video camera, head mounted display a DVD player, a personal computer, a portable telephone and a car audio.

13. An electronic device comprising: a source signal line driver circuit; a gate signal line driver circuit; and a pixel portion having a plurality of self light emitting elements arranged in a matrix shape; wherein:

one frame period has n subframe periods $SF_1, SF_2, \ldots, SF_n$;

the n subframe periods $SF_1, SF_2, \ldots, SF_n$ have: address (write in) periods $Ts_1, Ts_2, \ldots, Ts_n$, respectively; and sustain (turn on) periods $Ts_1, Ts_2, \ldots, Ts_n$, respectively;

there are a plurality of gate signal line selection periods within each of said n subframe periods, each of said plurality of gate signal line selection periods has m sub-gate signal line selection periods, and m is an integer which is greater than or equal to 2;

at most one gate signal line is selected within each of said m sub-gate signal line selection periods; and at most m gate signal lines are selected within each of said plurality of gate signal line selection periods.

14. An electronic device according to claim 13, wherein said electronic device is a device selected from the group consisting of: an OLED display, a video camera, head mounted display a DVD player, a personal computer, a portable telephone and a car audio.

15. An electronic device comprising: a source signal line driver circuit; a gate signal line driver circuit; and a pixel portion having a plurality of self light emitting elements arranged in a matrix shape; wherein:

one frame period has n subframe periods $SF_1, SF_2, \ldots, SF_n$ the n subframe periods $SF_1, SF_2, \ldots, SF_n$, have: address (write in) periods $Ta_1, Ta_2, \ldots, Ta_n$, respectively; and sustain (turn on) periods $Ts_1, Ts_2, \ldots, Ts_n$, respectively; and there are a plurality of gate signal line selection periods within each of said n subframe periods, each of said plurality of gate signal line selection periods has m sub-gate signal line selection periods, and m is an integer which is greater than or equal to 2;

at most one gate signal line is selected within each of said m sub-gate signal line selection periods;

at most m gate signal lines are selected within each of said plurality of gate signal line selection periods;

reset signal is inputted within such a period that an address period within one of said n sub frame periods and an address period within another one of said n subframe periods overlap; and said self light emitting elements are in turn off state within such a period that said reset signal is inputted.

16. An electronic device according to claim 15, wherein said electronic device is a device selected from the group consisting of an OLED display, a video camera, head mounted display a DVD player, a personal computer, a portable telephone and a car audio.

17. An electronic device comprising: a source signal line driver circuit; a gate signal line driver circuit; and a pixel portion in which a plurality of self light emitting elements are arranged in an matrix shape having a rows and b columns; wherein:

the source signal driver circuit uses a plurality of source driver circuits having: at least one first shift register circuit; a first memory circuit for storing a digital image signal; and a second memory circuit for storing an output signal of the first memory circuit; the gate signal line driver circuit uses a plurality of gate driver circuits having: at least one second shift register circuit; and at least one buffer circuit;

one frame period has n subframe periods $SF_1, SF_2, \ldots, SF_n$;

a plurality of gate signal line selection periods within the subframe periods has m sub-gate signal line selection periods;

write in to at most one gate signal line is performed in the sub-gate signal line selection periods;

write in of signals to at most m gate signal lines is completed within one gate signal line selection period, one source signal line is electrically connected to a maximum of m source driver circuits, through a first switching circuit;

one gate signal line is electrically connected to a maximum of m gate driver circuits, through a second switching circuit;

the source signal line driver circuit has a maximum of b×m source driver circuits; the gate signal line driver circuit has a maximum of a×m gate driver circuits;

the first switching circuit selects only one electrically connected source driver circuit, from among the m source driver circuits, during one dot data write in period, connects to the source signal line, and performs signal write in, and the second switching circuit selects only one electrically connected gate driver circuit, from among the m gate driver circuits, during one sub-gate signal line selection period, connects to the gate signal line, and performs write in.

18. An electronic device according to claim 17, wherein said electronic device is a device selected from the group consisting of: an OLED display, a video camera, head mounted display a DVD player, a personal computer, a portable telephone and a car audio.

* * * * *